US012569098B2

(12) United States Patent
Conrad

(10) Patent No.: US 12,569,098 B2
(45) **Date of Patent: *Mar. 10, 2026**

(54) SURFACE CLEANING APPARATUS

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton (CA)

( * ) Notice: Subject to any disclaimer, the term of this patent is extended or adjusted under 35 U.S.C. 154(b) by 10 days.

This patent is subject to a terminal disclaimer.

(21) Appl. No.: 18/379,119

(22) Filed: Oct. 11, 2023

(65) Prior Publication Data

US 2024/0032754 A1 Feb. 1, 2024

Related U.S. Application Data

(63) Continuation of application No. 17/458,128, filed on Aug. 26, 2021, which is a continuation-in-part of application No. 17/203,686, filed on Mar. 16, 2021, now Pat. No. 11,771,280, which is a continuation of application No. 16/822,708, filed on Mar. 18, 2020, now Pat. No. 11,730,327, and a continuation of application No. 16/823,191, filed on Mar. 18, 2020, now Pat. No. 11,666,193, and a continuation of (Continued)

(51) Int. Cl.
*A47L 9/16* (2006.01)
*A47L 9/32* (2006.01)

(52) U.S. Cl.
CPC ..... *A47L 9/1691* (2013.01); *A47L 9/322* (2013.01)

(58) Field of Classification Search
CPC ... A47L 5/24; A47L 5/225; A47L 5/28; A47L 9/1683; A47L 9/1691; A47L 9/22; A47L 9/246; A47L 9/28; A47L 9/2868; A47L 9/322

See application file for complete search history.

(56) References Cited

U.S. PATENT DOCUMENTS 1,600,762 A 9/1926 Charles
1,797,812 A 3/1931 Waring
(Continued)

FOREIGN PATENT DOCUMENTS

AU 112778 S 3/1990
CA 1077412 A1 5/1980
(Continued)

OTHER PUBLICATIONS

WIPO Translation CN-111870181; Hand-held Dust Collector; Chen, Ling-zun; Nov. 3, 2020 (Year: 2020).*
(Continued)

*Primary Examiner* — Brian D Keller
*Assistant Examiner* — Sidney D Full
(74) *Attorney, Agent, or Firm* — Philip C. Mendes da Costa; SMART & BIGGAR LP

(57) ABSTRACT

A hand vacuum cleaner has a cyclone unit, a front electrical connector and electrical conductors that extend from the front electrical connector to a source of power. The electrical conducts extend along a portion of a wall of the cyclone unit. When a cleaning tool is connected to the hand vacuum cleaner, the cleaning tool is connected in air flow communication with the dirty air inlet and the cleaning tool is electrically connected to the front electrical connector.

17 Claims, 36 Drawing Sheets

Related U.S. Application Data application No. 16/823,203, filed on Mar. 18, 2020, now Pat. No. 11,766,156, and a continuation of application No. 16/823,216, filed on Mar. 18, 2020, now Pat. No. 11,445,878.

(56) References Cited

U.S. PATENT DOCUMENTS

| | | | |
|---|---|---|---|
| 1,898,608 | A | 2/1933 | Alexander |
| 1,937,765 | A | 12/1933 | Leathers |
| 2,152,114 | A | 3/1939 | Van |
| 2,542,634 | A | 2/1951 | Davis et al. |
| 2,678,110 | A | 5/1954 | Madsen |
| 2,731,102 | A | 1/1956 | James |
| 2,811,219 | A | 10/1957 | Wenzl |
| 2,846,024 | A | 8/1958 | Bremi |
| 2,913,111 | A | 11/1959 | Rogers |
| 2,917,131 | A | 12/1959 | Evans |
| 2,937,713 | A | 5/1960 | Stephenson et al. |
| 2,942,691 | A | 6/1960 | Dillon |
| 2,942,692 | A | 6/1960 | Benz |
| 2,946,451 | A | 7/1960 | Culleton |
| 2,952,330 | A | 9/1960 | Winslow |
| 2,981,369 | A | 4/1961 | John, I et al. |
| 3,032,954 | A | 5/1962 | Racklyeft |
| 3,085,221 | A | 4/1963 | Joseph |
| 3,130,157 | A | 4/1964 | Kelsall et al. |
| 3,200,568 | A | 8/1965 | Mcneil |
| 3,204,772 | A | 9/1965 | Ruxton |
| 3,217,469 | A | 11/1965 | Eckert |
| 3,269,097 | A | 8/1966 | German |
| 3,320,727 | A | 5/1967 | Farley et al. |
| 3,372,532 | A | 3/1968 | Charles |
| 3,426,513 | A | 2/1969 | Kurt |
| 3,518,815 | A | 7/1970 | Mcfarland et al. |
| 3,530,649 | A | 9/1970 | Porsch et al. |
| 3,543,325 | A | 12/1970 | Hamrick |
| 3,561,824 | A | 2/1971 | Homan |
| 3,582,616 | A | 6/1971 | Wrob |
| 3,675,401 | A | 7/1972 | Cordes |
| 3,684,093 | A | 8/1972 | Kono et al. |
| 3,822,533 | A | 7/1974 | Oranje |
| 3,898,068 | A | 8/1975 | Mcneil |
| 3,933,450 | A | 1/1976 | Percevaut |
| 3,988,132 | A | 10/1976 | Oranje |
| 3,988,133 | A | 10/1976 | Schady |
| 4,097,381 | A | 6/1978 | Ritzler |
| 4,187,088 | A | 2/1980 | Hodgson |
| 4,218,805 | A | 8/1980 | Brazier |
| 4,236,903 | A | 12/1980 | Malmsten |
| 4,307,485 | A | 12/1981 | Dessig, III |
| 4,373,228 | A | 2/1983 | Dyson |
| 4,382,804 | A | 5/1983 | Mellor |
| 4,409,008 | A | 10/1983 | Solymes |
| 4,473,923 | A | 10/1984 | Neroni et al. |
| 4,486,207 | A | 12/1984 | Baillie |
| 4,494,270 | A | 1/1985 | Ritzau et al. |
| 4,523,936 | A | 6/1985 | Disanza, Jr. |
| 4,678,588 | A | 7/1987 | Shortt |
| 4,700,429 | A | 10/1987 | Martin et al. |
| 4,744,958 | A | 5/1988 | Pircon |
| 4,778,494 | A | 10/1988 | Patterson |
| 4,803,753 | A | 2/1989 | Palmer |
| 4,826,515 | A | 5/1989 | Dyson |
| 4,853,008 | A | 8/1989 | Dyson |
| 4,853,011 | A | 8/1989 | Dyson |
| 4,853,111 | A | 8/1989 | Macarthur et al. |
| 4,905,342 | A | 3/1990 | Ataka |
| 4,944,780 | A | 7/1990 | Usmani |
| 4,980,945 | A | 1/1991 | Bewley |
| 5,054,157 | A | 10/1991 | Werner et al. |
| 5,078,761 | A | 1/1992 | Dyson |
| 5,080,697 | A | 1/1992 | Finke |
| 5,090,976 | A | 2/1992 | Dyson |
| 5,129,125 | A | 7/1992 | Gamou et al. |
| 5,224,238 | A | 7/1993 | Bartlett |
| 5,230,722 | A | 7/1993 | Yonkers |
| 5,254,019 | A | 10/1993 | Noschese |
| 5,267,371 | A | 12/1993 | Soler et al. |
| 5,287,591 | A | 2/1994 | Rench et al. |
| 5,307,538 | A | 5/1994 | Rench et al. |
| 5,309,600 | A | 5/1994 | Weaver et al. |
| 5,309,601 | A | 5/1994 | Hampton et al. |
| 5,347,679 | A | 9/1994 | Saunders et al. |
| 5,358,290 | A | 10/1994 | Fleet et al. |
| 5,363,535 | A | 11/1994 | Rench et al. |
| 5,481,780 | A | 1/1996 | Daneshvar |
| 5,515,573 | A | 5/1996 | Frey |
| 5,599,365 | A | 2/1997 | Alday et al. |
| 5,709,007 | A | 1/1998 | Chiang |
| 5,755,096 | A | 5/1998 | Holleyman |
| 5,815,878 | A | 10/1998 | Murakami et al. |
| 5,815,881 | A | 10/1998 | Joergen |
| 5,858,038 | A | 1/1999 | Dyson et al. |
| 5,858,043 | A | 1/1999 | Geise |
| 5,893,938 | A | 4/1999 | Dyson et al. |
| 5,935,279 | A | 8/1999 | Lars |
| 5,950,274 | A | 9/1999 | Lars |
| 5,970,572 | A | 10/1999 | Thomas |
| 5,974,625 | A | 11/1999 | Garner |
| 6,071,095 | A | 6/2000 | Verkaart |
| 6,071,321 | A | 6/2000 | Trapp et al. |
| 6,080,022 | A | 6/2000 | Shaberman et al. |
| 6,098,244 | A | 8/2000 | Conrad et al. |
| 6,099,661 | A | 8/2000 | Conrad |
| 6,101,672 | A | 8/2000 | Conrad et al. |
| 6,122,796 | A | 9/2000 | Downham et al. |
| 6,123,779 | A | 9/2000 | Conrad et al. |
| 6,129,775 | A | 10/2000 | Conrad et al. |
| 6,135,708 | A | 10/2000 | Conrad et al. |
| 6,168,716 | B1 | 1/2001 | Conrad et al. |
| 6,170,119 | B1 | 1/2001 | Conrad et al. |
| 6,173,474 | B1 | 1/2001 | Conrad |
| 6,174,127 | B1 | 1/2001 | Conrad et al. |
| 6,183,641 | B1 | 2/2001 | Conrad et al. |
| 6,210,469 | B1 | 4/2001 | Tokar |
| 6,221,134 | B1 | 4/2001 | Conrad et al. |
| 6,224,325 | B1 | 5/2001 | Conrad et al. |
| 6,228,260 | B1 | 5/2001 | Conrad et al. |
| 6,231,645 | B1 | 5/2001 | Conrad et al. |
| 6,238,177 | B1 | 5/2001 | Conrad et al. |
| 6,243,917 | B1 | 6/2001 | Conrad |
| 6,251,296 | B1 | 6/2001 | Conrad et al. |
| 6,260,234 | B1 | 7/2001 | Wright et al. |
| 6,261,052 | B1 | 7/2001 | Conrad et al. |
| 6,261,379 | B1 | 7/2001 | Conrad et al. |
| 6,280,143 | B1 | 8/2001 | Parker et al. |
| 6,307,358 | B1 | 10/2001 | Conrad |
| 6,312,594 | B1 | 11/2001 | Conrad et al. |
| 6,328,527 | B1 | 12/2001 | Conrad et al. |
| 6,334,234 | B1 | 1/2002 | Conrad et al. |
| 6,344,064 | B1 | 2/2002 | Conrad |
| 6,345,408 | B1 | 2/2002 | Nagai et al. |
| 6,406,505 | B1 | 6/2002 | Oh et al. |
| 6,434,785 | B1 | 8/2002 | Vandenbelt et al. |
| 6,440,197 | B1 | 8/2002 | Conrad et al. |
| 6,457,205 | B1 | 10/2002 | Conrad |
| 6,502,278 | B2 | 1/2003 | Oh et al. |
| 6,519,810 | B2 | 2/2003 | Kim |
| 6,531,066 | B1 | 3/2003 | Saunders et al. |
| 6,533,834 | B2 | 3/2003 | Conrad et al. |
| 6,553,612 | B1 | 4/2003 | Dyson et al. |
| 6,553,613 | B2 | 4/2003 | Onishi et al. |
| 6,560,818 | B1 | 5/2003 | Hasko |
| 6,581,239 | B1 | 6/2003 | Dyson et al. |
| 6,599,338 | B2 | 7/2003 | Oh et al. |
| 6,599,340 | B2 | 7/2003 | Conrad et al. |
| 6,599,350 | B1 | 7/2003 | Rockwell et al. |
| 6,613,316 | B2 | 9/2003 | Sun et al. |
| 6,623,539 | B2 | 9/2003 | Lee et al. |
| 6,625,845 | B2 | 9/2003 | Matsumoto et al. |
| 6,640,385 | B2 | 11/2003 | Oh et al. |
| 6,648,934 | B2 | 11/2003 | Choi et al. |
| 6,712,868 | B2 | 3/2004 | Murphy et al. |

(56) References Cited

U.S. PATENT DOCUMENTS 6,732,403 B2 5/2004 Moore et al.
6,746,500 B1 6/2004 Park et al.
6,766,558 B1 7/2004 Matsumoto et al.
6,782,583 B2 8/2004 Oh
6,782,585 B1 8/2004 Conrad et al.
6,810,558 B2 11/2004 Lee
6,818,036 B1 11/2004 Seaman
6,833,015 B2 12/2004 Oh et al.
6,868,578 B1 3/2005 Kasper et al.
6,874,197 B1 4/2005 Conrad et al.
6,896,719 B2 5/2005 Coates et al.
6,929,516 B2 8/2005 Brochu et al.
7,329,294 B2 2/2008 Conrad
7,740,675 B2 6/2010 Conrad
7,749,293 B2 7/2010 Conrad
7,776,120 B2 8/2010 Conrad
7,803,207 B2 9/2010 Conrad
7,811,345 B2 10/2010 Conrad
7,867,308 B2 1/2011 Conrad
7,941,895 B2 5/2011 Conrad
8,127,398 B2 3/2012 Conrad
8,146,201 B2 4/2012 Conrad
8,151,407 B2 4/2012 Conrad
8,176,596 B2 5/2012 Conrad
8,192,515 B2 6/2012 Conrad
8,292,979 B2 10/2012 Conrad
8,296,900 B2 10/2012 Conrad
8,347,455 B2 1/2013 Dyson
8,349,428 B2 1/2013 Conrad
8,370,993 B2 2/2013 Conrad
8,375,508 B2 2/2013 Conrad
8,448,291 B2 5/2013 Conrad
8,479,358 B2 7/2013 Conrad
8,486,170 B2 7/2013 Conrad et al.
8,510,907 B2 8/2013 Conrad
8,533,904 B2 9/2013 Conrad
8,561,257 B2 10/2013 Conrad
8,567,005 B2 10/2013 Conrad
8,578,550 B2 11/2013 Conrad
8,578,553 B2 11/2013 Conrad
8,590,102 B2 11/2013 Conrad
8,607,407 B2 12/2013 Conrad
8,621,709 B2 1/2014 Conrad
8,640,304 B2 2/2014 Conrad
8,646,147 B2 2/2014 Conrad
8,659,184 B2 2/2014 Conrad
8,677,554 B2 3/2014 Conrad
8,677,558 B2 3/2014 Conrad
8,713,751 B2 5/2014 Conrad
8,813,305 B2 8/2014 Conrad
8,834,209 B2 9/2014 Conrad
8,869,344 B2 10/2014 Conrad
8,869,345 B2 10/2014 Conrad
8,869,348 B2 10/2014 Conrad
8,875,340 B2 11/2014 Conrad
8,875,342 B2 11/2014 Conrad
9,027,198 B2 5/2015 Conrad
9,027,203 B2 5/2015 Conrad et al.
9,066,642 B2 6/2015 Conrad
9,119,513 B2 9/2015 Conrad
9,161,666 B2 10/2015 Conrad
9,161,669 B2 10/2015 Conrad
9,167,944 B2 10/2015 Conrad
9,204,769 B2 12/2015 Conrad
9,204,773 B2 12/2015 Conrad
9,215,960 B2 12/2015 Conrad
9,226,633 B2 1/2016 Conrad et al.
9,227,151 B2 1/2016 Conrad
9,227,201 B2 1/2016 Conrad
9,232,881 B2 1/2016 Conrad
9,238,235 B2 1/2016 Conrad
9,295,995 B2 3/2016 Conrad
9,314,138 B2 4/2016 Conrad
9,314,139 B2 4/2016 Conrad et al.
9,320,401 B2 4/2016 Conrad
9,326,652 B2 5/2016 Conrad
9,364,127 B2 6/2016 Conrad
9,427,122 B2 8/2016 Conrad et al.
9,427,126 B2 8/2016 Conrad
9,433,332 B2 9/2016 Conrad
9,451,852 B2 9/2016 Conrad
9,451,853 B2 9/2016 Conrad et al.
9,451,855 B2 9/2016 Conrad
9,456,721 B2 10/2016 Conrad
9,492,045 B2 11/2016 Conrad
9,516,979 B2 12/2016 Gidwell
9,526,394 B2 12/2016 Conrad
9,572,463 B2 2/2017 Conrad
9,591,952 B2 3/2017 Conrad
9,591,958 B2 3/2017 Conrad
9,775,484 B2 10/2017 Conrad
9,801,513 B2 10/2017 Conrad et al.
9,820,621 B2 11/2017 Conrad et al.
10,076,183 B2 9/2018 Conrad et al.
10,149,587 B2 12/2018 Conrad et al.
10,159,393 B2 12/2018 Conrad
10,201,260 B2 2/2019 Conrad et al.
10,214,349 B2 2/2019 Conrad
10,251,519 B2 4/2019 Conrad
10,357,136 B2 7/2019 Conrad
10,537,216 B2 1/2020 Conrad
10,537,219 B2 1/2020 Conrad et al.
10,568,477 B2 2/2020 Conrad
10,575,693 B2 3/2020 Conrad
10,667,663 B2 6/2020 Conrad
10,687,679 B2 6/2020 Conrad et al.
10,729,294 B2 8/2020 Conrad et al.
10,791,890 B2 10/2020 Conrad
10,791,896 B2 10/2020 Conrad
10,888,205 B2 1/2021 Conrad et al.
10,932,634 B2 3/2021 Conrad
10,959,588 B2 3/2021 Conrad et al.
11,013,378 B2 5/2021 Conrad
11,108,254 B2 8/2021 Conrad
11,135,602 B2 10/2021 Conrad
11,154,169 B2 10/2021 Conrad
11,198,085 B2 12/2021 Conrad et al.
11,213,179 B2 1/2022 Conrad
11,246,462 B2 2/2022 Conrad
11,285,495 B2 3/2022 Conrad
11,318,482 B2 5/2022 Conrad
11,478,116 B2 10/2022 Conrad
11,478,117 B2 10/2022 Conrad et al.
11,529,034 B2 12/2022 Conrad
11,534,041 B2 12/2022 Conrad
11,534,043 B2 12/2022 Conrad
11,534,702 B2 12/2022 Conrad
11,547,258 B2 1/2023 Conrad
11,571,097 B2 2/2023 Conrad
11,612,290 B2 3/2023 Conrad
11,737,625 B2 8/2023 Conrad
11,745,131 B2 9/2023 Conrad
11,793,374 B2 10/2023 Conrad
11,839,343 B2 12/2023 Conrad et al.
11,841,024 B2 12/2023 Conrad
11,857,142 B2 1/2024 Conrad
11,950,745 B2 4/2024 Conrad et al.
12,082,766 B2 * 9/2024 Zhong ..... A47L 9/122
2001/0027587 A1 10/2001 Conrad et al.
2002/0011050 A1 1/2002 Hansen et al.
2002/0011053 A1 1/2002 Oh
2002/0062531 A1 5/2002 Oh
2002/0088208 A1 7/2002 Lukac et al.
2002/0112315 A1 8/2002 Conrad
2002/0134059 A1 9/2002 Oh
2002/0134238 A1 9/2002 Conrad et al.
2002/0162188 A1 11/2002 Harmen
2002/0178535 A1 12/2002 Oh et al.
2002/0178698 A1 12/2002 Oh et al.
2002/0178699 A1 12/2002 Oh
2003/0037403 A1 2/2003 Lang
2003/0046910 A1 3/2003 Lee et al.
2003/0066273 A1 4/2003 Choi et al.
2003/0106180 A1 6/2003 Tsen

(56) References Cited

U.S. PATENT DOCUMENTS

2003/0159238 A1 8/2003 Oh
2003/0159411 A1 8/2003 Hansen et al.
2003/0200736 A1 10/2003 Ni
2003/0201754 A1 10/2003 Conrad
2004/0010885 A1 1/2004 Hitzelberger et al.
2004/0025285 A1 2/2004 Mccormick et al.
2004/0045126 A1 3/2004 Parker et al.
2004/0216264 A1 11/2004 Shaver et al.
2004/0216266 A1 11/2004 Conrad
2005/0081321 A1 4/2005 Milligan et al.
2005/0115409 A1 6/2005 Conrad
2005/0132528 A1 6/2005 Yau
2005/0198769 A1 9/2005 Lee et al.
2005/0198770 A1 9/2005 Jung et al.
2005/0252179 A1 11/2005 Oh et al.
2005/0252180 A1 11/2005 Oh et al.
2006/0037172 A1 2/2006 Choi
2006/0042206 A1 3/2006 Arnold et al.
2006/0090290 A1 5/2006 Lau
2006/0123590 A1 6/2006 Fester et al.
2006/0137304 A1 6/2006 Jeong et al.
2006/0137306 A1 6/2006 Jeong et al.
2006/0137309 A1 6/2006 Jeong et al.
2006/0137314 A1 6/2006 Conrad et al.
2006/0156508 A1 7/2006 Khalil
2006/0162298 A1 7/2006 Oh et al.
2006/0162299 A1 7/2006 North
2006/0168922 A1 8/2006 Oh
2006/0168923 A1 8/2006 Lee et al.
2006/0196004 A1 9/2006 Conrad
2006/0207055 A1 9/2006 Ivarsson et al.
2006/0207231 A1 9/2006 Arnold
2006/0230715 A1 10/2006 Oh et al.
2006/0230723 A1 10/2006 Kim et al.
2006/0230724 A1 10/2006 Han et al.
2006/0236663 A1 10/2006 Oh
2006/0254226 A1 11/2006 Jeon
2006/0278081 A1 12/2006 Han et al.
2006/0288516 A1 12/2006 Sawalski
2007/0067944 A1 3/2007 Kitamura et al.
2007/0077810 A1 4/2007 Gogel et al.
2007/0079473 A1 4/2007 Min et al.
2007/0079585 A1 4/2007 Oh et al.
2007/0095028 A1 5/2007 Kim et al.
2007/0095029 A1 5/2007 Min et al.
2007/0136984 A1 6/2007 Hsu
2007/0209334 A1 9/2007 Conrad
2007/0209335 A1 9/2007 Conrad
2007/0271724 A1 11/2007 Hakan et al.
2007/0289089 A1 12/2007 Yacobi
2007/0289266 A1 12/2007 Oh
2008/0040883 A1 2/2008 Beskow et al.
2008/0047091 A1 2/2008 Nguyen
2008/0134460 A1 6/2008 Conrad
2008/0134462 A1 6/2008 Jansen et al.
2008/0172992 A1 7/2008 Conrad
2008/0178416 A1 7/2008 Conrad
2008/0178418 A1 7/2008 Conrad
2008/0178420 A1 7/2008 Conrad
2008/0179133 A1 7/2008 Conrad
2008/0189901 A1 8/2008 Jansen
2008/0190080 A1 8/2008 Oh et al.
2008/0196194 A1 8/2008 Conrad
2008/0196366 A1 8/2008 Conrad
2008/0196745 A1 8/2008 Conrad
2008/0216281 A1 9/2008 Conrad
2008/0301903 A1 12/2008 Cunningham et al.
2009/0044372 A1 2/2009 Knopow et al.
2009/0100633 A1 4/2009 Bates et al.
2009/0113659 A1 5/2009 Jeon et al.
2009/0144932 A1 6/2009 Yoo
2009/0165431 A1 7/2009 Oh
2009/0205160 A1 8/2009 Conrad
2009/0205161 A1 8/2009 Conrad
2009/0205298 A1 8/2009 Hyun et al.
2009/0209666 A1 8/2009 Hellberg et al.
2009/0265877 A1 10/2009 Dyson et al.
2009/0282639 A1 11/2009 Dyson et al.
2009/0300874 A1 12/2009 Tran et al.
2009/0300875 A1 12/2009 Inge et al.
2009/0307564 A1 12/2009 Vedantham et al.
2009/0307863 A1 12/2009 Milne et al.
2009/0308254 A1 12/2009 Oakham
2009/0313958 A1 12/2009 Gomiciaga-Pereda et al.
2009/0313959 A1 12/2009 Gomiciaga-Pereda et al.
2010/0083459 A1 4/2010 Beskow et al.
2010/0115726 A1* 5/2010 Groff ..... A47L 9/106 15/344
2010/0132319 A1 6/2010 Ashbee et al.
2010/0154150 A1 6/2010 Mcleod
2010/0175217 A1 7/2010 Conrad
2010/0212104 A1 8/2010 Conrad
2010/0224073 A1 9/2010 Oh et al.
2010/0229321 A1 9/2010 Dyson et al.
2010/0229323 A1 9/2010 Conrad
2010/0229324 A1 9/2010 Conrad
2010/0229325 A1 9/2010 Conrad
2010/0229326 A1 9/2010 Conrad
2010/0229328 A1 9/2010 Conrad
2010/0229334 A1 9/2010 Conrad
2010/0229335 A1 9/2010 Conrad
2010/0242210 A1 9/2010 Conrad
2010/0243158 A1 9/2010 Conrad
2010/0251507 A1 10/2010 Conrad
2010/0293745 A1 11/2010 Coburn
2010/0299865 A1 12/2010 Conrad
2010/0299866 A1 12/2010 Conrad
2011/0023261 A1 2/2011 Proffitt, II et al.
2011/0146024 A1 6/2011 Conrad
2011/0168332 A1 7/2011 Bowe et al.
2011/0219567 A1 9/2011 Conrad
2011/0219576 A1 9/2011 Conrad
2011/0219579 A1 9/2011 Conrad
2011/0289719 A1 12/2011 Han et al.
2012/0023701 A1 2/2012 Lenkiewicz et al.
2012/0030896 A1 2/2012 Crouch et al.
2012/0060322 A1 3/2012 Simonelli et al.
2012/0079671 A1 4/2012 Stickney et al.
2012/0216361 A1 8/2012 Millington et al.
2012/0222245 A1 9/2012 Conrad
2012/0222260 A1 9/2012 Conrad
2012/0222262 A1 9/2012 Conrad
2013/0160232 A1 6/2013 Peace
2014/0137362 A1 5/2014 Smith
2014/0137363 A1 5/2014 Wilson
2014/0137364 A1 5/2014 Stickney et al.
2014/0182080 A1 7/2014 Lee et al.
2014/0208538 A1 7/2014 Visel et al.
2014/0237768 A1 8/2014 Conrad
2014/0237956 A1 8/2014 Conrad
2015/0000464 A1 1/2015 De La Maza Uriarte
2015/0135474 A1 5/2015 Gidwell
2015/0230677 A1 8/2015 Andrikanish
2015/0297050 A1 10/2015 Marsh et al.
2016/0113460 A1 4/2016 Williams et al.
2017/0290480 A1* 10/2017 Conrad ..... A47L 5/26
2018/0055320 A1* 3/2018 Hwang ..... A47L 9/22
2020/0305671 A1 10/2020 Conrad
2021/0228032 A1 7/2021 Conrad
2021/0330157 A1 10/2021 Conrad
2021/0386258 A1 12/2021 Conrad
2022/0142440 A1 5/2022 Conrad
2022/0151446 A1 5/2022 Conrad et al.
2023/0098664 A1 3/2023 Conrad
2023/0263350 A1 8/2023 Conrad et al.
2023/0348169 A1 11/2023 Conrad
2024/0016351 A1 1/2024 Conrad
2024/0138634 A1 5/2024 Conrad

(56) References Cited

U.S. PATENT DOCUMENTS

| | | | |
|---|---|---|---|
| 2024/0180373 | A1 | 6/2024 | Conrad et al. |
| 2024/0358212 | A1 | 10/2024 | Conrad |

FOREIGN PATENT DOCUMENTS

| | | | | | |
|---|---|---|---|---|---|
| CA | 1218962 | A1 | | 3/1987 | |
| CA | 2275675 | A1 | | 12/1999 | |
| CA | 2288544 | A1 | | 5/2000 | |
| CA | 2258416 | A1 | | 7/2000 | |
| CA | 2258419 | A1 | | 7/2000 | |
| CA | 2258421 | A1 | | 7/2000 | |
| CA | 2258422 | A1 | | 7/2000 | |
| CA | 2258423 | A1 | | 7/2000 | |
| CA | 2258426 | A1 | | 7/2000 | |
| CA | 2330801 | A1 | | 7/2001 | |
| CA | 2338193 | A1 | | 7/2002 | |
| CA | 2339514 | A1 | | 9/2002 | |
| CA | 2342673 | A1 | | 9/2002 | |
| CA | 2342993 | A1 | | 9/2002 | |
| CA | 2450450 | C | | 4/2007 | |
| CA | 2438079 | C | | 8/2009 | |
| CA | 2658014 | A1 | | 9/2010 | |
| CA | 2658022 | A1 | | 9/2010 | |
| CA | 2658160 | A1 | | 9/2010 | |
| CA | 2658366 | A1 | | 9/2010 | |
| CA | 2658397 | A1 | | 9/2010 | |
| CA | 2658497 | A1 | | 9/2010 | |
| CA | 2658643 | A1 | | 9/2010 | |
| CA | 2658644 | A1 | | 9/2010 | |
| CA | 2659212 | A1 | | 9/2010 | |
| CA | 2484587 | C | | 1/2011 | |
| CH | 203675 | A | | 3/1939 | |
| CN | 1336154 | A | | 2/2002 | |
| CN | 1434688 | A | | 8/2003 | |
| CN | 1493244 | A | | 5/2004 | |
| CN | 1626025 | A | | 6/2005 | |
| CN | 1875846 | A | | 12/2006 | |
| CN | 1875855 | A | | 12/2006 | |
| CN | 1887437 | A | | 1/2007 | |
| CN | 1895148 | A | | 1/2007 | |
| CN | 101061932 | A | | 10/2007 | |
| CN | 101095604 | A | | 1/2008 | |
| CN | 101108106 | A | | 1/2008 | |
| CN | 101108110 | A | | 1/2008 | |
| CN | 101448447 | A | | 6/2009 | |
| CN | 101489453 | A | | 7/2009 | |
| CN | 101489457 | A | | 7/2009 | |
| CN | 101489461 | A | | 7/2009 | |
| CN | 201290642 | Y | | 8/2009 | |
| CN | 101822506 | A | | 9/2010 | |
| CN | 101108081 | B | | 10/2010 | |
| CN | 201683850 | U | | 12/2010 | |
| CN | 101489455 | B | | 6/2012 | |
| CN | 202739907 | U | | 2/2013 | |
| CN | 202932850 | U | | 5/2013 | |
| CN | 203724037 | U | | 7/2014 | |
| CN | 102256523 | B | | 11/2014 | |
| CN | 204363891 | U | | 6/2015 | |
| CN | 102188208 | B | | 3/2016 | |
| CN | 105816104 | A | | 8/2016 | |
| CN | 205671986 | U | | 11/2016 | |
| CN | 108402988 | A | * | 8/2018 | ..... A47L 5/24 |
| CN | 109171552 | A | * | 1/2019 | ..... A47L 9/00 |
| CN | 111870181 | A | * | 11/2020 | |
| DE | 375134 | C | | 5/1923 | |
| DE | 10056935 | C2 | | 1/2003 | |
| DE | 102007011457 | A1 | | 10/2007 | |
| DE | 112010001135 | T5 | | 8/2012 | |
| DE | 202010018047 | U1 | | 11/2013 | |
| DE | 102012211246 | A1 | | 1/2014 | |
| DE | 202010018084 | U1 | | 2/2014 | |
| DE | 202010018085 | U1 | | 2/2014 | |
| EP | 489498 | A1 | | 6/1992 | |
| EP | 493950 | B1 | | 4/1998 | |
| EP | 1200196 | B1 | | 6/2005 | |
| EP | 1815777 | A1 | | 8/2007 | |
| EP | 1594386 | B1 | | 4/2009 | |
| EP | 1676516 | B1 | | 1/2010 | |
| EP | 2308360 | A2 | | 4/2011 | |
| EP | 1629758 | B1 | | 10/2013 | |
| EP | 2848173 | A1 | | 3/2015 | |
| FR | 1094603 | A | | 5/1955 | |
| FR | 2812531 | B1 | | 11/2004 | |
| GB | 194963 | A | | 3/1923 | |
| GB | 700791 | A | | 12/1953 | |
| GB | 1111074 | A | | 4/1968 | |
| GB | 2035787 | A | | 6/1980 | |
| GB | 2163703 | B | | 1/1988 | |
| GB | 2268875 | A | | 1/1994 | |
| GB | 2307849 | A | | 6/1997 | |
| GB | 2282979 | B | | 10/1997 | |
| GB | 2365324 | B | | 7/2002 | |
| GB | 2440111 | A | | 1/2008 | |
| GB | 2441962 | B | | 3/2011 | |
| GB | 2465781 | B | | 10/2012 | |
| GB | 2466290 | B | | 10/2012 | |
| GB | 2508035 | B | | 3/2015 | |
| JP | 61131720 | A | | 6/1986 | |
| JP | 2000140533 | A | | 5/2000 | |
| JP | 2002085297 | A | | 3/2002 | |
| JP | 2003135335 | A | | 5/2003 | |
| JP | 2005040246 | A | | 2/2005 | |
| JP | 2006102034 | A | | 4/2006 | |
| JP | 2008206613 | A | | 9/2008 | |
| JP | 2009261501 | A | | 11/2009 | |
| JP | 2010081968 | A | | 4/2010 | |
| JP | 2010178773 | A | | 8/2010 | |
| JP | 2010220632 | A | | 10/2010 | |
| JP | 2011189132 | A | | 9/2011 | |
| JP | 2011189133 | A | | 9/2011 | |
| JP | 2013086228 | A | | 5/2013 | |
| KR | 1020010045598 | A | | 6/2001 | |
| KR | 1020020067489 | A | | 8/2002 | |
| KR | 1020020085478 | A | | 11/2002 | |
| KR | 1020040050174 | A | | 6/2004 | |
| KR | 1020060008365 | A | | 1/2006 | |
| KR | 1020060118795 | A | | 11/2006 | |
| KR | 1020060118800 | A | | 11/2006 | |
| KR | 1020060118802 | A | | 11/2006 | |
| KR | 1020060118803 | A | | 11/2006 | |
| KR | 1020060122249 | A | | 11/2006 | |
| KR | 1020060125952 | A | | 12/2006 | |
| KR | 1020060125954 | A | | 12/2006 | |
| KR | 1020100084127 | A | | 7/2010 | |
| WO | 8002561 | A1 | | 11/1980 | |
| WO | 0010718 | A1 | | 3/2000 | |
| WO | 2004069021 | A1 | | 8/2004 | |
| WO | 2006076363 | A3 | | 12/2006 | |
| WO | 2007084543 | A2 | | 7/2007 | |
| WO | 2006026414 | A3 | | 8/2007 | |
| WO | 2008009883 | A1 | | 1/2008 | |
| WO | 2008009888 | A1 | | 1/2008 | |
| WO | 2008009890 | A1 | | 1/2008 | |
| WO | 2008009891 | A1 | | 1/2008 | |
| WO | 2008035032 | A3 | | 6/2008 | |
| WO | 2008070973 | A1 | | 6/2008 | |
| WO | 2008088278 | A2 | | 7/2008 | |
| WO | 2008135708 | A1 | | 11/2008 | |
| WO | 2009026709 | A1 | | 3/2009 | |
| WO | 2010102396 | A1 | | 9/2010 | |
| WO | 2010142968 | A1 | | 12/2010 | |
| WO | 2010142969 | A1 | | 12/2010 | |
| WO | 2010147247 | A1 | | 12/2010 | |

OTHER PUBLICATIONS

PE2E Translation of CN-109171552-A; Lin, Tong; Cleaning Tool; Jan. 11, 2019 (Year: 2019).*

PE2E Translation CN-108402988; Cleaning Machine; Chai, Yongbi; Aug. 17, 2018 (Year: 2018).*

English machine translation of KR1020060125954A , published on Dec. 7, 2006.

(56) References Cited

OTHER PUBLICATIONS

English machine translation of KR1020060125952A, published on Dec. 7, 2006.
English machine translation of KR1020100084127A, published on Jul. 23, 2010.
English machine translation of KR1020040050174A, published on Jun. 16, 2004.
English machine translation of KR1020060118800A, published on Nov. 24, 2006.
English machine translation of KR1020060118802A, published on Nov. 24, 2006.
English machine translation of KR1020060118795A, published on Nov. 24, 2006.
English machine translation of KR1020060008365A , published on Jan. 26, 2006.
English machine translation of KR1020060122249A, published on Nov. 30, 2006.
English machine translation of KR1020020085478A, published on Jan. 24, 2008.
English machine translation of KR1020060118803A, published on Nov. 24, 2006.
English machine translation of JP2006102034A, published on Apr. 20, 2006.
English machine translation of JP2013086228A, published on May 13, 2013.
English machine translation of JP2008206613A, published on Sep. 11, 2008.
English machine translation of JP2010220632A, published on Oct. 7, 2010.
English machine translation of KR1020020067489A, published on Aug. 22, 2002.
English machine translation of JP2010178773A, published on Aug. 19, 2010.
English machine translation of JP2000140533A, published on May 23, 2000.
English machine translation of JP2011189132A, published on Sep. 29, 2011.
English machine translation of JP2010081968A, published on Apr. 15, 2010.
English machine translation of JP61131720A, published on Jun. 19, 1986.
English machine translation of JP2003135335A, published on May 13, 2003.
English machine translation of KR1020010045598A , published on Jun. 5, 2001.
English machine translation of JP2002085297A, published on Mar. 26, 2002.
English machine translation of JP2005040246A, published on Feb. 17, 2005.
English machine translation of JP2009261501A , published on Nov. 12, 2009.
English machine translation of JP2011189133A, published on Sep. 9, 2011.
English machine translation of CN1336154A, published on Feb. 20, 2002.
English machine translation of CN105816104A , published on Aug. 3, 2016.
English machine translation of CN102188208B , published on Mar. 2, 2016.
English machine translation of CN101061932A, published on Oct. 31, 2007.
English machine translation of CN101448447A , published on Jun. 3, 2009.
English machine translation of CN1887437A, published on Jan. 3, 2007.
English machine translation of CN101095604A , published on Jan. 2, 2008.
English machine translation of CN101108106A, published on Jan. 23, 2008.
English machine translation of CN1434688A, published on Aug. 6, 2003.
English machine translation of CN101489461A, published on Jul. 22, 2009.
English machine translation of CN1626025A , published on Jun. 15, 2005.
English machine translation of CN1875846A, published on Dec. 13, 2006.
English machine translation of CN101489457A, published on Jul. 22, 2009.
English machine translation of CN101108081B, published on Oct. 27, 2010.
English machine translation of CN101489455B , published on Jun. 27, 2012.
English machine translation of CN101489453A , published on Jul. 22, 2009.
English machine translation of CN101822506A, published on Sep. 8, 2010.
English machine translation of CN101108110A, published on Jan. 23, 2008.
English machine translation of CN1493244A, published on May 5, 2004.
English machine translation of CN1875855A, published on Dec. 13, 2006.
English machine translation of CN102256523B, published on Nov. 5, 2014.
English machine translation of DE202010018047U1, published on Nov. 14, 2013.
English machine translation of CN202932850U, published on May 15, 2013.
English machine translation of DE112010001135T5, published on Aug. 2, 2012.
English machine translation of CN205671986U, published on Nov. 9, 2016.
English machine translation of CN1895148A, published on Jan. 17, 2007.
English machine translation of CN201683850U , published on Dec. 29, 2010.
English machine translation of DE202010018084U1 , published on Feb. 27, 2014.
English machine translation of DE202010018085U1, published on Feb. 27, 2014.
English machine translation of DE102012211246A1, published on Jan. 2, 2014.
English machine translation of CN203724037U, published on Jul. 23, 2014.
English machine translation of DE10056935C2, published on Jan. 16, 2003.
English machine translation of CN204363891U, published on Jun. 3, 2015.
English machine translation of CN201290642Y, published on Aug. 19, 2009.
English machine translation of DE102007011457A1, published on Oct. 25, 2007.
English machine translation of CN202739907U , published on Feb. 20, 2013.
English machine translation of DE375134C, published on May 7, 1923.
English machine translation of FR2812531B1, published on Nov. 5, 2004.
Translation Portal EPO: English machine translation of French Patent No. FR1094603A, published on May 23, 1955.
Translation Portal EPO: English machine translation of Swiss Patent No. CH203675A, published on Mar. 31, 1939.
U.S. Appl. No. 09/343,479, filed Jun. 30, 1999.

* cited by examiner

SURFACE CLEANING APPARATUS

CROSS-REFERENCE TO RELATED APPLICATION

This application is a continuation of U.S. patent application Ser. No. 17/458,128, which was filed on Aug. 26, 2021, which itself is a continuation-in-part of U.S. patent application Ser. No. 17/203,686 filed on Mar. 16, 2021 and issued as U.S. Pat. No. 11,771,280 on Oct. 3, 2023, which is:

- a continuation of U.S. patent application Ser. No. 16/822,708 filed on Mar. 18, 2020 and issued as U.S. Pat. No. 11,730,327 on Aug. 22, 2022;
- a continuation of U.S. patent application Ser. No. 16/823,191 filed on Mar. 18, 2020 and issued as U.S. Pat. No. 11,666,193 on Jun. 6, 2023;
- a continuation of U.S. patent application Ser. No. 16/823,203 filed on Mar. 18, 2020 and issued as U.S. Pat. No. 11,766,156 on Sep. 26, 2023; and,
- a continuation of U.S. patent application Ser. No. 16/823,216 filed on Mar. 18, 2020 which issued as U.S. Pat. No. 11,445,878 on Sep. 20, 2022, the disclosure of each of which is hereby incorporated herein by reference.

FIELD

This disclosure relates generally to surface cleaning apparatus such as hand vacuum cleaners, upright vacuum cleansers, stick vacuum cleaners or canister vacuum cleaners, and in particular portable surface cleaning apparatus, such as hand vacuum cleaners.

INTRODUCTION

The following is not an admission that anything discussed below is part of the prior art or part of the common general knowledge of a person skilled in the art.

Various types of surface cleaning apparatus are known, including upright surface cleaning apparatus, canister surface cleaning apparatus, stick surface cleaning apparatus, central vacuum systems, and hand carriable surface cleaning apparatus such as hand vacuum cleaners. Further, various designs for cyclonic surface cleaning apparatus, including battery operated cyclonic hand vacuum cleaners are known in the art.

SUMMARY

The following introduction is provided to introduce the reader to the more detailed discussion to follow. The introduction is not intended to limit or define any claimed or as yet unclaimed invention. One or more inventions may reside in any combination or sub-combination of the elements or process steps disclosed in any part of this document including its claims and figures.

In accordance with another aspect of this disclosure, which may be used alone or in combination with any other aspect, a hand vacuum cleaner has a power connection (an accessory power connector) to which an accessory may be removably connected (e.g., a powered floor cleaning tool), and the power connection for the accessory is provided as part of a removable air treatment member or a part of an air treatment member that is moveable with respect to the hand vacuum cleaner. For example, a removeable air treatment member may be removably mounted to a main body of the hand vacuum, wherein the main body houses the suction motor. The air treatment member includes a bin electrical connector while the main body includes a corresponding body electrical connector such that power may be transferred from the body connector to the bin connector, which is electrically connected to the accessory power connector by, electrically conductive members. This may allow the air treatment member to be more easily removed while still allowing for a desirable location for the power connector. For example, the air treatment member may remove forwardly, and the accessory power connector may be on a forward end of the bin. The bin connector may be on an opposite side of the bin. For example, the bin connector may be on a rear of the bin while the accessory power connector is on a front of the bin. The bin may be mounted to the body with a rear of the bin in contact with the body and the front of the bin carrying a nozzle or connection point for an air flow connection between the bin and the accessory. Alternately, the accessory power connector may be on part of the air treatment member that is moveable mounted to the main body or another portion of the air treatment member. For example, a portion of the air treatment member may pivot to an open position to enable the air treatment member to be emptied and the accessory power connector may be on the moveable portion of the air treatment member.

In accordance with another aspect of this disclosure, which may be used alone or in combination with any other aspect, the hand vacuum cleaner is configured such that removing the air treatment member allows access the post-motor filter to be accessed. Accordingly, the post-motor filter may be inaccessible when the air treatment member is attached. For example, the filter housing may include a removeable portion (e.g., a removable cover) that is removeable such that the filter in the housing may be removed (e.g., lifted out) of the housing. A latch on another body portion (e.g., the main body of the hand vacuum cleaner) may hold the removable portion in position over the filter and may be accessible once part or all of the air treatment member is removed, such that the latch may be released when the air treatment member is removed. Alternatively, a latch provided on the removeable portion may hold the removeable portion in position over the filter and may be accessible once the air treatment member is removed, such that the latch may be released when the air treatment member is removed.

In accordance with another aspect of this disclosure, which may be used alone or in combination with any other aspect, a hand vacuum cleaner may have a transversely extending bleed valve. The bleed valve may have a longitudinal axis that is generally perpendicular to the longitudinal axis (front to rear) of the surface cleaning apparatus, the cyclone axis of rotation, and/or the motor axis of rotation. The air inlet of the bleed valve may be on one side of the centre line (laterally positioned) of the hand vacuum, and the bleed valve may extend transverse to the air inlet direction of the air inlet to the hand vacuum. The bleed valve inlet may be a laterally directed inlet (i.e., it may face laterally and may be in a plane that is generally parallel to a lateral side of the hand vacuum cleaner). The air inlet of the bleed valve and/or the air inlet of the bleed valve housing may be directed towards a lateral side of the surface cleaning apparatus or may be on a lateral side of the surface cleaning apparatus. A finger gap may be between the pistol grip handle and the bleed valve. A transversely extending bleed valve may allow for a more compact construction, as the bleed valve may have a smaller size along a longitudinal axis of the hand vacuum.

In accordance with another aspect of this disclosure, which may be used alone or in combination with any other aspect, a hand vacuum cleaner may have a control panel on the rear face of the hand vacuum. The control panel may contain one or more toggles (e.g., a button or touchscreen) operable to control the surface cleaning apparatus or a component of the surface cleaning apparatus (e.g., to turn on the motor or adjust a speed setting of the motor). The control panel may be located on a rear external surface of the surface cleaning apparatus and/or on a centre line of the surface cleaning apparatus. A rear-facing control panel may be easily accessible.

In accordance with another aspect of this disclosure, which may be used alone or in combination with any other aspect, a hand vacuum cleaner may have a portion of the motor extend into an adjacent component. For example, a hand vacuum may have a compact overall form, for example so it can be maneuvered around and/or between objects when being carried by a user while cleaning one or more surfaces. A compact form may also improve the ergonomics of the hand vacuum cleaner (e.g., the perceived balance or 'hand feel' when carried by a user) and well as permit the hand vacuum cleaner to be stored in a smaller place. A hand vacuum cleaner may include a handle for use in maneuvering the hand vacuum cleaner and/or a post-motor filter for filtering exhaust air (e.g., a post motor filter housed in a post-motor filter housing). One or more components (e.g., the handle and/or the post-motor filter) may have a space or volume inside that is not fully utilized (e.g., particularly if the handle is not filled with, e.g., batteries). Extending a portion of the suction motor (e.g., a portion of a brush of a brushed motor) into the handle, post-motor filter, and/or post-motor filter housing may promote a compact design (e.g., reduce the overall size of the hand vacuum cleaner). This may provide increased maneuverability and accessibility for a user of the hand vacuum cleaner.

In accordance with another aspect of this disclosure, which may be used alone or in combination with any other aspect, a hand vacuum cleaner may be laterally balanced. Lateral balance may contribute to an improved hand-feel. A hand vacuum cleaner may have a motor with brushes, and the brushes may be centered. The brushes may be oriented directly above one another on a vertically and longitudinally extending (i.e., in the direction of the motor axis of rotation) centre plane of the surface cleaning apparatus, or the brushes may be located within a centrally located zone around the vertically and longitudinally extending centre plane (e.g., a zone between parallel vertical planes tangential to the right and left edges of the handle and parallel to the motor axis of rotation). A hand vacuum cleaner may have the vortex finder, the brushes, and the handle aligned such that a vertical plane passes through the vortex finder, the brushes, and the handle, or such that all of the vortex finder, the brushes, and the handle are within the central zone between two planes. This aspect may provide better lateral balance and/or better alignment of the components (e.g., for improved performance or reduced size).

In accordance with another aspect of this disclosure, which may be used alone or in combination with any other aspect, a hand vacuum cleaner may have a centre of gravity centred within the main body of the hand vacuum cleaner. The centre of gravity may be within a vertical and/or horizontal projection of the handle (i.e., between parallel vertical planes tangential to the right and left edges of the handle). In some examples, components inside the main body are not centred, but are arranged to balance one another so that the main body looks and feels balanced. For example, the centre of gravity of the motor and the centre of gravity of the energy storage members (e.g., batteries) may each be off the central plane and/or outside the central zone but balanced such that the centre of gravity of the hand vacuum as a whole is on the central plane and/or inside the central zone. This aspect may provide a better hand feel.

In accordance with another aspect of this disclosure, which may be used alone or in combination with any other aspect, a hand vacuum cleaner may have an air treatment member that includes a uniflow cyclone. The uniflow cyclone may be more compact than a reversing cyclone.

In accordance with another aspect of this disclosure, which may be used alone or in combination with any other aspect, a hand vacuum cleaner may have a handle that is in line with further components of the vacuum. The hand vacuum may have a handle that is in-line with at least one additional component, such as the bleed valve, the air treatment member, the dirt collection chamber, the cyclone, and/or a front openable door. Alternately or in addition, a vortex finder and/or fluff screen of a hand vacuum cleaner may be in-line with other components of the surface cleaning apparatus. The hand vacuum cleaner may include a vortex finder and/or fluff screen arranged such that a longitudinal projection of the vortex finder/fluff screen extends through the suction motor and the accessory electrical connector. Alternately or in addition, a motor of the hand vacuum cleaner may be in-line with other components, such as the accessory electrical connector, the cyclone, the pre-motor filter, and/or the rear-facing control panel. The alignment of components may result in better lateral balance, improved performance, and/or reduced overall size of the hand vacuum.

In accordance with one aspect of this disclosure, which may be used alone or in combination with any other aspect, a hand vacuum cleaner may have a power cord entering a rear of handle and extending to a motor at the top of the handle. An electrical conductor, e.g., wires, may extend through the handle from a lower end of the handle to an upper end of the handle. The power line may enter the handle at a rear of the handle and extend to the motor that is at the top of the handle or that is within the handle (e.g., if the motor extends into the handle). The power cord may be provided in addition to an on board energy storage member, (e.g., batteries), or the hand vacuum cleaner may be provided without an on board energy storage member. An on board energy storage member may allow a greater flexibility of use of the hand vacuum cleaner, but may be heavy and contribute to a larger overall size of the hand vacuum cleaner.

In accordance with another aspect of this disclosure, which may be used alone or in combination with any other aspect, a hand vacuum cleaner may include a base of the handle having a high-friction or an anti-skid surface. If the hand vacuum cleaner is mounted to a wand and a floor cleaning head so as to form a stick vacuum cleaner, this may allow a user to store the stick vacuum cleaner adjacent a wall (i.e., the floor cleaning head is adjacent the wall and the base of the handle contacts the wall) without the hand vacuum falling due to the base of the handle sliding across the wall. This may allow the user to more securely store the hand vacuum cleaner in a stick vacuum cleaner configuration.

In accordance with another aspect of this disclosure, which may be used alone or in combination with any other aspect, a hand vacuum cleaner may operate with a sound damping feature. The air flow path from the motor may extend through apertures designed to reduce sound transmission. The apertures may be smaller than the wavelength of the sound frequencies that are to be blocked (e.g., to reduce sound transmission at those frequencies). The apertures may be downstream of the cyclone and/or downstream of the motor, and may be at or near the air outlet of the air flow path. This may reduce the external experience of undesirable frequencies of sound.

It will be appreciated by a person skilled in the art that an apparatus or method disclosed herein may embody any one or more of the features contained herein and that the features may be used in any particular combination or sub-combination.

These and other aspects and features of various embodiments will be described in greater detail below.

BRIEF DESCRIPTION OF THE DRAWINGS

For a better understanding of the described embodiments and to show more clearly how they may be carried into effect, reference will now be made, by way of example, to the accompanying drawings in which.

Figure 1:
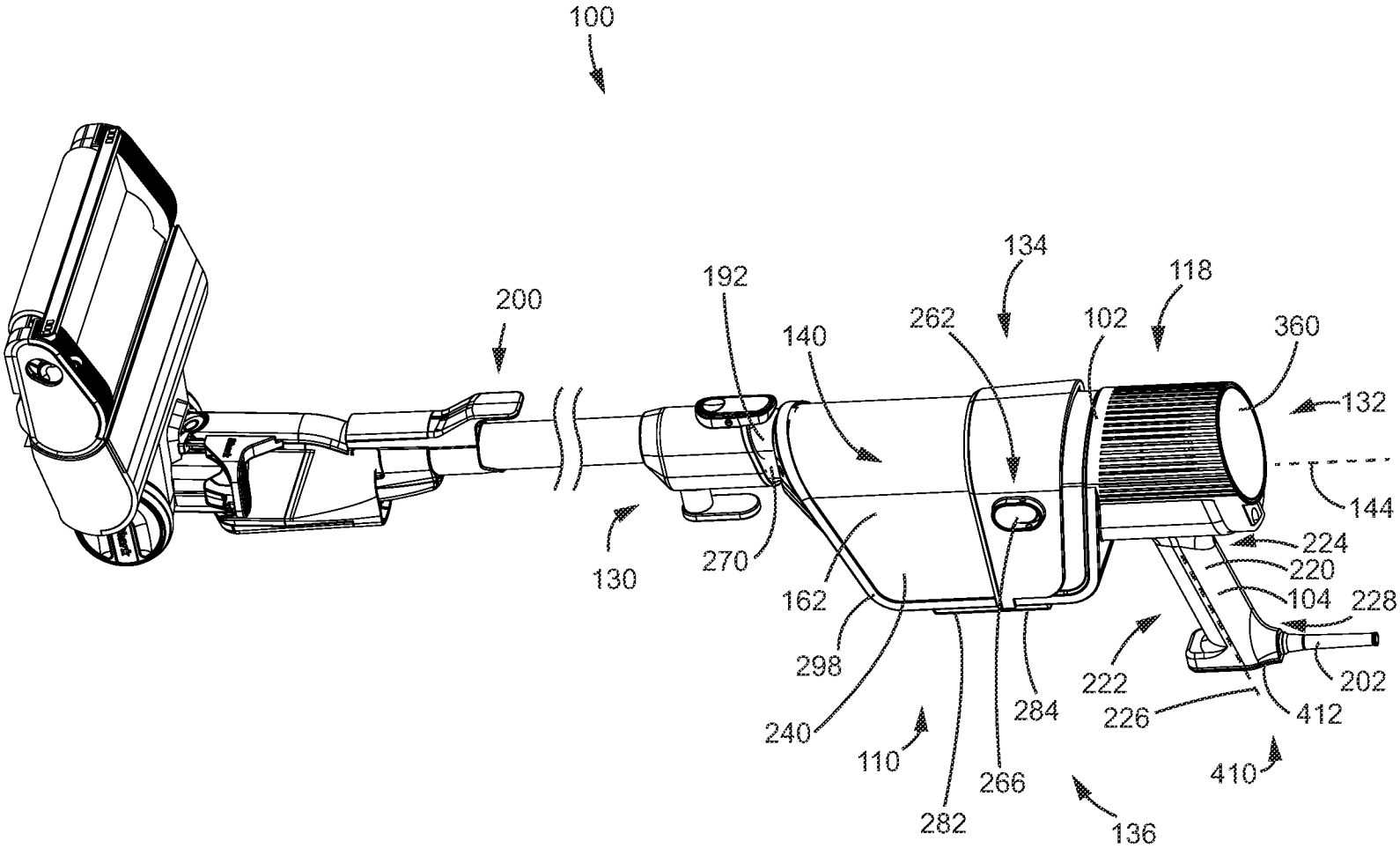
FIG. 1 is a perspective view from the side and the rear of a hand vacuum cleaner, in accordance with an embodiment.

The drawings included herewith are for illustrating various examples of articles, methods, and apparatuses of the teaching of the present specification and are not intended to limit the scope of what is taught in any way.

DESCRIPTION OF EXAMPLE EMBODIMENTS

Various apparatuses, methods and compositions are described below to provide an example of an embodiment of each claimed invention. No embodiment described below limits any claimed invention and any claimed invention may cover apparatuses and methods that differ from those described below. The claimed inventions are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", or "fastened" where the parts are joined or operate together either directly or indirectly (i.e., through one or more intermediate parts), so long as a link occurs. As used herein and in the claims, two or more parts are said to be "directly coupled", "directly connected", "directly attached", or "directly fastened" where the parts are connected in physical contact with each other. None of the terms "coupled", "connected", "attached", and "fastened" distinguish the manner in which two or more parts are joined together.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

General Description of a Surface Cleaning Apparatus

Referring to FIGS. 1, 18, 29, and 34, exemplary embodiments of a surface cleaning apparatus are shown generally as 100. The illustrated example surface cleaning apparatus are each hand vacuum cleaners, which may also be referred to as "handvacs" or "hand-held vacuum cleaners".

As used herein, a hand vacuum cleaner is a vacuum cleaner that can be operated to clean a surface generally one-handedly. That is, the entire weight of the vacuum may be held by the same one hand used to direct a dirty air inlet of the vacuum cleaner with respect to a surface to be cleaned. For example, the handle and a clean air inlet may be rigidly coupled to each other (directly or indirectly) so as to move as one while maintaining a constant orientation relative to each other. This is to be contrasted with canister and upright vacuum cleaners, whose weight is typically supported by a surface (e.g., a floor) during use. It will also be appreciated that the hand vacuum cleaner may be mounted to an outlet end of a wand which is pivotally mounted to a surface cleaning head so as to provide a stick type vacuum cleaner (see for example FIG. 1).

It will be appreciated that any one or more of the features of the surface cleaning apparatus 100 set out herein may alternately be used in any type of surface cleaning apparatus, such as an upright surface cleaning apparatus, a stick vac, a canister surface cleaning apparatus, an extractor or the like. It will also be appreciated that a surface cleaning apparatus may use any configuration of the operating components and the airflow paths exemplified herein.

As exemplified, the surface cleaning apparatus 100 includes a main body 102 comprising a housing and a handle 104. It will be appreciated that the housing and/or handle 104 of the surface cleaning apparatus 100 may be in other configurations, shapes, and/or positions in other examples. The surface cleaning apparatus 100 also includes an air treatment member assembly 110 connected to the main body 102, a dirty air inlet 116, a clean air outlet 118, and an air flow path extending between the dirty air inlet 116 and the clean air outlet 118.

The air treatment member assembly 110 may be a single cleaning stage (such as a single cyclonic stage, which may comprise one or more cyclones in parallel, or a single non-cyclonic momentum separator chamber) and, as such, the air treatment member assembly 110 may be referred to as an air treatment member 110.

As exemplified in FIGS. 2, 19, 30, and 35, the air flow path 120 extends through the air treatment member 110 such that air flowing through the air flow path 120 may be treated by the air treatment member 110. The air flow path 120 may be referred to as a primary or first air flow path. It will be appreciated that the surface cleaning apparatus 100 may include one or more additional discrete or branched air flow paths, such as an air flow path through a battery pack to cool the batteries, an additional or alternative air flow path to the air treatment member assembly 110 (e.g., an above for cleaning hose for an upright vacuum cleaner), or a separate air path over the motor to cool the motor.

As exemplified in FIGS. 1, 8, 18, 29 and 34, the surface cleaning apparatus 100 has a front end 130, a rear end 132, an upper end or top 134, and a lower end or bottom 136. The surface cleaning apparatus 100 also has first and second laterally opposed sides 140, 142 spaced apart in a direction transverse to a central longitudinal axis 144, which extends in the forward/rearward direction. Preferably, when the upper end 134 of the surface cleaning apparatus 100 is positioned above the lower end 136, the central longitudinal axis 144 is oriented generally horizontally.

In the embodiment shown, the dirty air inlet 116 is at an upper portion of the front end 130 and clean air outlet 118 is at an upper portion of the rear end 132. The clean air outlet 118 may include a grill located on an upper surface of the surface cleaning apparatus 100. It will be appreciated that the dirty air inlet 116 and/or the clean air outlet 118 may be provided at different locations and/or be of different configurations.

As exemplified in FIGS. 2, 19, 30, and 35, an air moving member (e.g., a motor and fan assembly 150) is a clean air motor and is provided to generate vacuum suction through the air flow path 120. The air moving member may include a suction motor and fan assembly 150, which may be referred to as suction motor 150. The suction motor 150 is contained within a suction motor housing 152. The suction motor housing 152 may be of any suitable construction, including any of those exemplified herein.

The suction motor 150 in the illustrated example is positioned downstream from the air treatment member 110, although it will be appreciated that the suction motor 150 may be positioned upstream of the air treatment member 110 (e.g., a dirty air motor) in alternative embodiments. The suction motor 150 rotates about a central axis of rotation 154.

Preferably, when the upper end 134 of the surface cleaning apparatus 100 is positioned above the lower end 136, the axis of rotation 154 is oriented generally horizontally and extends between the front end 130 and the rear end 132. In other examples, however, the axis of rotation 154 may extend at any angle to the horizontal, or it may extend vertically. Accordingly, the suction motor 150 may be oriented in any direction within the surface cleaning apparatus 100. The suction motor axis of rotation 153 may be spaced (e.g., vertically spaced) from the central longitudinal axis 144 of the surface cleaning apparatus 100 or it may be coaxial therewith.

The air treatment member 110 is configured to remove particles of dirt and other debris from the airflow and/or otherwise treat the airflow. Any air treatment member or members known in the art may be used. For example, the surface cleaning apparatus may use one or more cyclones, bags, screens, physical filter media (e.g., foam, felt, HEPA) or the like. The air treatment member 110 may comprise one or more cyclonic stages, each of which have one or more cyclones in parallel.

Figure 2:
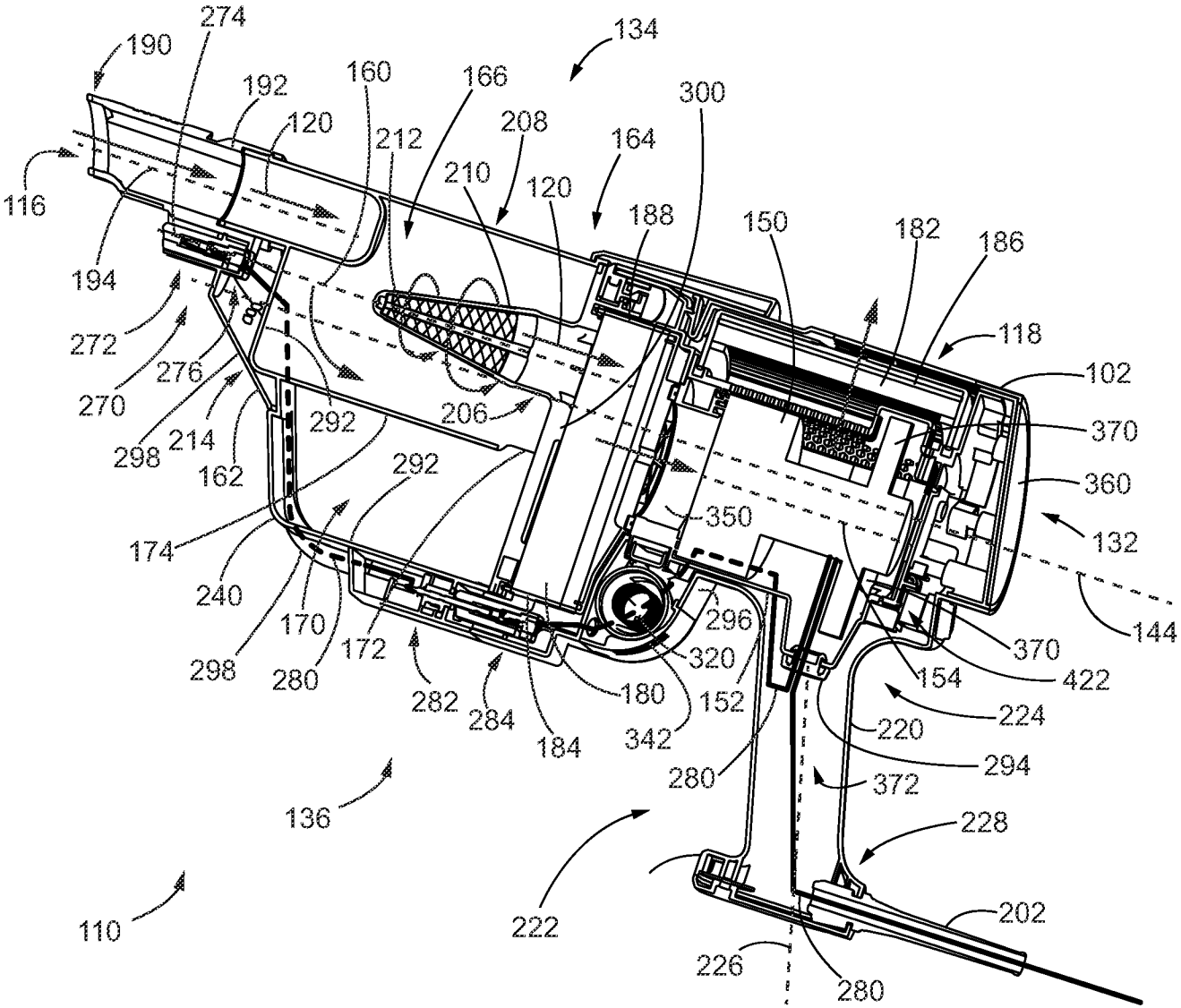
FIG. 2 is a side perspective cross sectional view of the hand vacuum cleaner of FIG. 1.

As exemplified in FIG. 2, the air treatment member 110 is a cyclone assembly 162 having a single cyclonic cleaning stage 164 with a single cyclone chamber 166, and the central longitudinal axis 144 is parallel to the cyclone axis of rotation 160, and may be coaxial therewith. Preferably, when the upper end 134 of the surface cleaning apparatus 100 is positioned above the lower end 136, the cyclone axis 160 is oriented generally horizontally. In other examples, however, the cyclone axis 160 may extend at any angle to the horizontal, or may extend vertically. Accordingly, the cyclone chamber 166 may be oriented in any direction within the surface cleaning apparatus 100.

As exemplified in FIG. 2, the air treatment member axis of rotation 160 may be spaced (e.g., vertically spaced) from the central longitudinal axis 144 of the surface cleaning apparatus 100, or it may be coaxial therewith. The air treatment member axis of rotation 160 may be parallel to and/or spaced from (e.g., vertically spaced from) the suction motor axis of rotation 154.

The air treatment member 110 may include a dirt collection region 170. In the illustrated example, the dirt collection region 170 is external to the cyclone chamber 166, although in alternative examples the dirt collection region 170 may be, e.g., a lower portion of the cyclone chamber 166 or it may be an end of the cyclone chamber distal to the air outlet end of the cyclone chamber 166. The dirt collection region may also be adjacent the cyclone chamber and generally to one side (e.g., on a lower side) of the cyclone chamber. Positioning the dirt collection chamber 170 adjacent the cyclone chamber 166 (e.g., rather than fully surrounding the cyclone chamber) may help reduce the overall size (e.g., width and/or height) of the surface cleaning apparatus 100 (e.g., reducing the width when the dirt collection chamber 170 is above or below and not beside the cyclone chamber 166). The cyclone chamber 166 and dirt collection region 170 may be of any configuration suitable for separating dirt from an air stream and collecting the separated dirt, respectively.

The cyclone chamber 166 and the exterior dirt collection region 170 are in communication via a gap or dirt outlet 172. The dirt outlet 172 may be one or more openings in a wall separating the air treatment chamber 166 and the dirt collection chamber 170. The opening has an outer perimeter defined by the wall in which the dirt outlet is provided or the walls which abut the dirt outlet. Any dirt outlet may be used.

The exemplary dirt outlet 172 is arranged such that dirt and debris—entrained in air flow inside of the cyclone chamber 166—may be ejected (e.g., "spit-out") through the gap and into the dirt chamber 170. The dirt outlet 172 may be a gap in the sidewall 174 of the cyclone chamber 166. If all or a majority of the gap is provided in an upper end of the dirt collection chamber, (when the surface cleaning apparatus is in an in use position—e.g., the upper end is above the lower end), as illustrated, then dirt may fall downwardly inside of the dirt chamber to collect (e.g., aggregate) in the lower end of the chamber. In this manner, the dirt outlet 172 configuration may help improve the dirt separation efficiency of the air treatment member.

If the air treatment member assembly 110 includes an air treatment chamber and a dirt collection chamber external to the cyclone chamber, then the air treatment chamber and the dirt collection chamber may be concurrently openable, such as by opening a wall or portion of each chamber, which as a front end and/or a rear end of the air treatment member assembly 110, thereby enabling the air treatment chamber and the dirt collection chamber to be concurrently emptyable.

In some examples, during an opening or emptying operation, a wall or walls defining a first part of the perimeter of the dirt outlet may be moved relative to a wall or walls defining a second part of the dirt outlet thereby opening the dirt outlet. The dirt outlet 172 may be a gap between two or more separable plates or panels. For example, the dirt outlet 172 may be a gap between the sidewall 174 and an end wall of the cyclone chamber 166. In some examples, the end wall of the cyclone chamber 166 and the sidewall 174 may be moved apart (e.g., to open the cyclone chamber 166 and/or dirt collection chamber 170). Separating plates or panels that form the perimeter of the dirt outlet 172, e.g., when the rear end opens as exemplified in FIG. 7, may open up the dirt outlet (e.g., to allow bridging debris to be removed more easily from the dirt outlet 172).

As in the illustrated example and as discussed previously, the cyclone assembly 162 may include a single cyclone cleaning stage. In alternative embodiments, the cyclone assembly 162 may include two or more cyclonic cleaning stages arranged in series with each other. Each cyclonic cleaning stage may include one or more cyclone chambers 166 that may be arranged in parallel with each other and one or more dirt collection chambers 170 of any suitable configuration. The dirt collection chamber or chambers 170 may be external to the cyclone chambers 166, or may be internal the cyclone chambers 166 and configured as a dirt collection area or region within the cyclone chambers 166.

The surface cleaning apparatus 100 may include one or more filters, such as a pre-motor filter 180 in the air flow path upstream of the suction motor 150 (e.g., upstream of the motor 150 and downstream of the air treatment member 110) and/or a post-motor filter 182 in the air flow path downstream of the suction motor 150. The pre-motor filter 180 and the post-motor filter 182 may be formed from any suitable physical, porous filter media and may have any suitable shape, including the examples disclosed herein. For example, the pre-motor filter 180 and/or the post-motor filter 182 may be one or more of a foam filter, felt filter, HEPA filter, other physical filter media, electrostatic filter, and the like.

The pre-motor filter 180 may be provided in a pre-motor filter housing 184. The post-motor filter 182 may be provided in a post-motor filter housing 186. The pre-motor filter housing 184 and the post-motor filter housing 186 may be of any suitable construction, including any of those exemplified herein. The pre-motor filter housing 184 and/or the post-motor filter housing 186 may be openable or accessible to allow the pre-motor filter 180 and/or the post-motor filter 182 to be cleaned and/or replaced.

Figure 8:
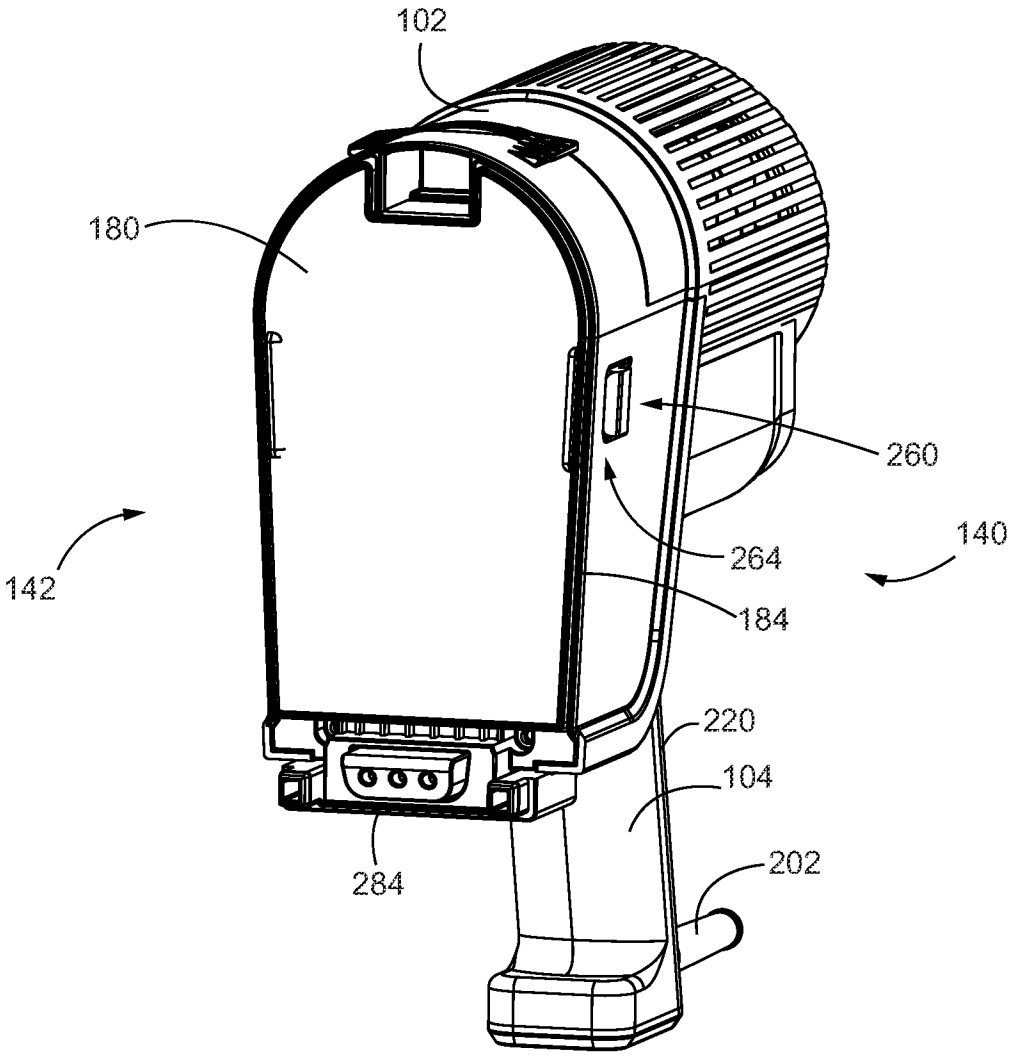
FIG. 8 is a front perspective view of a main body of the hand vacuum cleaner of FIG. 1 with the air treatment member assembly removed.
Figure 9:
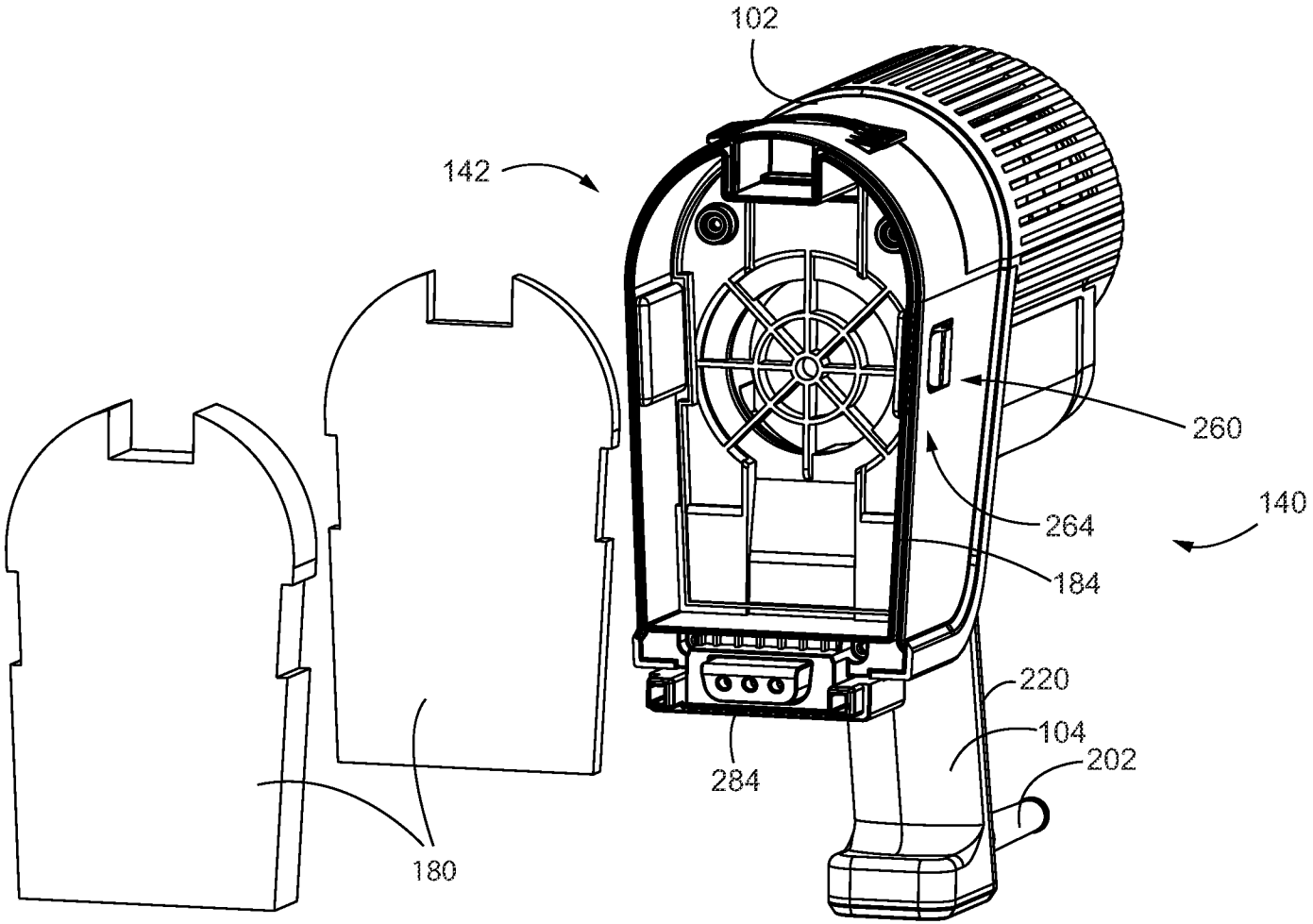
FIG. 9 is a front perspective view of the main body of the hand vacuum cleaner of FIG. 1 with the pre-motor filter removed.
Figure 10:
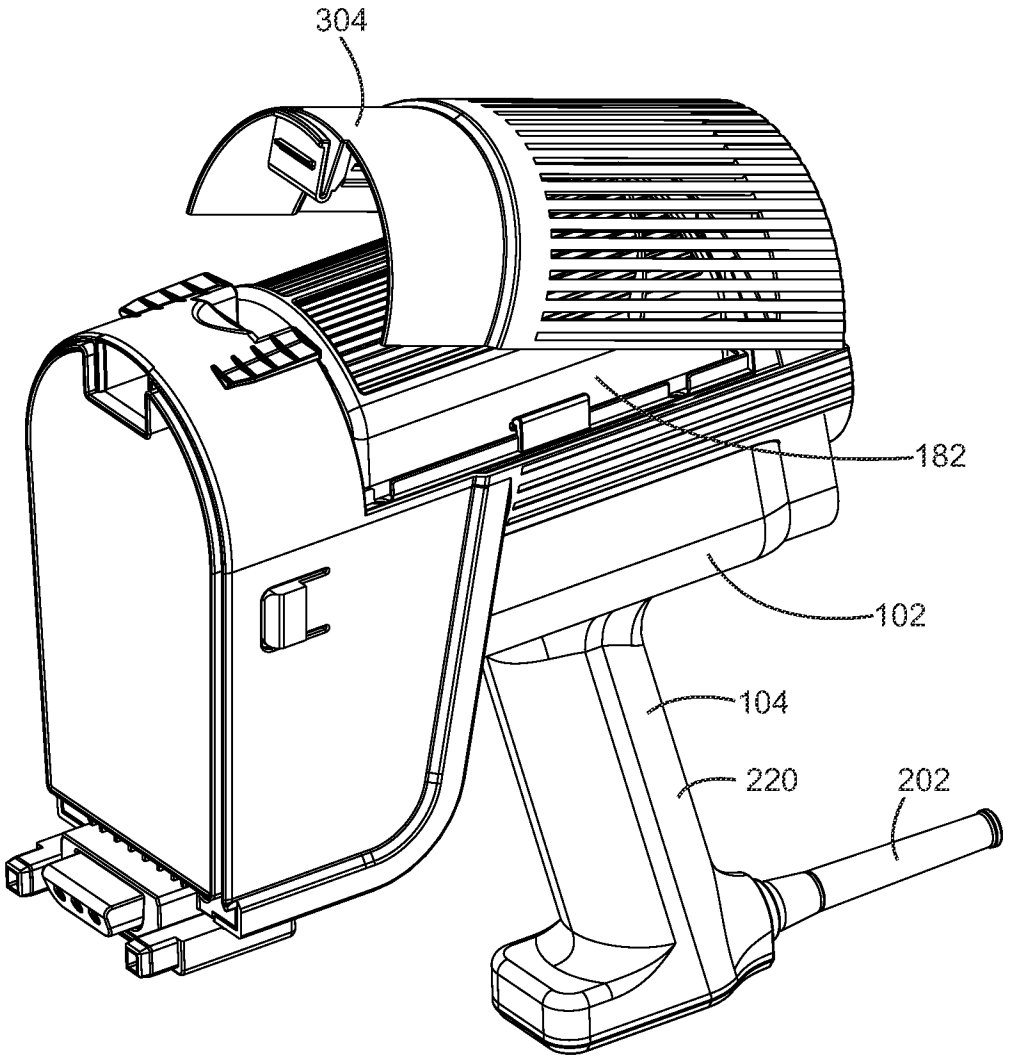
FIG. 10 is a top perspective view of the hand vacuum cleaner of FIG. 1 with a removable portion of the post-motor filter housing in a first open position.
Figure 20:
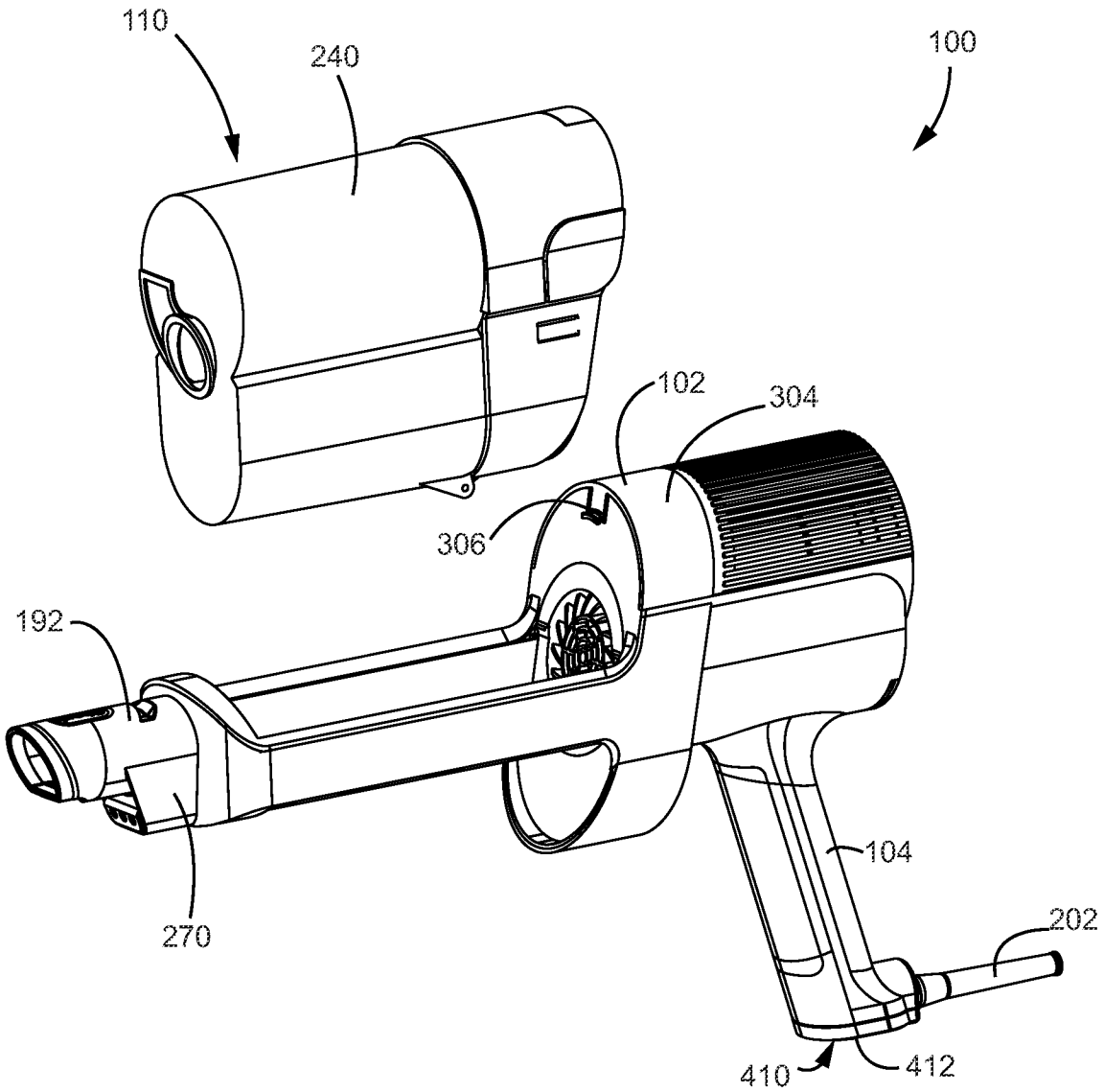
FIG. 20 is a side perspective view from the front of the hand vacuum cleaner of FIG. 18 with the air treatment member assembly removed.
Figure 21:
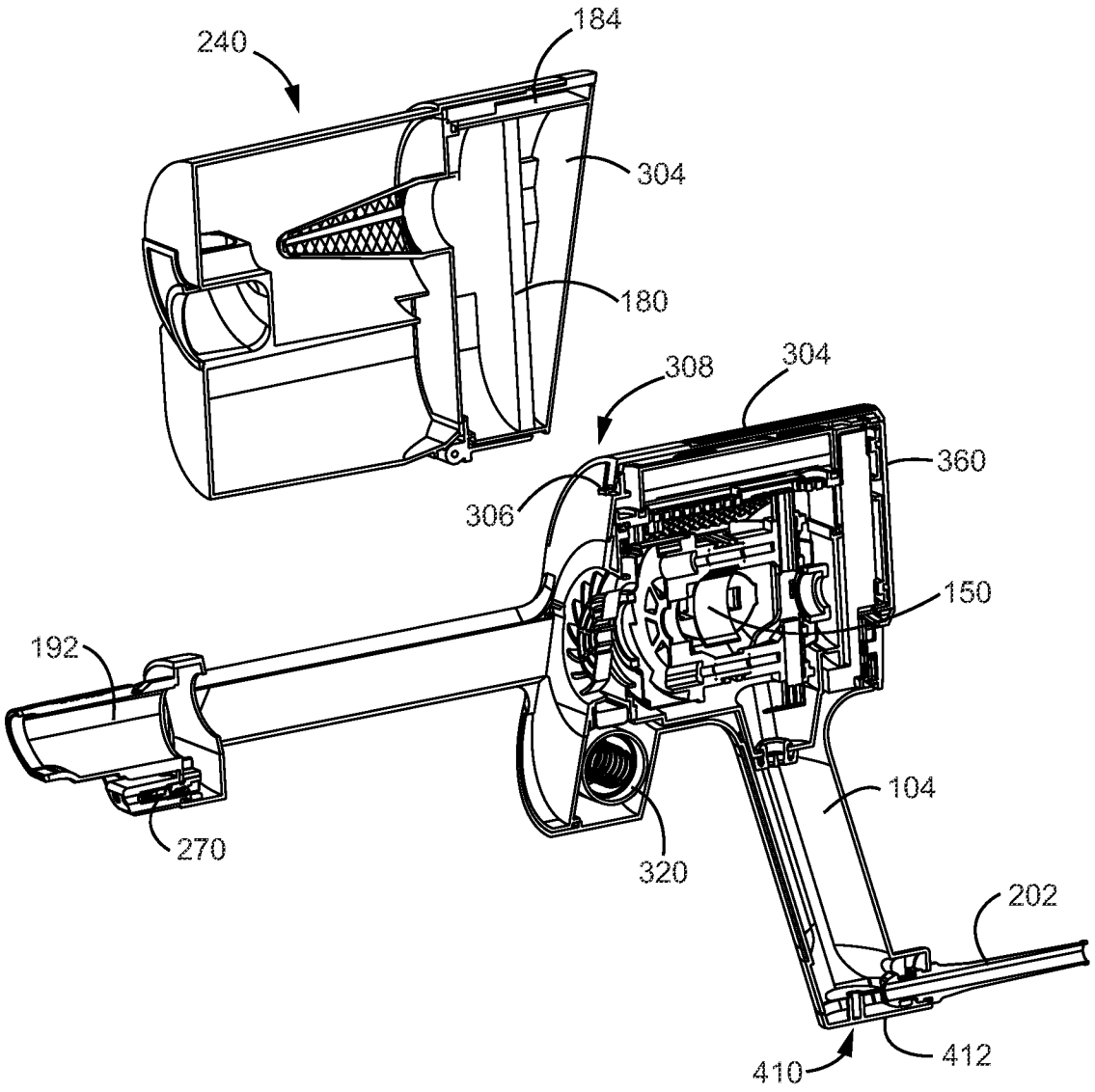
FIG. 21 is a side perspective cross sectional view of the hand vacuum cleaner of FIG. 18 with the air treatment member assembly removed.

The pre-motor filter 180 may be provided as part of the air treatment member assembly 110 and removable therewith (see for example FIG. 20) or the pre-motor filter 180 may be part of the front end of the main body, see for example FIG. 8.

The axis 154 of the suction motor 150 may extend through a volume defined by the outer perimeter 188 of the pre-motor filter 180 and/or through the pre-motor filter housing 184, and may extend through a portion of the pre-motor filter 180. In some examples, the pre-motor filter 180 has a vertical length in a vertical plane that is greater than a vertical length of the suction motor 150 in a vertical plane. A greater length may allow for a greater surface area (e.g., to allow for greater air flow/less backpressure).

The axis 154 of the suction motor 150 may also extend through a volume defined by the outer perimeter of the post-motor filter 182 and/or through the post-motor filter housing, and may optionally extend through a portion of the post-motor filter 182. The post-motor filter 182 may overlay the suction motor 150.

In the illustrated embodiment, the dirty air inlet 116 of the surface cleaning apparatus 100 is the inlet end 190 of an inlet conduit or passage 192. In some examples, the inlet conduit or passage 192 has a longitudinally extending axis 194. The conduit or passage 192 may be a linear conduit or passage 192 between dirty air inlet 116 and an inlet of an air treatment member.

Optionally, the inlet end 190 of the conduit 192 can be used as a nozzle to directly clean a surface. Alternatively, or in addition to functioning as a nozzle, inlet conduit 192 may be connectable or directly connectable to the downstream end of any suitable accessory tool such as a rigid air flow conduit (e.g., an above floor cleaning wand), a crevice tool, a mini brush, and the like. Accordingly, an assembly 200 (FIG. 1) comprising a floor cleaning head, a rigid air flow conduit that is moveably mounted to the floor cleaning head at an inlet end of the rigid air flow conduit, and the hand vacuum cleaner disclosed herein, may be provided.

As exemplified, power may be supplied to the surface cleaning apparatus 100 (e.g., to components or elements such as the suction motor 150) via a power cord 202. The power cord 202 may be configured for use with standard wall electrical outlets. It will be appreciated that the power cord 202 may be provided at any location on the surface cleaning apparatus 100 and/or main body 102. It will be appreciated that in some examples, the surface cleaning apparatus 100 may alternatively or additionally include one or more energy storage members (e.g., a capacitor or battery) to supply power to powered components (e.g., the motor 150), and the energy storage member may be arranged in one or more packs (e.g., a removeable battery pack).

Uniflow Cyclone

The following is a description of a uniflow cyclone, which may be used by itself or in combination with one of more of the open handle, the arcuate post-motor filter, the removable air treatment member, the accessory power connection on a removeable air treatment member, the filters are accessible when air treatment member is moved, the transversely extending bleed valve, the laterally directed inlet to the bleed valve, the rearwardly positioned control panel, the motor and/or motor housing extends into surrounding features, the power line extends through the handle, the brushes are centered, the handle is in-line with additional components, centrally positioned components, off-center components with a centered centre of gravity, the friction surface on a handle base, sound damping and an in-line vortex finder or air treatment member, which are set out herein.

In accordance with this aspect, the cyclone 166 of the surface cleaning apparatus 100 comprises or consists of one or more uniflow cyclones. If the cyclone assembly is a single stage cyclone assembly, then the cyclone assembly may include a single cyclone that is a uniflow cyclone or a plurality of cyclones in parallel that are each uniflow cyclones. If the cyclone assembly is a multistage cyclone assembly, each cyclonic cleaning stage may include one or more cyclones, and each cyclone may be a uniflow cyclone. This aspect may be used by itself or in combination with one or more other aspects of this disclosure.

As exemplified in FIGS. 2, 19, 30, and 35, the cyclone 166 may have a sidewall 174, which may extend axially in the direction of the cyclone axis 160. The cyclone chamber 166 may be provided within the sidewall 174. The sidewall 174 may have any suitable shape or configuration. Optionally, as shown, the sidewall 174 may have a cylindrical configuration defined by a constant diameter along the axial length of cyclone chamber 166. Alternatively, the sidewall 174 may have, for example, a frusto-conical shape wherein the diameter of the sidewall 174 may decrease along the axial length from the cyclone outlet end (e.g., sidewall 174 may have a diameter which tapers from the rear end 132 to the front end 130, along axis 160).

The cyclone 166 may also comprise a cyclone air inlet 204 (FIG. 19), and a cyclone air outlet 206. The cyclone air inlet 204 is defined by an aperture (e.g., a tangential air inlet) on the sidewall 174. The air outlet 206 is similarly defined by an aperture, with the air outlet 206 aperture in the wall forming the rear end 208 of the cyclone 166. The surface cleaning apparatus 100 may include a vortex finder 210, which may be part of a screen 212 forming an outlet of the cyclone chamber 166. It will be appreciated, however, that the air inlet 204 and the air outlet 206 may be of different configurations.

While the cyclone air inlet 204 and the cyclone air outlet 206 may be any configuration known in the art and at any location known in the art, in some examples the cyclone 166 is a uniflow cyclone. The cyclone air inlet 204 may be at one end of the cyclone chamber 166 (e.g., the front end 214) and the cyclone air outlet 206 may be at the other end of the cyclone chamber 166 (e.g., the rear end 208).

Air received inside cyclone chamber 166 may swirl therein, and may swirl cyclonically about the cyclone axis 160 such that dirt is dis-entrained from the air flow. Cleaned air may then exit the cyclone 166 via the outlet 206. The exemplified cyclone 166 is arranged as a uniflow cyclone in which air travels in one direction along the cyclone axis of rotation 160.

A uniflow cyclone 166 may have shape and/or performance advantages over a reverse flow cyclone. A uniflow cyclone 166 may be more compact, which may reduce the size of the surface cleaning apparatus 100.

Open Handle

The following is a description of an open handle, which may be used by itself or in combination with one of more of the uniflow cyclone, the arcuate post-motor filter, the removable air treatment member, the accessory power connection on a removeable air treatment member, the filters are accessible when air treatment member is moved, the transversely extending bleed valve, the laterally directed inlet to the bleed valve, the rearwardly positioned control panel, the motor and/or motor housing extends into surrounding features, the power line extends through the handle, the brushes are centered, the handle is in-line with additional components, centrally positioned components, off-center components with a centered centre of gravity, the friction surface on a handle base, sound damping and an in-line vortex finder or air treatment member, which are set out herein.

In accordance with this aspect, the handle 104 of the surface cleaning apparatus 100 is an open handle. An open handle includes a hand grip portion 220 projecting from a body portion (e.g., the main body 102) of the surface cleaning apparatus 100, with a first end (e.g., an upper end 134) secured to the main body 102 and a second end opposite to the first end (e.g., a lower end 136) that is free-hanging. This aspect may be used by itself or in combination with one or more other aspects of this disclosure.

A handle 104 allows a user to control and wield the surface cleaning apparatus 100. The handle 104 may include a hand grip portion 220 that can be grasped by a user's hand when using surface cleaning apparatus 100. A finger gap or empty space or void 222 forward of the handle 104 allows a user's fingers to wrap around the hand grip portion 220.

As exemplified in FIGS. 1-2 and 18-19, a first or upper end 224 of the handle 104 is provided on a body portion of the surface cleaning apparatus 100 (e.g., the main body 102). The handle 104 extends outwardly (e.g., downwardly) from the main body 102.

In some examples, the handle 104 extends out from a portion that houses the suction motor 150, such as extending out from a wall of the suction motor housing 152 that forms an exterior surface of the main body 102. The handle 104 may be provided at a rearward portion of the surface cleaning apparatus 100. Optionally, the handle 104 may be the rearward most part of the surface cleaning apparatus 100. In some examples, a handle axis 226 may intersect the suction motor 150.

As exemplified in FIGS. 1-2 and 18-19, the handle 104 may be a pistol grip handle. A handle axis 226 extends through the hand grip portion 220 between the first or upper end 224 and an opposite second or lower end 228. With a pistol grip handle, the axis 226 extends generally vertically when the upper end 134 of the surface cleaning apparatus 100 is above the lower end 136 of the surface cleaning apparatus 100 (e.g., the axis 226 may extend at an angle of less than 45°, less than 30°, or less than 15° from vertical).

The finger gap 222 may be provided between the hand grip portion 220 and one or more cleaning stage (e.g., the pre-motor filter 180). The pre-motor filter 180 may operate more efficiently or have a longer life span between cleaning with a large surface area in a direction transverse to the air flow through the pre-motor filter 180 (e.g., the downstream and/or the rear surface area) and positioning the finger receiving area 222 between the pre-motor filter 180 and the hand grip portion 220 may allow the pre-motor filter 180 to have a larger surface area than otherwise.

As exemplified, the handle 104 is an open handle, with the upper end 224 secured to the body and the lower end 228 free-hanging. In other words, the lower end 228 is only joined to a body portion of the surface cleaning apparatus (e.g., the main body 102) via the body of the handle 104 itself (e.g., the handle grip portion 220). An open handle 104 may facilitate easier construction and/or use.

Optionally, a finger guard may be provided forward of the finger receiving area 222, such as a member that extends from the bottom of the handle to the main body 102, thereby providing a closed finger receiving area 222.

Arcuate Post-Motor Filter

The following is a description of an arcuate post-motor filter, which may be used by itself or in combination with one of more of the uniflow cyclone, the open handle, the removable air treatment member, the accessory power connection on a removeable air treatment member, the filters are accessible when air treatment member is moved, the transversely extending bleed valve, the laterally directed inlet to the bleed valve, the rearwardly positioned control panel, the motor and/or motor housing extends into surrounding features, the power line extends through the handle, the brushes are centered, the handle is in-line with additional components, centrally positioned components, off-center components with a centered centre of gravity, the friction surface on a handle base, sound damping and an in-line vortex finder or air treatment member, which are set out herein.

In accordance with this aspect, the post-motor filter 182 of the surface cleaning apparatus 100 is arcuate. The body of the post-motor filter 182 along a cross section taken through the post-motor filter 182 in, e.g., a plane that is transverse to the cyclone axis, is arcuate. This aspect may be used by itself or in combination with one or more other aspects of this disclosure.

Figure 11:
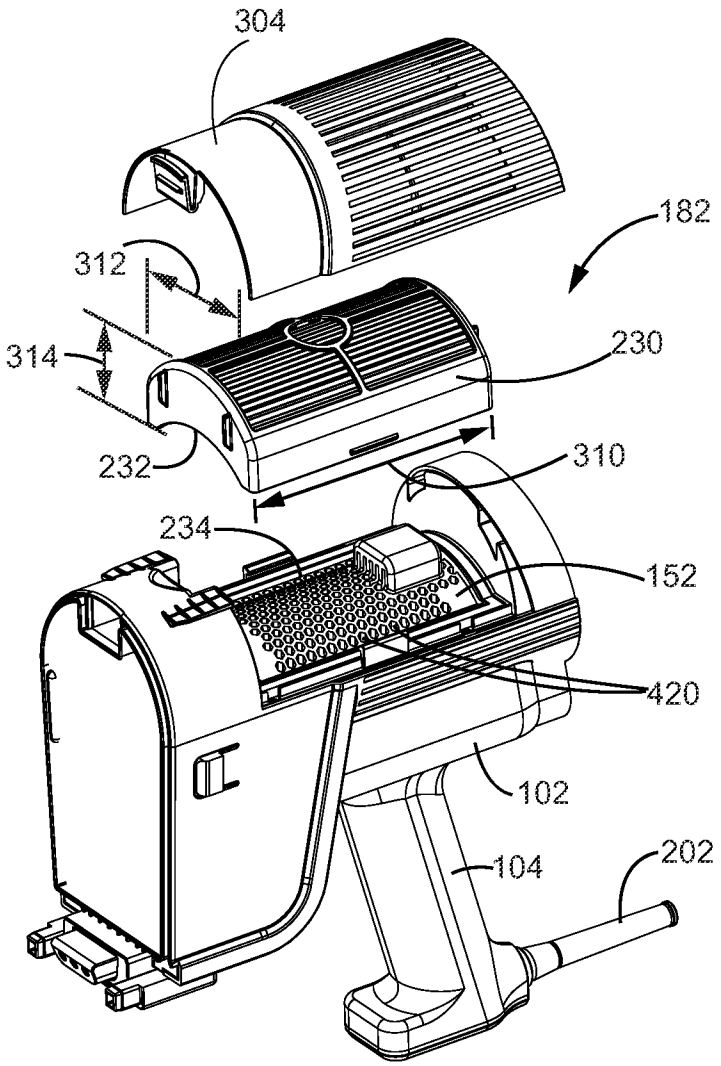
FIG. 11 is a top perspective view of the hand vacuum cleaner of FIG. 1 with the post-motor filter removed.
Figure 28:
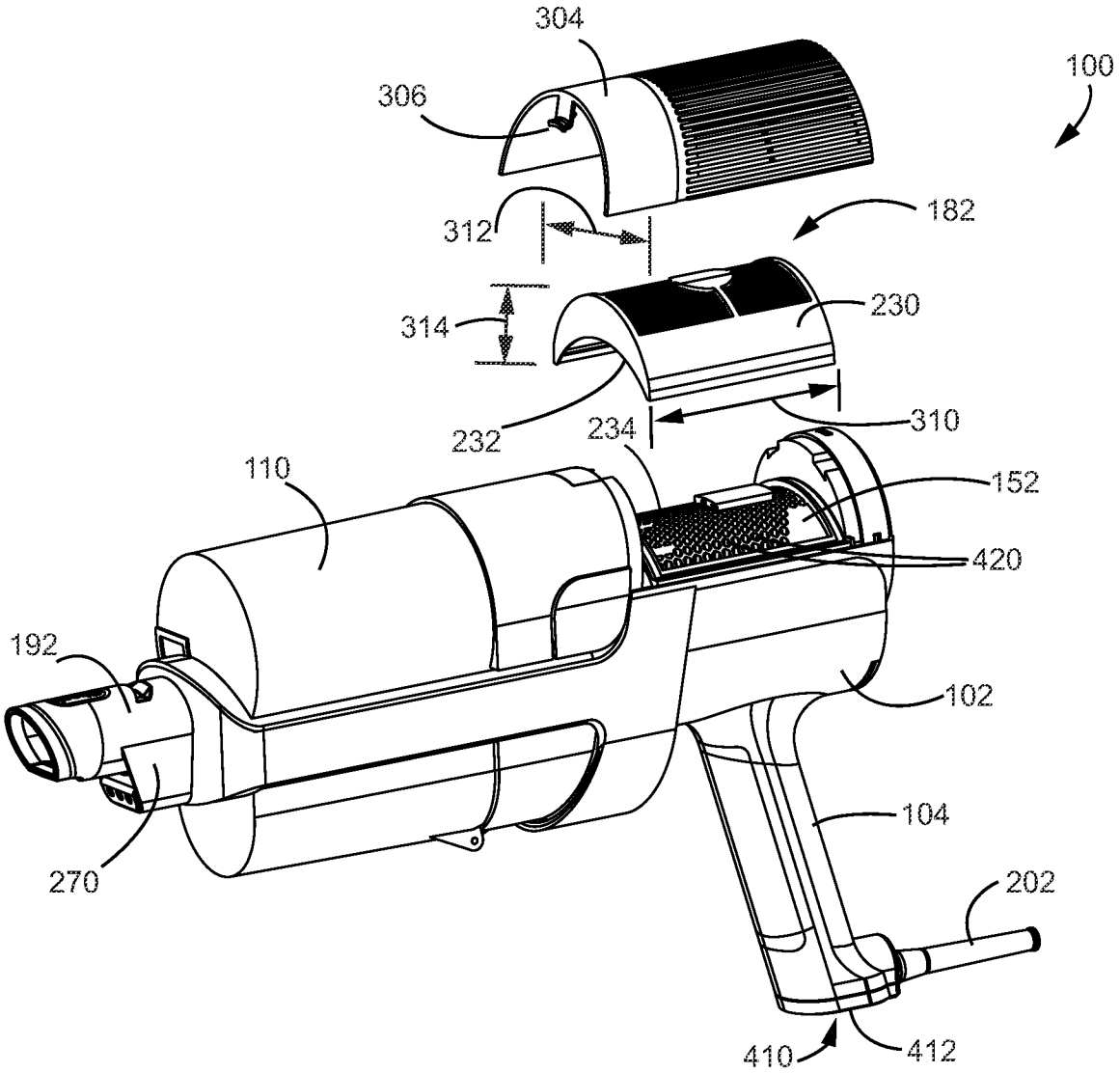
FIG. 28 is a side perspective view from the front of the hand vacuum cleaner of FIG. 18 with the post-motor filter removed.
Figure 33:
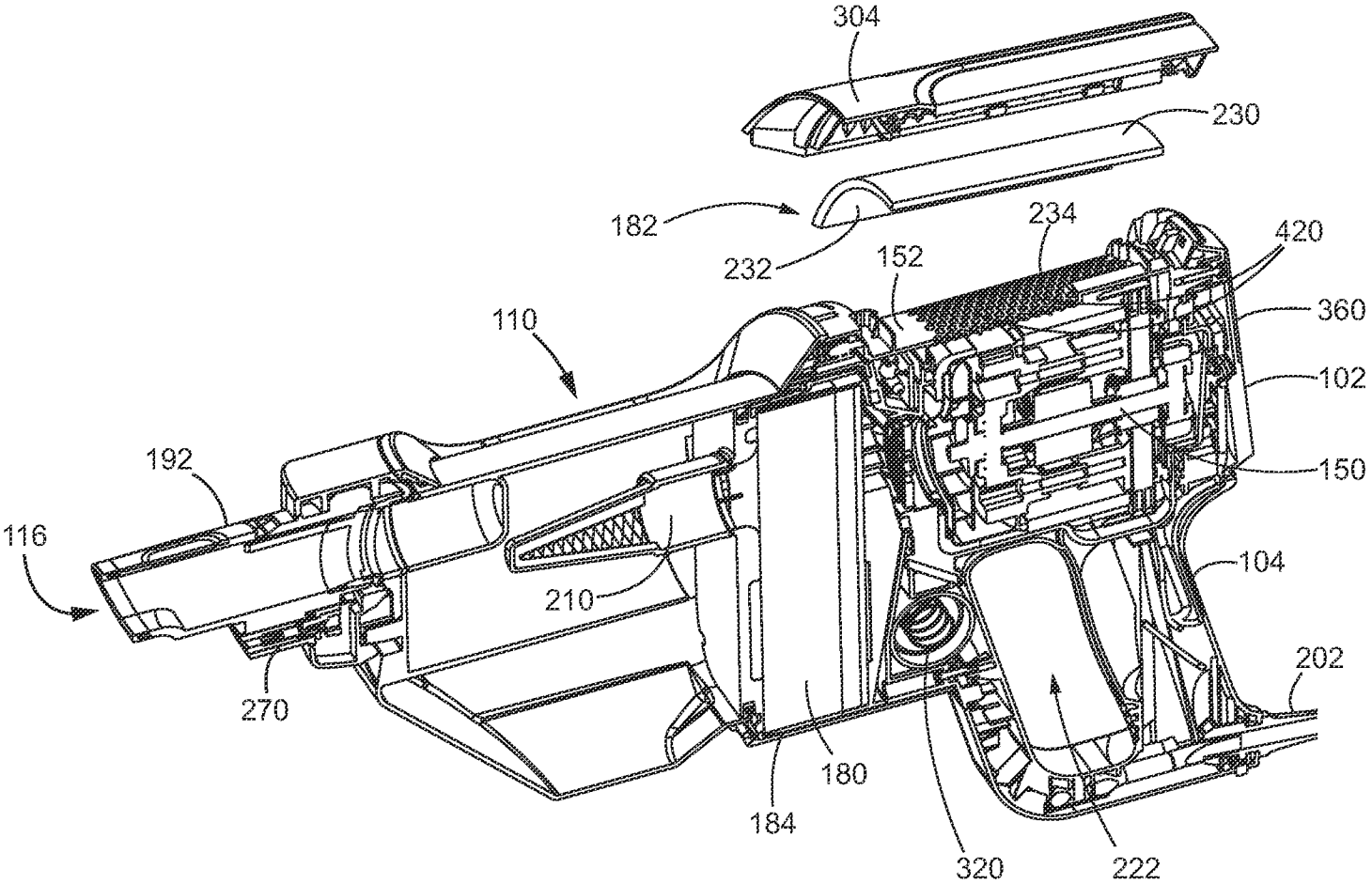
FIG. 33 is a side perspective cross sectional view from the front of the hand vacuum cleaner of FIG. 29 with the post-motor filter removed.
Figure 34:
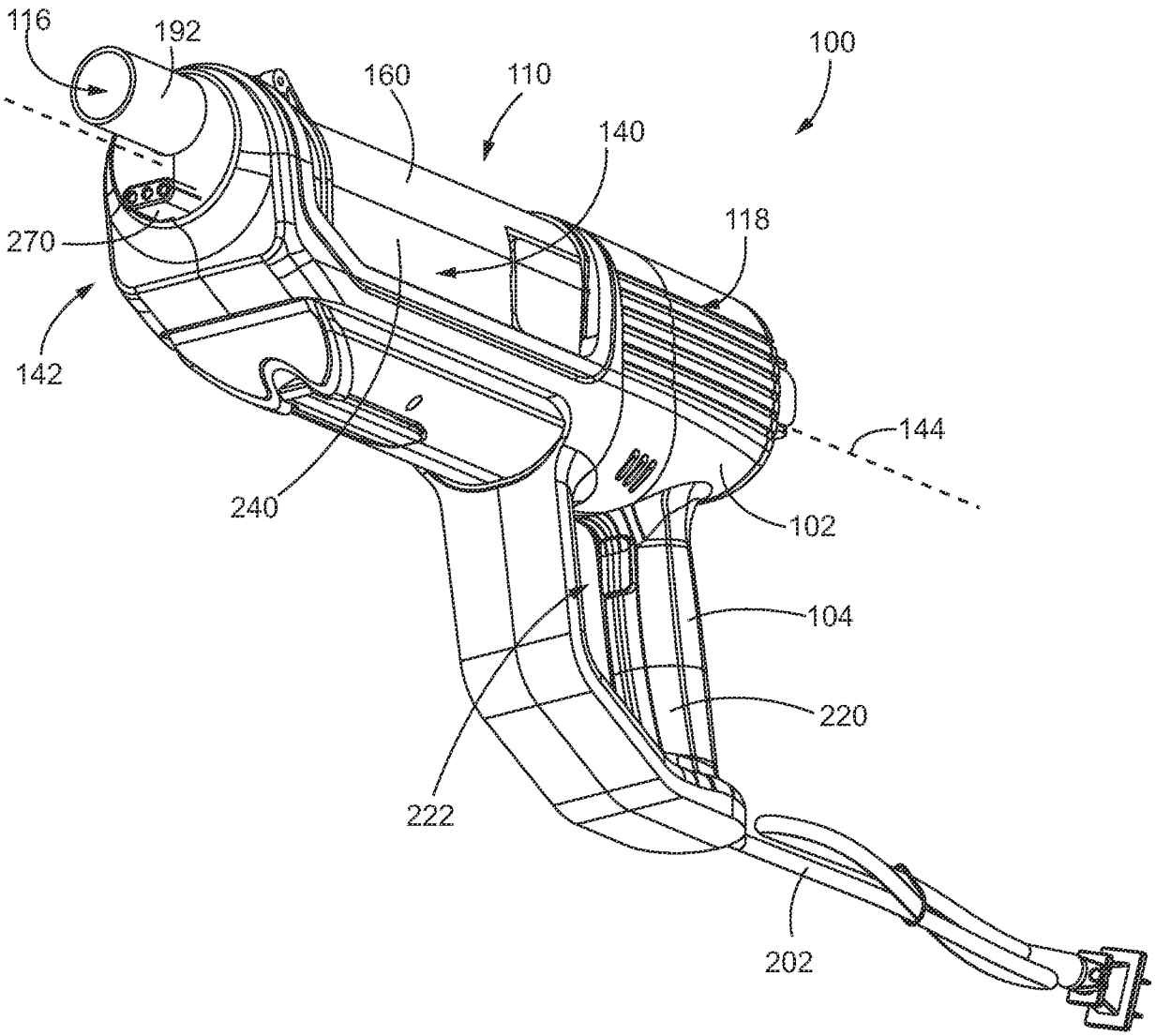
FIG. 34 is a front perspective view of an alternative hand vacuum cleaner, in accordance with an embodiment.
Figure 35:
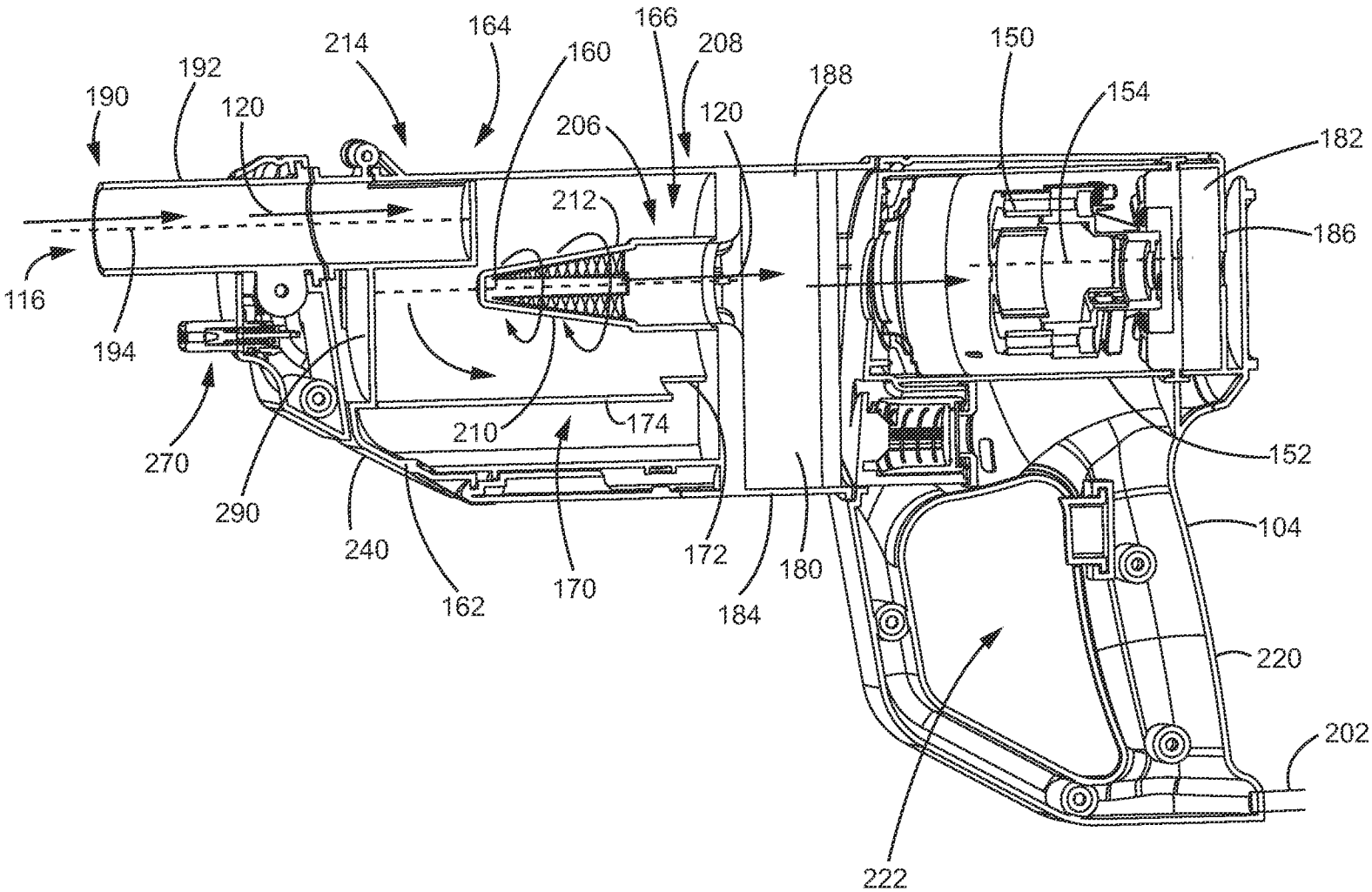
FIG. 35 is a cross sectional view of the hand vacuum cleaner of FIG. 34; and, FIG. 36 is a cross sectional view of the hand vacuum cleaner of FIG. 34 with the air treatment member assembly in a removed position.
Figure 36:
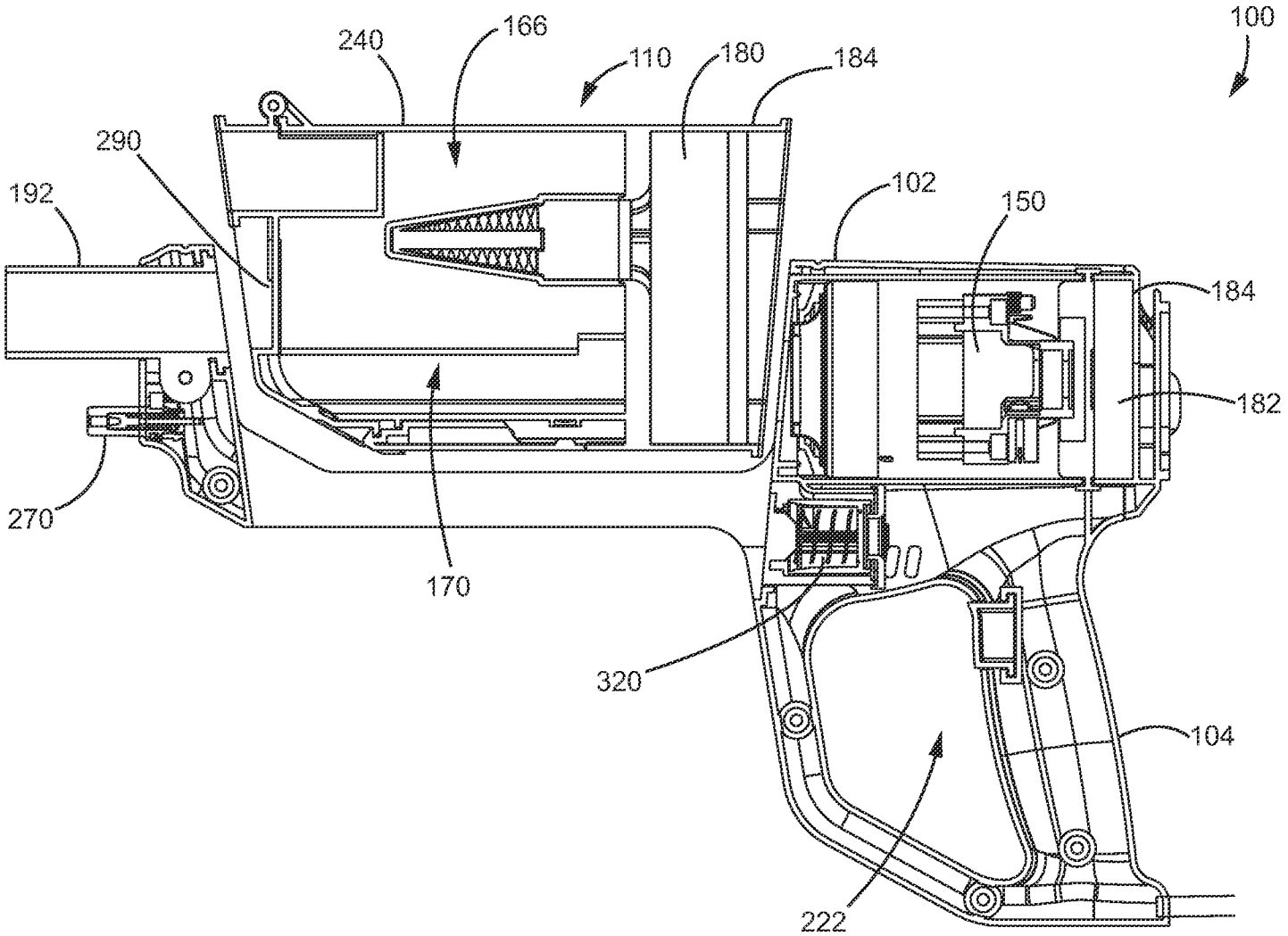

As exemplified in FIGS. 11, 28, and 33, the post-motor filter 182 may be arcuate or semi-circular in cross-section. In other words, a surface (e.g., an upper surface 230 or a lower surface 232) of the post-motor filter 182 is concave and the opposite surface is convex. The post-motor filter 182 is arcuate or semi-circular in a plane transverse to the central longitudinal axis 144.

An arcuate shape to a post-motor filter 182 may allow the post-motor filter 182 to fit closely over another component of the surface cleaning apparatus, such as when the other component has a convex surface over which an arcuate post-motor filter 182 may fit closely.

As exemplified, the suction motor 150 and/or suction motor housing 152 has a convex surface 234. The convex surface 234 is an outer surface, and may be an upper surface. The post-motor filter 182 may overly the suction motor 150 (i.e., be above the suction motor 150) and may seat thereon. As exemplified, the post-motor filter 182 and/or the post motor filter housing 186 may fit closely over the suction motor 150 and/or suction motor housing 152, with an arcuate section of the post motor filter 182 and/or filter housing 186 fitting against a convex portion of the suction motor 150 and/or suction motor housing 152. As illustrated, the convex surface 234 of the suction motor housing 152 may be an outer surface of the suction motor housing 152 and an inner surface of the post-motor filter housing 186 (i.e., the suction motor housing and post-motor filter housing have a shared wall).

An arcuate shape of the post-motor filter 182 may facilitate a compact shape of the surface cleaning apparatus 100 and/or a more efficient filtering of the post-motor air flow.

Removable Air Treatment Member

The following is a description of a removable air treatment member, which may be used by itself or in combination with one of more of the uniflow cyclone, the open handle, the arcuate post-motor filter, the accessory power connection on a removeable air treatment member, the filters are accessible when air treatment member is moved, the transversely extending bleed valve, the laterally directed inlet to the bleed valve, the rearwardly positioned control panel, the motor and/or motor housing extends into surrounding features, the power line extends through the handle, the brushes are centered, the handle is in-line with additional components, centrally positioned components, off-center components with a centered centre of gravity, the friction surface on a handle base, sound damping and an in-line vortex finder or air treatment member, which are set out herein.

In accordance with this aspect, the air treatment member assembly 110 of the surface cleaning apparatus 100 is removeable from the main body of the surface cleaning apparatus 100, with or without the pre-motor filter 180. The air treatment member 110 may remove forwardly, downwardly or upwardly. This aspect may be used by itself or in combination with one or more other aspects of this disclosure.

As exemplified in FIGS. 3, 20, 31, and 36, the air treatment member 110 is removably attached to a front end of the main body 102. The air treatment member 110 may be a bin assembly 240 and/or be part of a bin assembly 240, and the bin assembly 240 may be removably secured to the main body 102.

Figure 3:
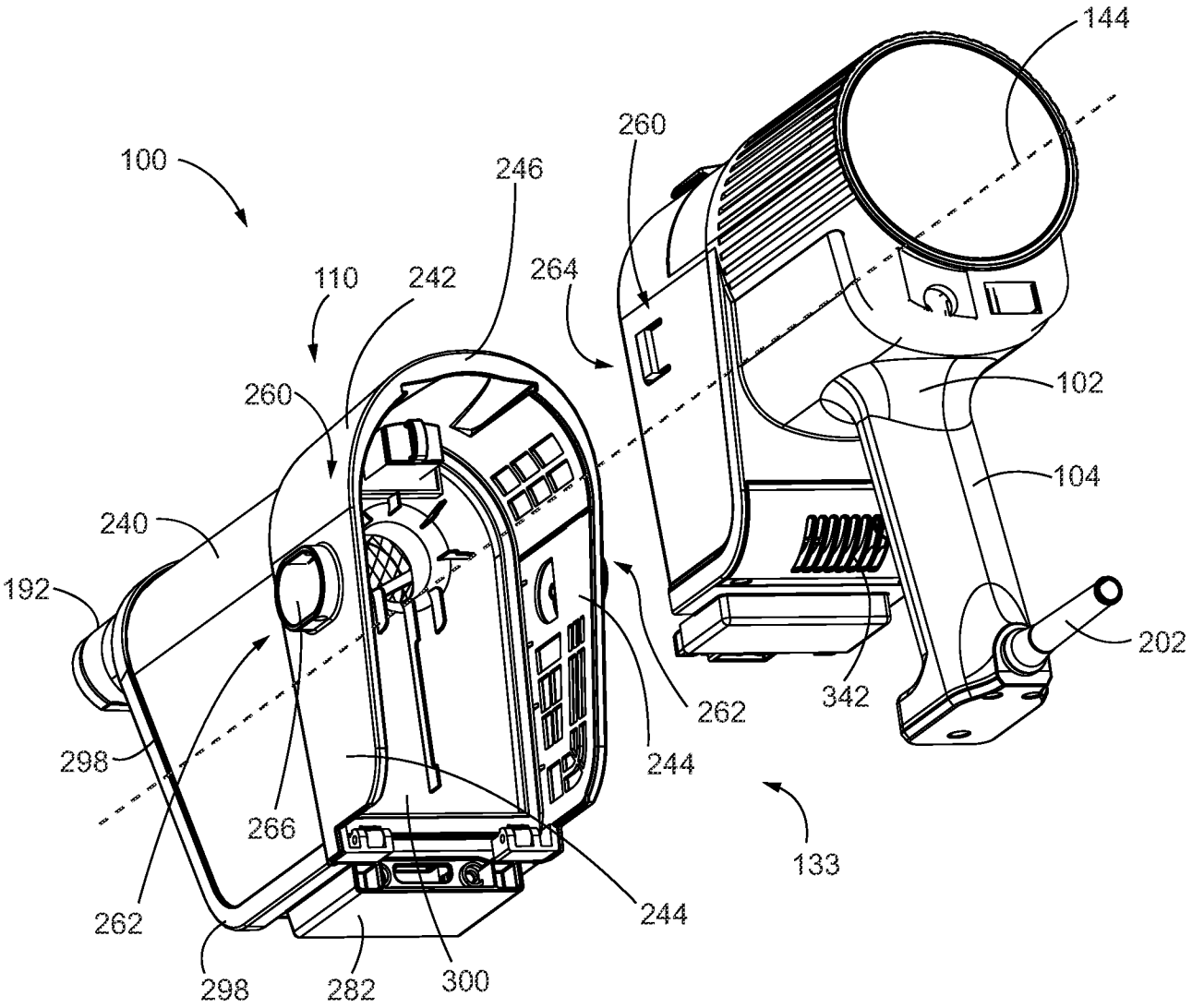
FIG. 3 is a rear perspective view of the hand vacuum cleaner of FIG. 1 with the air treatment member assembly removed.
Figure 4:
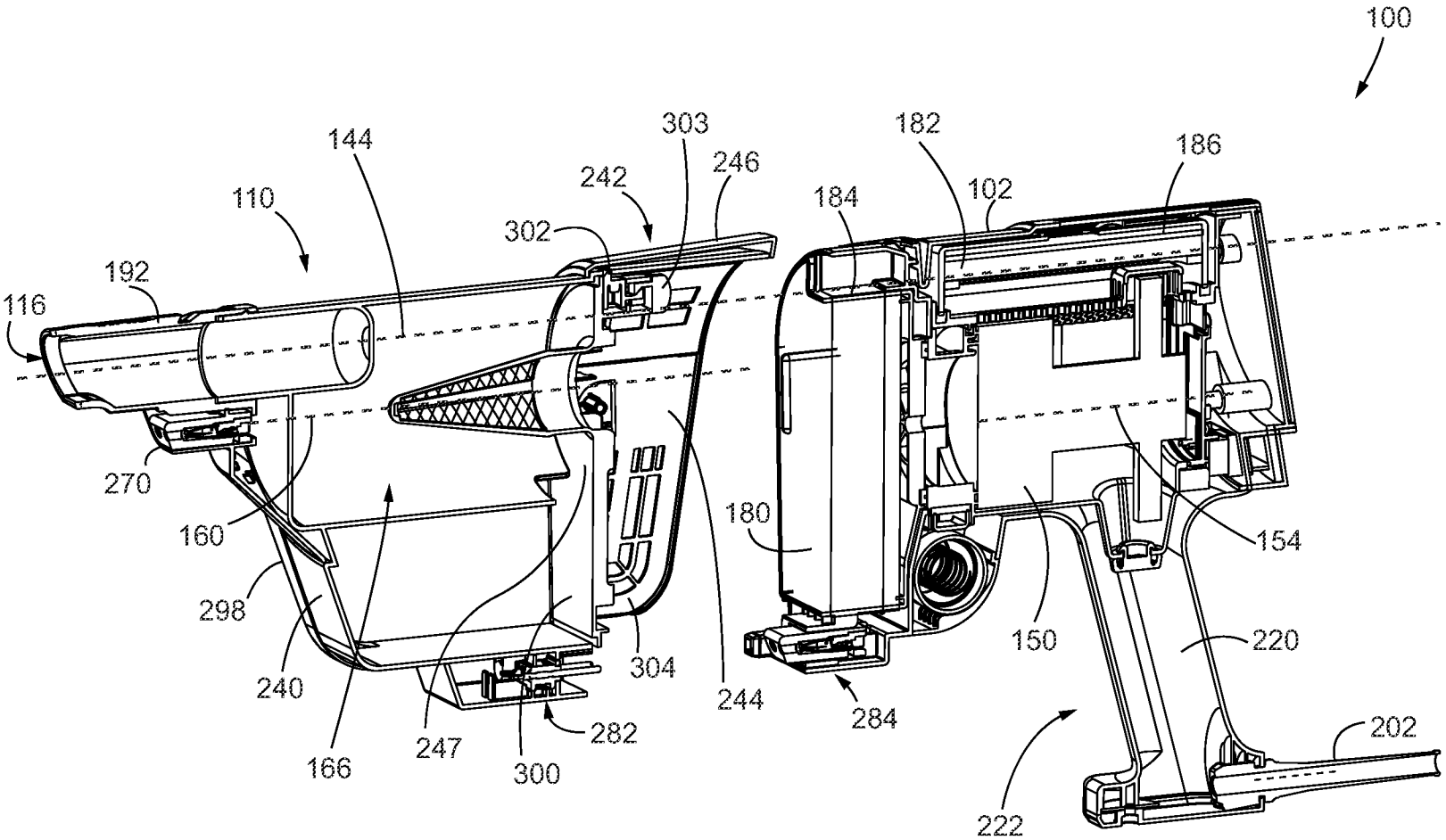
FIG. 4 is a side perspective cross sectional view, from the front, of the hand vacuum cleaner of FIG. 1 with the air treatment member assembly removed.

As exemplified in FIGS. 3 and 4, in some examples the air treatment member 110 is removeable forwardly, in which a removal direction of the air treatment member 110 includes a majority component that is in-line with the longitudinal axis 144 of the surface cleaning apparatus 100, the cyclone axis of rotation 160, and/or the motor axis of rotation 154, i.e., the axis continue to pass through the air treatment member 100 as the air treatment member is moved forwardly away from the main body 102. In some examples, a removal direction of the air treatment member 110 (or a majority component of the removal direction) is in-line with an axis of the surface cleaning apparatus 100 which passes through the motor 150 and/or inlet 116.

The bin assembly 240 may include a rearwardly extending flange 242. The flange 242 may include lateral sides 244 spaced apart across the central longitudinal axis 144. The flange 242 may also include an upper portion 246 joining the lateral sides 244 at the upper end 134 of the surface cleaning apparatus 100. The rearwardly extending flange 242 extends out rearwardly beyond a rear or second end wall 247 of the cyclone chamber 166. In some examples, a majority component of the direction in which the rearwardly extending flange 242 extends is rearward of the air treatment member 110 and in-line with the longitudinal axis 144 of the surface cleaning apparatus 100, the cyclone axis of rotation 160, and/or the motor axis of rotation 154.

Figure 22:
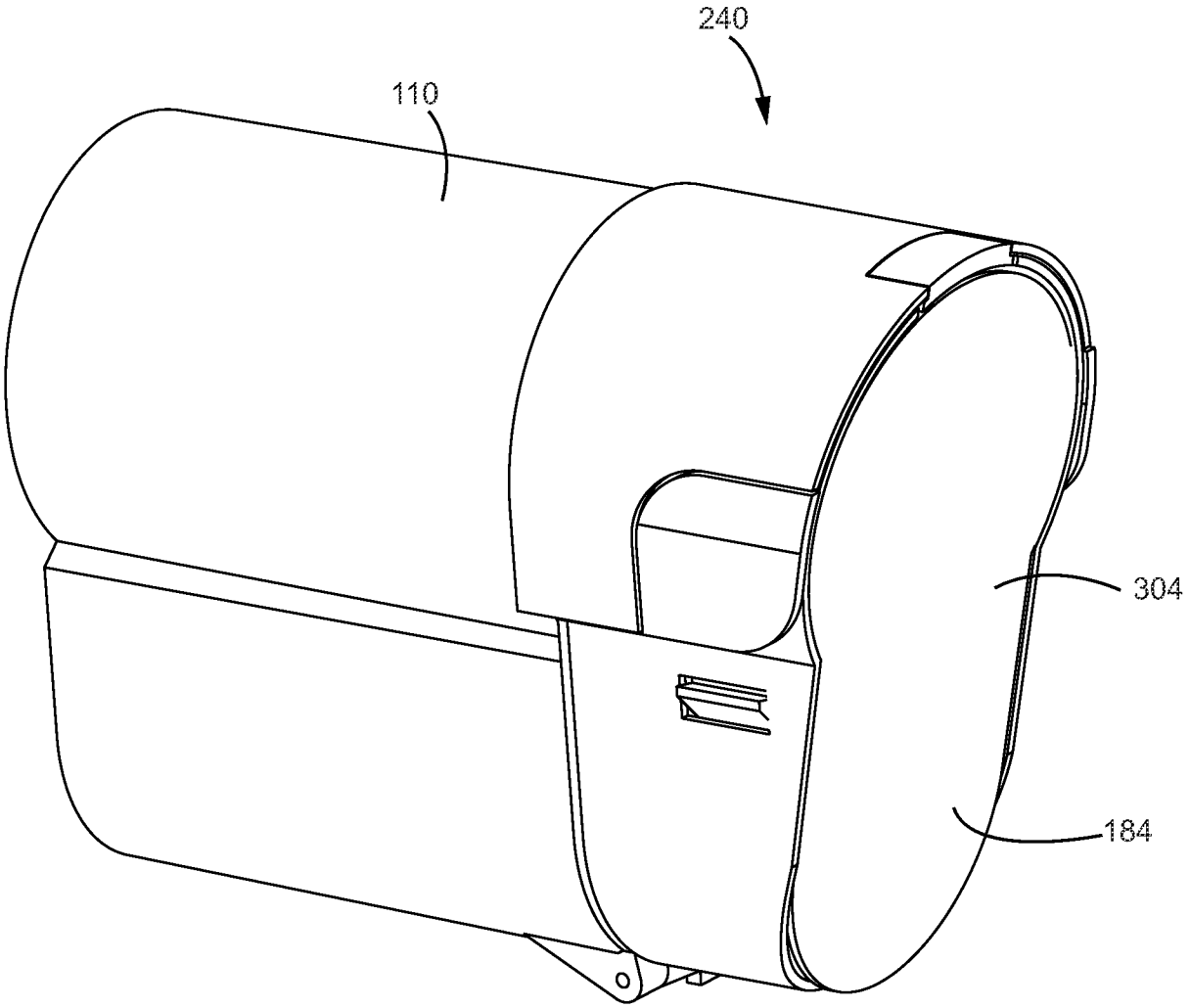
FIG. 22 is a rear perspective view of the air treatment member assembly of the hand vacuum cleaner of FIG. 18.
Figure 23:
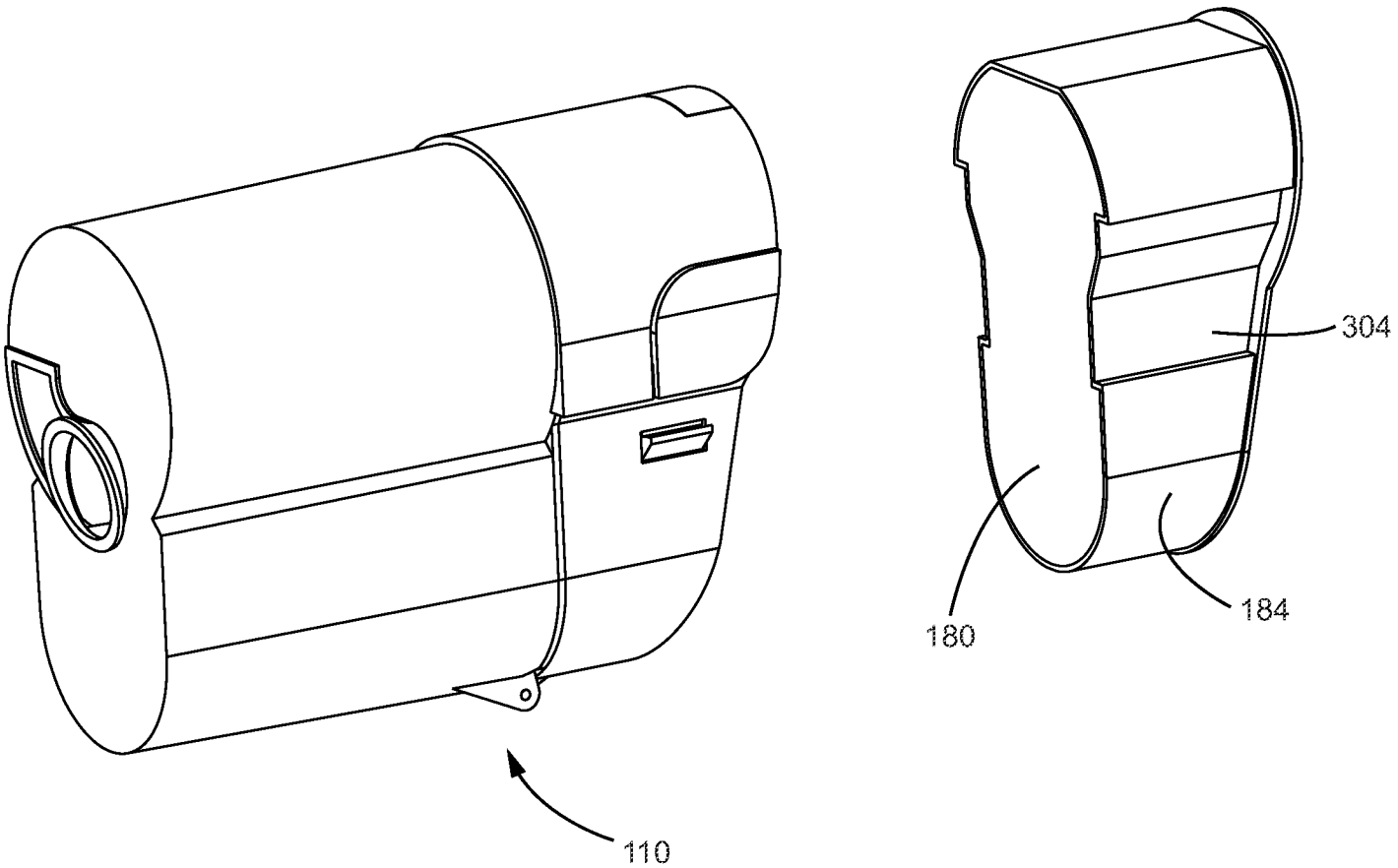
FIG. 23 is a side perspective view from the front of the air treatment member assembly of the hand vacuum cleaner of FIG. 18 with a removable portion of the premotor filter housing removed.

It will be appreciated that, when the bin assembly 240 is mounted to the main body, part or all of the flange may seat over the main body 102. As exemplified in FIG. 2, the flange 242 seats over the pre-motor filter 180. Alternately, as exemplified in FIG. 22, the pre-motor filter 180 may seat within flange 242.

One or more releasable fasteners may hold the bin assembly 240 to the main body 102. If a flange 242 is provided, then a portion of the fasteners may be provided on the flange 242. As exemplified in FIGS. 3 and 4, the surface cleaning apparatus 100 may include a pair of clasps 260 to hold the bin assembly 240 to the main body 102. Each clasp includes a bin member 262 and a body member 264. As illustrated, the body member 264 may include a recess or pocket, and the bin member 262 may include a moveable projection or hook or latch. As exemplified, the bin members 262 are mounted to the rearwardly extending flange 242, and, when the bin assembly 240 is secured to the main body, the flange 242 overlays a portion of the main body 102 on which the body members 264 are mounted.

Figure 25:
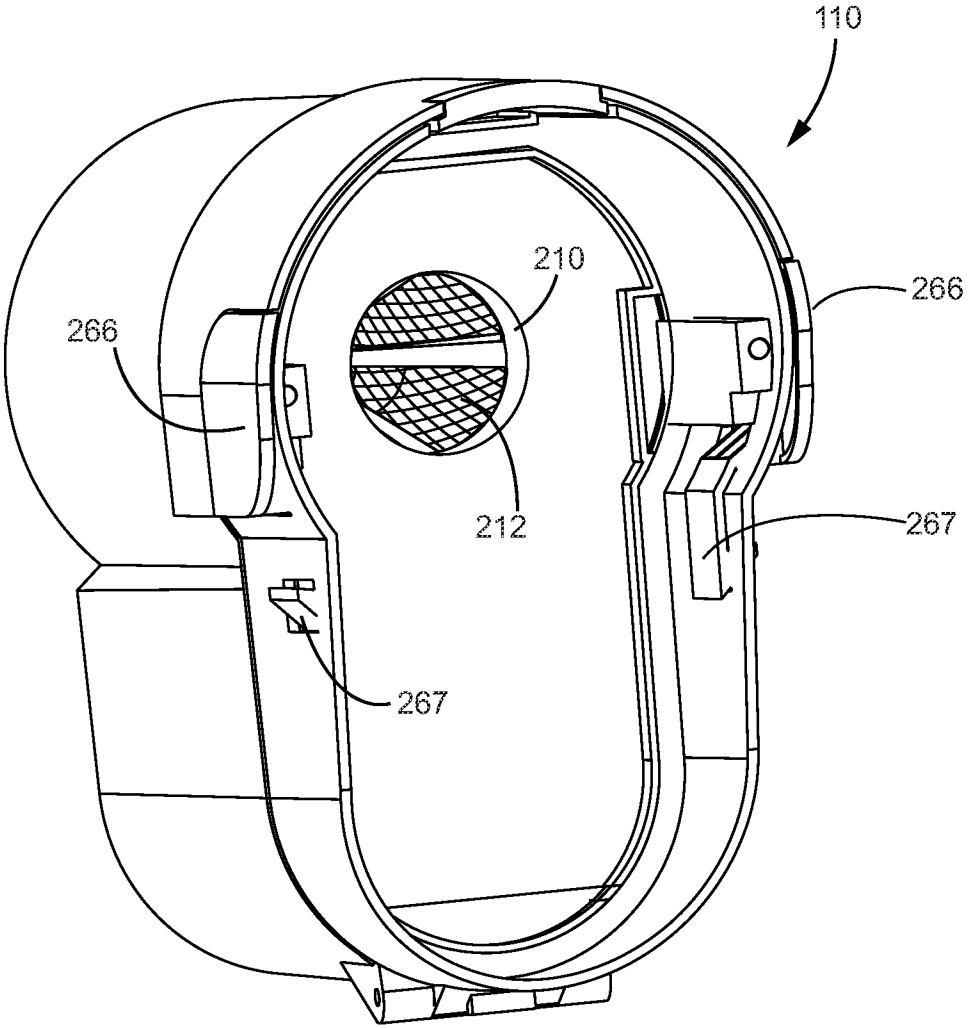
FIG. 25 is a rear perspective view of the air treatment member assembly of the hand vacuum cleaner of FIG. 18 with the pre-motor filter removed.
Figure 26:
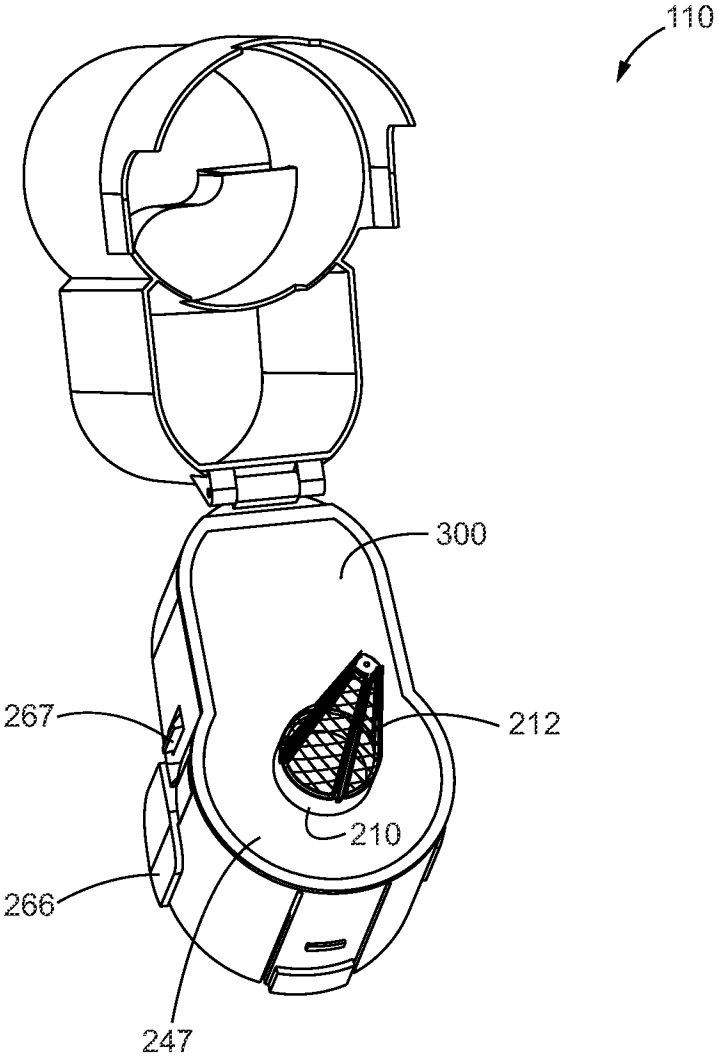
FIG. 26 is a rear perspective view of the air treatment member assembly of the hand vacuum cleaner of FIG. 18 with an openable door in a first open position.
Figure 27:
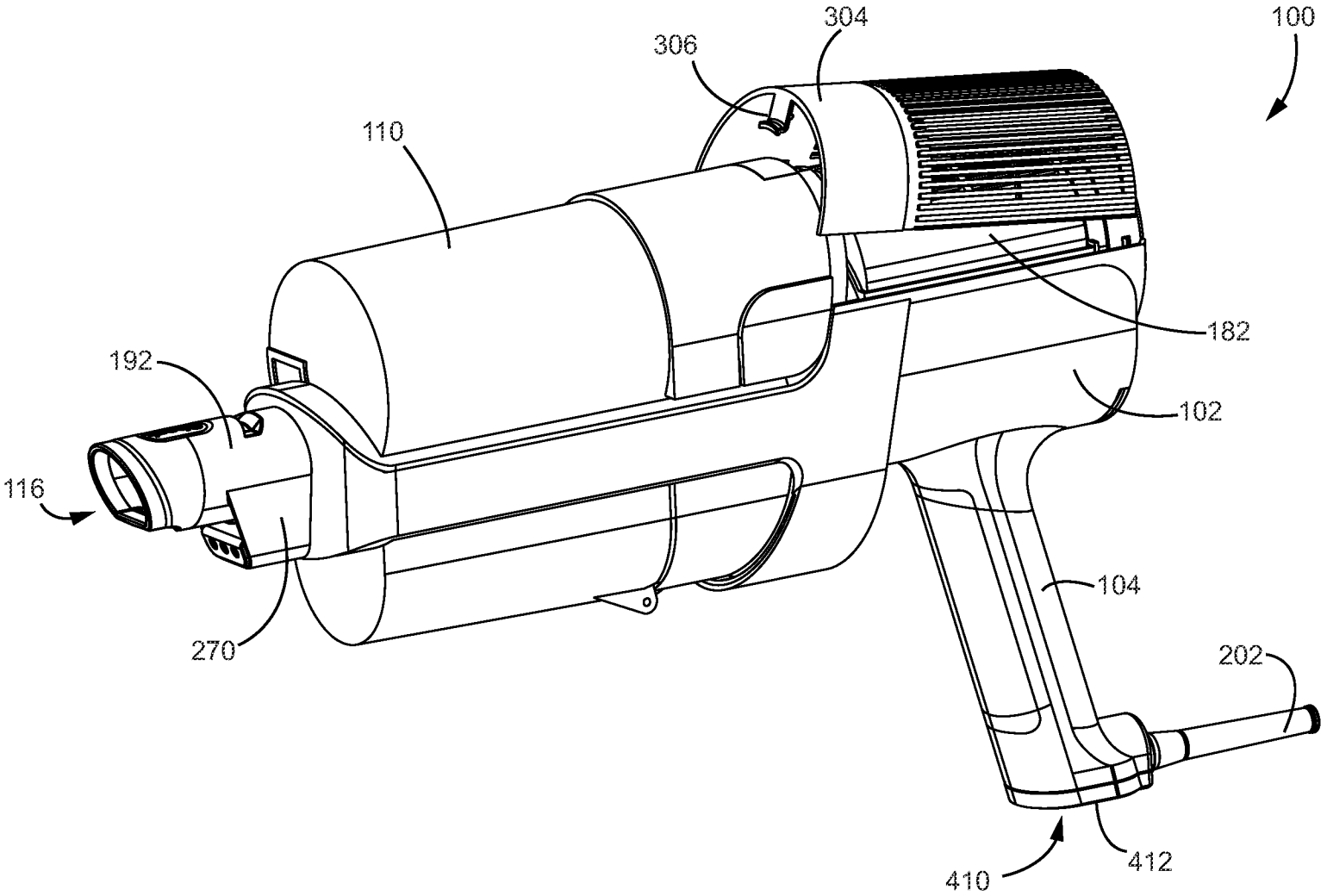
FIG. 27 is a side perspective view from the front of the hand vacuum cleaner of FIG. 18 with a removeable portion of the post-motor filter housing in a first open position.

The bin member 262 is moveable between a closed position in which a free end of the latch is drawn adjacent (e.g., against) a surface of the bin assembly 240 (e.g., the flange 242) and an extended position in which the free end of the latch is moved away from the surface of the bin assembly 240. The latch may be biased to the closed position (e.g., by a spring). An actuator 266 (e.g., a button) may be used to move the latch 267 (FIG. 25) to the extended position. For example, the actuator 266 may be drivingly connected to the latch and moved (e.g., depressed) to move the latch to the extended position. When the latch is brought into contact with the body member 264 and moved to the closed position, the latch will hold the bin member 262 to the body member 264. When the latch is moved to the extended position by the actuator 266, the body member 264 is released from the bin member 262.

It will be appreciated that any latching mechanism may be used.

An air treatment member 110 that is removable may be easier to clean and/or empty than an air treatment member 110 that is not removable from a main body 102. The air treatment member 110 may have an openable door to an internal chamber (e.g., the cyclone chamber 166 and/or dirt collection chamber 170) that is openable when the air treatment member 110 is removed and optionally when the air treatment member 110 is mounted to the main body 102.

Accessory Power Connection on a Removeable Air Treatment Member

The following is a description of an accessory power connection on a removeable air treatment member, which may be used by itself or in combination with one of more of the uniflow cyclone, the open handle, the arcuate post-motor filter, the removable air treatment member, the filters are accessible when air treatment member is moved, the transversely extending bleed valve, the laterally directed inlet to the bleed valve, the rearwardly positioned control panel, the motor and/or motor housing extends into surrounding features, the power line extends through the handle, the brushes are centered, the handle is in-line with additional components, centrally positioned components, off-center components with a centered centre of gravity, the friction surface on a handle base, sound damping and an in-line vortex finder or air treatment member, which are set out herein.

In accordance with this aspect, the surface cleaning apparatus 100 includes a power connector 270 for an accessory (e.g., a powered floor cleaner head). The power connector 270 for the accessory may be on a removeable bin assembly or air treatment member 110. The power connector 270 for the accessory may be on a front 130 of the surface cleaning apparatus 100. This aspect may be used by itself or in combination with one or more other aspects of this disclosure.

As illustrated in FIG. 2, the surface cleaning apparatus 100 may include an electrical connector 270 for providing power to an upstream attachment (e.g., a surface cleaning head or another cleaning tool). As shown, connector 270 may extend from a front connector end 272 along a connector axis 274 to a rear connector end 276. In some embodiments, connector axis 274 may be parallel to one or more of nozzle axis 194, cyclone axis 160, and motor axis 154. In the illustrated embodiment, connector axis 274 is parallel to nozzle axis 194, cyclone axis 160, and motor axis 154. The accessory connector 270 may extend forwardly from the bin assembly 240. In some examples, when a cleaning tool is connected to the air treatment member 110, the cleaning tool is connected in air flow communication with the air treatment member 110 (e.g., via inlet 192) and (e.g., concurrently) the cleaning tool is electrically connected to the air treatment member 110 (e.g., via connector 270).

In some embodiments, the surface cleaning apparatus 100 may include one or more electrical conductors or cables 280 which extend from electrical connector 270 rearwardly to electrically couple accessory electrical connector 270 with a source of power (e.g., the power cord 202 in the illustrated example). The source of power is in the main body 102, and the cables 280 extend rearwardly through the bin assembly 240 and further cables 280 extend through the main body to the source of power. It will be appreciated that the power source may be one or more energy storage members provided in main body 102.

The air treatment member 110 and/or bin assembly 240 includes an air treatment member electrical connector 282 to electrically couple the air treatment member 110 and/or bin assembly 240 and the main body 102. The main body 102 includes a main body electrical connector 284 to be coupled to the air treatment member electrical connector 282 of the air treatment member 110 and/or bin assembly 240 (connectors 282, 284 are shown decoupled in FIG. 4), to electrically join the accessory connector 270 mounted to the removeable air treatment member 110 and/or bin assembly 240 to the source of power in the main body 102 (e.g., to couple the cables 280 in the bin to the cables 280 in the body 102).

The body electrical connector 284 may extend from or be adjacent to a surface of the body that abuts a surface of the air treatment member when the air treatment member 110 and/or bin assembly 240 is mounted to the body 102 in air flow communication with the body 102. Similarly, the bin electrical connector 282 may extend from or be adjacent to a surface of the bin 110 and/or bin assembly 240 that abuts a surface of the body 102 when the air treatment member 110 is mounted to the body 102 in air flow communication with the body 102. The bin electrical connector 282 may be directed rearwardly from the bin assembly 240, and the body connector 284 may be directed forwardly from the body 102. In some examples, the air treatment member 110 and/or bin assembly 240 is concurrently connectable in air flow communication with the main body 102 and electrically connectable to the main body 102 when the air treatment member 110 and/or bin assembly 240 is mounted to the main body 102.

The accessory connector 270 and the main body electrical connector 284 may each be a female connector, and the air treatment member electrical connector 282 may be a male connector. However, it will be appreciated that any other combination of male and female connectors may be used, and, in some examples, there may be multiple accessory connectors 270, main body connectors 284, and/or air treatment member connectors 282. Where the accessory connection 270 and/or the main body connector 284 is a male connector, the surface cleaning apparatus 100 may include a switch to turn off power to the accessory connector 270 and/or the main body connector 284.

The accessory power connector 270 may be on an openable door of the air treatment member 110. As exemplified in FIGS. 34 to 36, a bin assembly 240 and/or air treatment member 110 may have an openable door, such as a front door 290. In some examples, the accessory power connector 270 is mounted on an openable door such as door 290 of the embodiment shown in FIGS. 34 to 36.

As exemplified in FIGS. 2, 19, 30, and 35, The surface cleaning apparatus 100 may include an inlet conduit 192 having the dirty air inlet 116, and the accessory electrical connector 270 may be provided adjacent the inlet conduit 192. The inlet conduit 192 may be provided at an upper end 134 of the surface cleaning apparatus 100.

As exemplified in FIGS. 2 and 3, the air treatment member electrical connector 282 may be provided at a lower end 136 of the air treatment member 110 and/or the surface cleaning apparatus 100. Electrical connectors 270, 282 of the air treatment member 110 may be on opposite sides (e.g., lateral sides) of the surface cleaning apparatus. For example, the electrical connectors 270, 282 of the air treatment member 110 may be on opposite sides of a vertical line through the centre of gravity (e.g., a plane that is transverse to the cyclone axis and extend through the centre of gravity) and/or on opposite sides of a horizontal line through the centre of gravity. Maneuverability may be facilitated by having the electrical connectors 270, 282 on either side of the centre of gravity.

It will be understood that the connectors 270, 282, 284 may be any suitable electrical connectors and may be arranged in any suitable way to permit electrically coupling the accessory to the power source of the main body through the bin assembly. As illustrated, the connectors 270, 282, 284 may be rigidly mounted, which may facilitate making an electrical connection concurrently when establishing air flow connections. Alternatively, one or more connector 270, 282, 284 may be a pig tail connector.

The electrical conductors or cables 280 may take any suitable path through or along the bin assembly 240 and/or main body 102. As exemplified, the air treatment member 110 comprises electrical conductors 280 that extend along a portion of the air treatment member 110 from the air treatment member electrical connector 282 to the cleaning tool electrical connector 270, with at least a portion of the electrical conductors 280 extending along an outer surface 292 of the walls of the cyclone chamber 166 and/or the dirt collection chamber 170.

As illustrated in FIG. 2, the air treatment member 110 may comprise electrical conductors 280 that extend along a front end of the bin assembly 240. For example, the electrical connectors may extend along an outer surface of a front end 130 of the air treatment member 110. The electrical conductors 280 also extend along a lower end 136 of the air treatment member 110. The electrical conductors 280 may extend along an outer surface of a bottom end of the dirt collector 170. The bin assembly 240 may include a cover 298 mounted to the air treatment member 110 to overly that electrical conductors 280 where the electrical conductors extend over outer surfaces of the air treatment member 110 (e.g., outer surfaces of the dirt chamber or cyclone chamber). Alternately, the electrical conductors may be provided in grooves provided in the wall of the bin assembly 240.

As illustrated in FIG. 2, the conductors 280 extend from the cord 202 up through the handle 104 (i.e., the hand grip portion 220), into the motor housing 152 through a grommet 294 to the motor 150 to supply power to the motor 150. As exemplified, the electrical conductors 280 also extend from the motor 150 out of the motor housing 152 through the grommet 294 then between the motor housing 152 and the outer housing of main body 102, through a bleed valve housing 296, out of the bleed valve housing 296 through an aperture and then between the premotor filter housing 184 and the outer housing of the main body 102 to the body connector 284. The body connector 284 couples to the bin connector 282 to supply power to the bin connector 282. Electrical conductors extend from the bin connecter 282 along an outer surface of the walls of the dirt chamber 170 at the bottom end of the dirt chamber 170 to the front of the dirt chamber 170, and then up an outer surface of the dirt assembly 170 at the front of the dirt chamber 170 and up an outer surface of the walls of the cyclone chamber 166 at a front end of the cyclone chamber 166 to the accessory connector 270. Along the outer surfaces of the walls of the dirt chamber 170 and cyclone chamber 166, the conductors 280 are covered by an outer cover 298 of the bin assembly 240.

Figure 5:
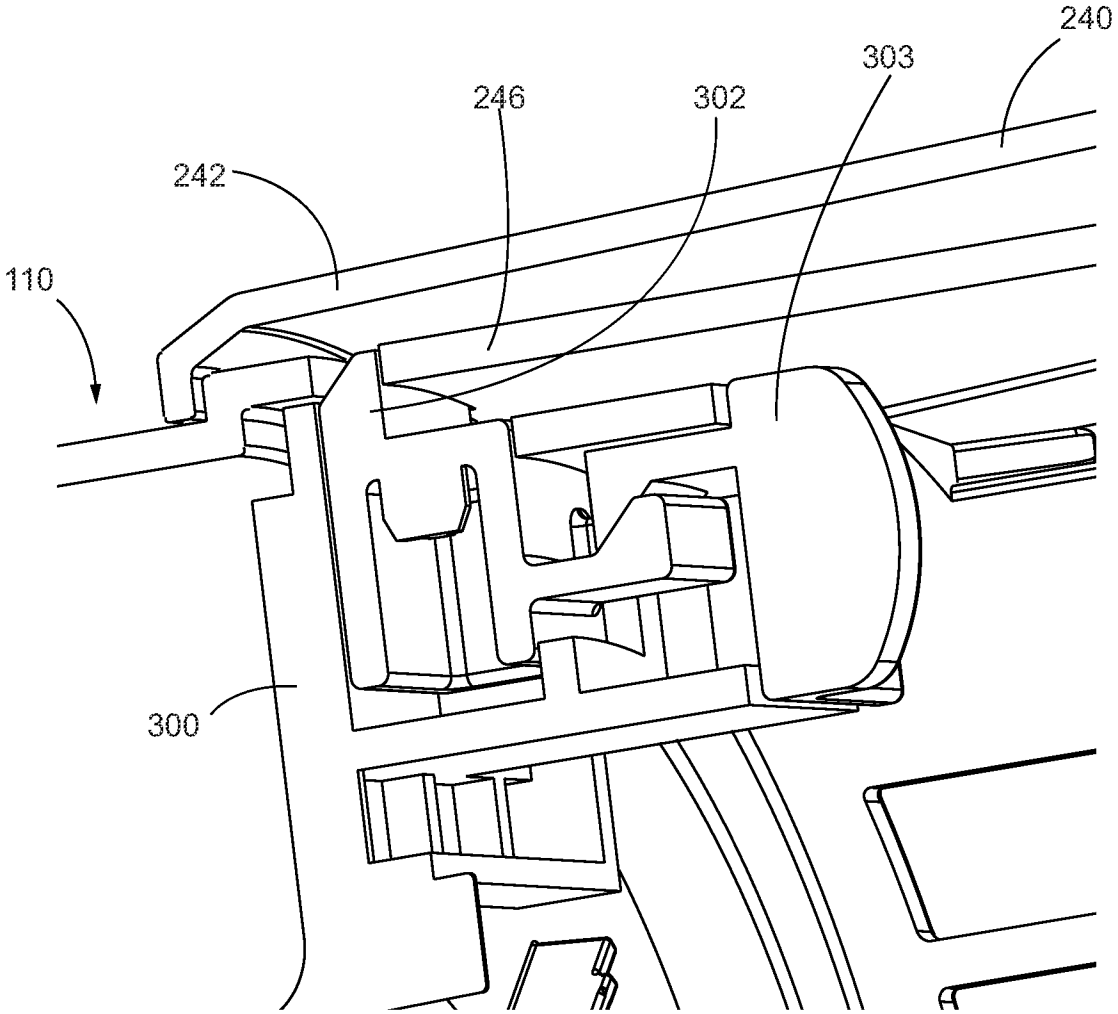
FIG. 5 is an expanded view of a portion of the hand vacuum cleaner of FIG. 1.
Figure 6:
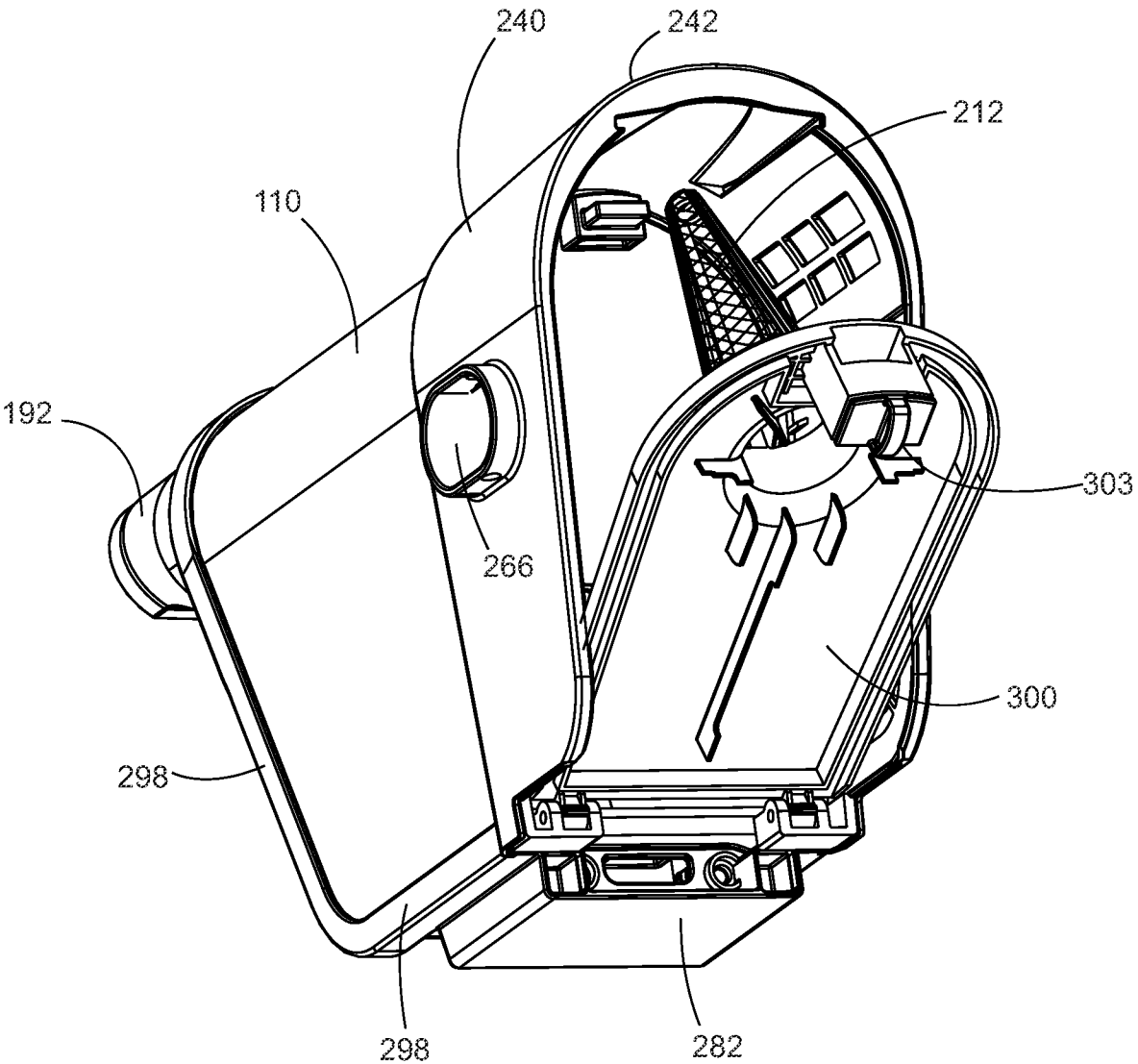
FIG. 6 is a rear perspective view of the air treatment member assembly of the hand vacuum cleaner of FIG. 1 with a rear door in a first open position.
Figure 7:
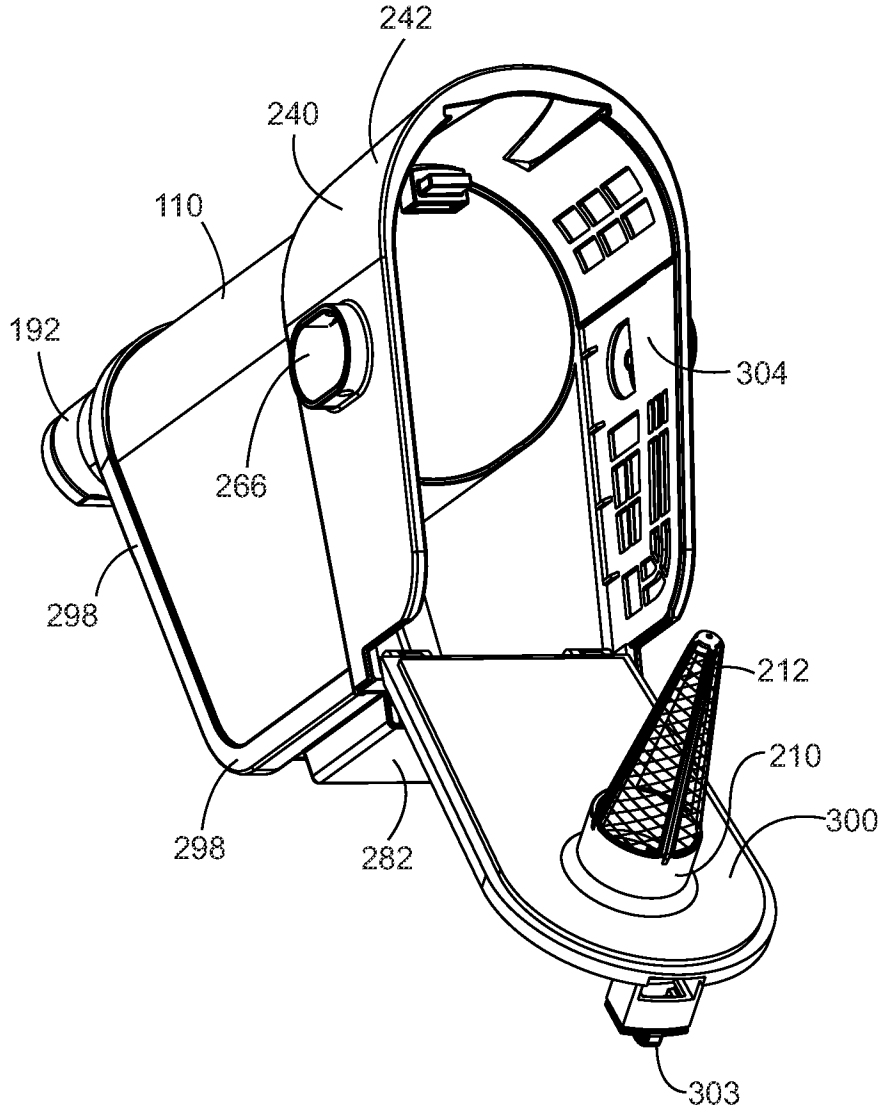
FIG. 7 is a rear perspective view of the air treatment member assembly of the hand vacuum cleaner of FIG. 1 with a rear door in a further opened position.

A rear end 133 of the air treatment member 110 is openable and, optionally, no electrical conductors extend across the rear end 132. The rear end 132 of the air treatment member 110 may include an openable door 300. The door 300 (FIGS. 3 to 7) may be pivotally secured to the air treatment member 110, and moveable between an operating position (FIGS. 3 and 4) and an emptying position (FIGS. 6 and 7). As illustrated in FIG. 5, the door 300 may be secured by a latch 302 inside the flange 242. An actuator 303 within the flange 242 may be accessible when the bin assembly 240 and/or air treatment member 110 is removed from the main body 102 (e.g., and not accessible when the bin assembly 240 and/or air treatment member 110 is not removed from the main body 102).

In the emptying position one or both of the cyclone chamber 166 and the dirt collection chamber 170 may be opened to remove dirt. In some examples, opening the rear door 300 also opens the dirt outlet 172 (e.g., moves one wall defining a part of a perimeter of the dirt outlet 172 away from another wall defining another portion of the perimeter of the dirt outlet 172).

The electrical conductors or cables 280 may be any electrical connector such as wires. Alternately, they may be flat conductors. The electrical conductors 280 may comprise flat conductors that have a height and a width perpendicular to the height, wherein the height and the width are dimensioned in a plane that is perpendicular to an extension direction of the conductor, and the width is the longest distance across the conductor in the plane and the height is perpendicular to the width. The electrical conductors 280 may have a depth (e.g., a height) in a direction that extends in an outward direction to a wall of a portion of the air treatment member 110 and a width in a direction parallel to a wall of the portion of the air treatment member 110 and the width is greater than the depth or height. For example, if as exemplified in FIG. 2, the electrical conductors 280 extends along the surface to which reference numeral 240 points in FIG. 4, then the height is in the forward direction and the width is in the lateral, side to side, direction). One or more conductor of the surface cleaning apparatus 100 may have a height of 0.01-5 mm, 0.5-5 mm, 0.5-3 mm or 1-3 mm. One or more conductor of the surface cleaning apparatus 100 may have a width of 0.25-15 mm, 1-10 mm, or 2-7 mm. Using a flat conductor may allow for sharper bends in a conduction path.

Filters are Accessible when Air Treatment Member is Moved

The following is a description of filters that are accessible when air treatment member is moved, which may be used by itself or in combination with one of more of the uniflow cyclone, the open handle, the arcuate post-motor filter, the removable air treatment member, the accessory power connection on a removeable air treatment member, the transversely extending bleed valve, the laterally directed inlet to the bleed valve, the rearwardly positioned control panel, the motor and/or motor housing extends into surrounding features, the power line extends through the handle, the brushes are centered, the handle is in-line with additional components, centrally positioned components, off-center components with a centered centre of gravity, the friction surface on a handle base, sound damping and an in-line vortex finder or air treatment member, which are set out herein.

In accordance with this aspect, the surface cleaning apparatus 100 includes a pre-motor filter 180 and/or a post-motor filter 182. The pre-motor filter 180 and/or the post-motor filter 182 may be accessible when the air treatment member 110 is moved from an operating position to an emptying position (e.g., when the air treatment member is removed or pivoted to an open position in which, optionally, a dirt chamber may be emptied). The pre-motor filter 180 and/or the post-motor filter 182 may be inaccessible when the air treatment member 110 is attached to the main body in an operating position of the hand vacuum cleaner. This aspect may be used by itself or in combination with one or more other aspects of this disclosure.

As illustrated in FIGS. 4, 8-11, 21-28, and 32-33, the pre-motor filter 180 and/or the post-motor filter 182 may be removably receivable in a filter housing (e.g., pre-motor filter housing 184 and post-motor filter housing 186). For example, the pre-motor filter 180 may be removably received (e.g., held) in a pre-motor filter housing 184 and the post-motor filter 182 may be removably received (e.g., held) in a post-motor filter housing 186 when the air treatment member 110 is in the operating position.

Moving the air treatment member 110 from the operating position to the emptying position may open the filter housing (e.g., such that a filter is accessible if the filter is in the housing). For example, the filter housing may include a removeable housing portion 304 secured to the air treatment member 110 such that the removeable housing portion 304 moves with the air treatment member 110.

Alternately or in addition, moving the air treatment member 110 from the operating position to the emptying position may result in a removeable housing portion of the filter housing being removeable. The removeable housing portion 304 of the filter housing may not be removable while the air treatment member 110 is in the operating position.

As exemplified in FIGS. 21-28, moving the air treatment member 110 from the operating position to the emptying position may expose a removable housing portion 304 (e.g., a wall or cover) of the filter housing (e.g., housing 184) such that the removable housing portion of the housing (e.g., housing 184) may be removed (e.g., lifted away) and, if a filter (e.g., filter 180) is held in the housing, the filter held in the housing is accessible. Alternately, moving the air treatment member 110 from the operating position to the emptying position may expose the pre-motor filer 180 enabling the pre-motor filter to be removed.

As exemplified in FIGS. 30-33, moving the air treatment member 110 from the operating position to the emptying position may uncover or otherwise make accessible a latch control or actuator 306 of a latch or lock 308 that holds the removable housing portion 304 of the filter housing (e.g., housing 286) in position, and the latch control or actuator 306 may be used to release the latch or lock 308 and the removeable housing portion 304 such that the removeable housing portion 304 (e.g., wall or cover) of the filter housing may be removed (e.g., lifted away) and, if a filter (e.g., filter 182) is held in the housing, the filter held in the housing is accessible. The latch control or actuator 306 of the latch or lock 308 may be inaccessible when the air treatment member 110 and/or bin assembly 240 is in the operating position. It will be appreciated that the post-motor filter may be secured to or removable with the removable housing portion 304.

As exemplified in FIGS. 4-9, the pre-motor filter 180 may remain with the main body when the air treatment member 110 is removed and may be accessed when the air treatment member 110 is removed. Accordingly, a removeable housing portion 304 of the pre-motor filter 180 may be moved as part of the air treatment member 110 when the air treatment member 110 is removed. In other words, when the air treatment member 110 is moved (e.g., removed or pivoted away from the main body) the removeable housing portion 304 may be moved with the air treatment member 110; providing access to the pre-motor filter 180. The pre-motor filter 180 may be removed from the surface cleaning apparatus 100 (e.g., the main body), such as by pulling the pre-motor filter 180 out through the opening that is exposed by the removal of the removeable housing portion 304.

Figure 24:
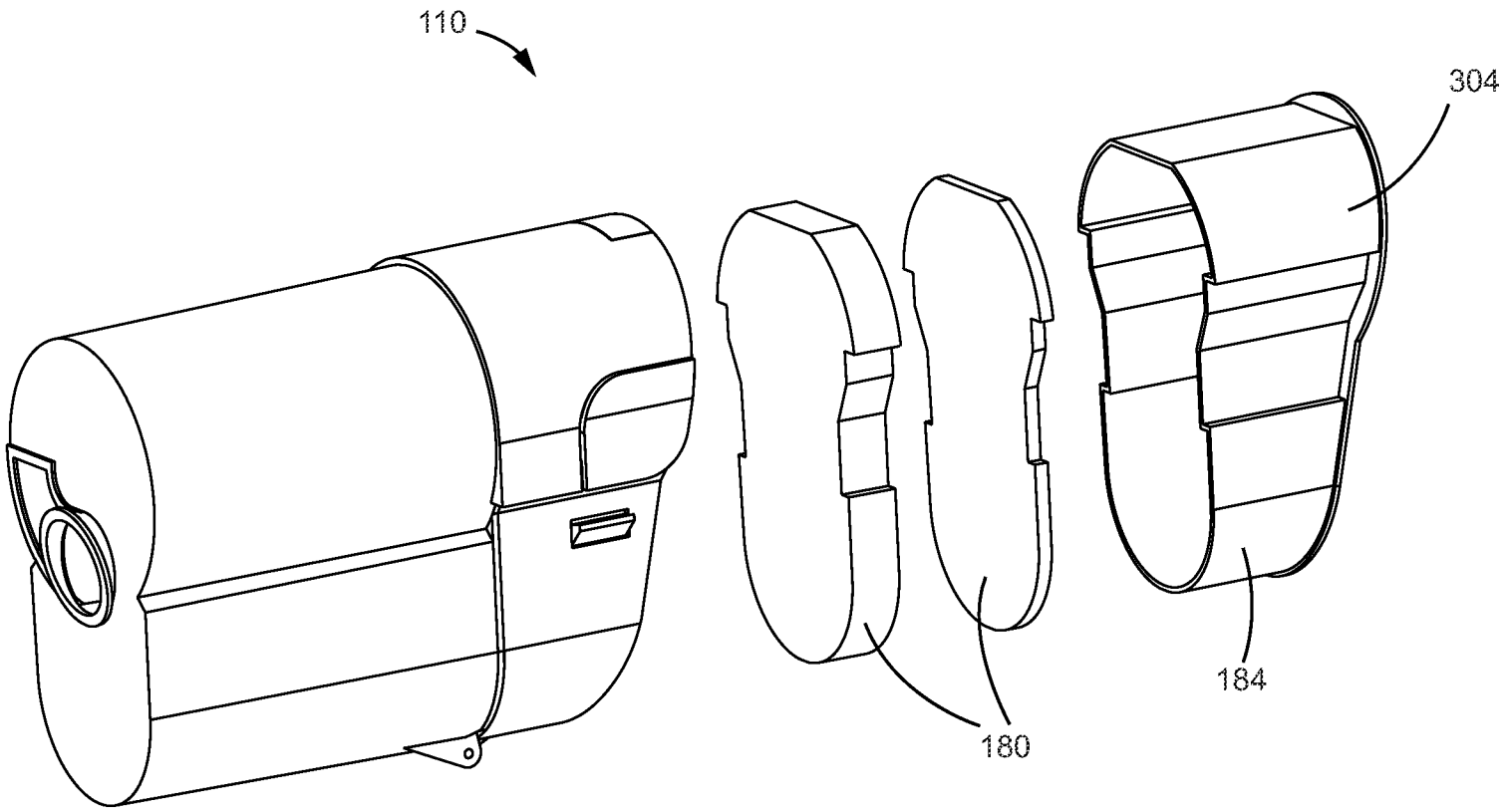
FIG. 24 is a side perspective view from the front of the air treatment member assembly of the hand vacuum cleaner of FIG. 18 with the pre-motor filter removed.

As exemplified in FIGS. 20, 21, 27, and 28, the removeable housing portion 304 of the post-motor filter 182 may have a recess for receiving the pre-motor filter (see FIG. 24). The removable housing portion 304 may have a latch 308 that can be released when the air treatment member 110 is removed, thereby enabling the removable housing portion 304 to be removed from the air treatment member 100 and providing access to the post-motor filter 182. The removeable housing portion 304 may be secured in position by the latch or lock 308, and moving the latch release or actuator 306 releases the latch or opens the lock such that the removeable housing portion 304 may be removed (e.g., pulled or lifted away) from the air treatment member 110. The post-motor filter 182 may then be pulled out through the opening provided by removal of the removeable housing portion 304.

In any embodiment, the filter (e.g., the pre-motor filter) may be removed with the bin (e.g., FIGS. 20 to 24) or may be left behind when the bin is removed (e.g., FIGS. 3 and 4), and the removeable portion of the housing may be removed by the action of moving the bin to the open position, may be accessible for removal when the bin is in the open position, or may be released by releasing a latch via an actuator that is accessible when the bin is moved to the open position. For example, the removeable portion 304 of the embodiment of FIGS. 20 to 24 wherein the filter removes with the bin is shown as an unlatched portion that removes along with the bin 240 and filter 180, but may alternatively be secured by a latch in some embodiments or may be left behind on the body 102 when the bin 240 is removed in some embodiments. Similarly, while the removeable portion 304 of the embodiment of FIGS. 3 and 4 is shown removing with the bin 240 to expose the pre-motor filter 180 which remains on the body 102, in some embodiments the removeable portion 304 may remain on the body when the bin 240 is removed and may be unlatched (i.e., can be picked out directly without releasing a latch) or secured by latch that can be released when the bin via an actuator that is accessible when the bin 240 is removed.

The removeable housing portion of the filter housing may include a portion of an outer surface of the main body 102.

The removeable housing portion 304 of the filter housing may overly part or all of the suction motor 150. The removeable housing portion 304 of the filter housing may be removeable in a direction that is transverse to the central longitudinal axis 144 of the surface cleaning apparatus 100 and/or the axis of rotation 154 of the motor 150. Alternately, the removeable housing portion 304 of the filter housing may be removeable in a direction that is parallel to the central longitudinal axis 144 of the surface cleaning apparatus 100 and/or the axis of rotation 154 of the motor 150.

As exemplified in FIGS. 11 and 28, the post-motor filter 182 may have a length 310, a width 312, and a height 314. The longest dimension (i.e., of the length 310, width 312, and height 314) may be in a direction parallel to the central longitudinal axis 144 of the surface cleaning apparatus 100 and/or the axis of rotation 154 of the motor 150.

Transversely Extending Bleed Valve

The following is a description of a transversely extending bleed valve, which may be used by itself or in combination with one of more of the uniflow cyclone, the open handle, the arcuate post-motor filter, the removable air treatment member, the accessory power connection on a removeable air treatment member, the filters are accessible when air treatment member is moved, the laterally directed inlet to the bleed valve, the rearwardly positioned control panel, the motor and/or motor housing extends into surrounding features, the power line extends through the handle, the brushes are centered, the handle is in-line with additional components, centrally positioned components, off-center components with a centered centre of gravity, the friction surface on a handle base, sound damping and an in-line vortex finder or air treatment member, which are set out herein.

In accordance with this aspect, the surface cleaning apparatus 100 includes a bleed valve 320 which extends transversely to axis 144. The bleed valve 320 includes a longitudinal axis 322 that is generally perpendicular to the longitudinal axis 144 of the surface cleaning apparatus 100, the cyclone axis of rotation 160, and/or the motor axis of rotation 154. This aspect may be used by itself or in combination with one or more other aspects of this disclosure.

Figure 12:
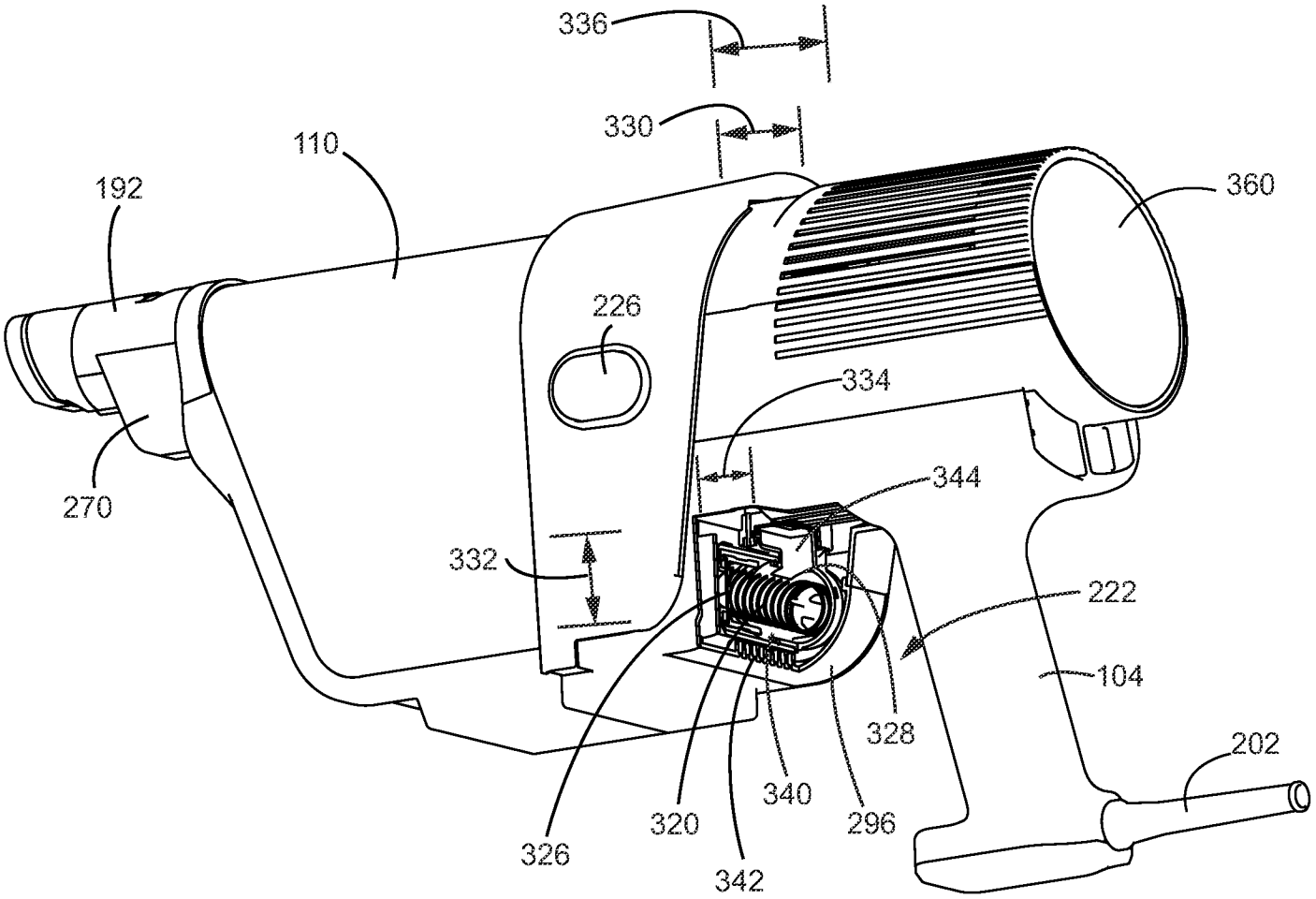
FIG. 12 is a bottom perspective view of the hand vacuum cleaner of FIG. 1 with a cutout into a bleed valve.

As exemplified in FIG. 12, the bleed valve 320 includes a bleed air flow path that extends from a bleed air inlet 326 to a bleed air outlet 328. The bleed air inlet 326 and the bleed air outlet 328 may be transversely spaced apart (e.g., by a distance 330). Accordingly, part or all of the bleed air flow path from the bleed air inlet 326 to the bleed air outlet 328 may extend transversely to axis 144.

The bleed valve 320 may have a height 332, a width 334, and a length 336, and the longest dimension (e.g., of the height 332, the length 334, and the width 336) may extend transversely. For example, an axis that is transverse to the central longitudinal axis 144 may extend through the longest dimension of the bleed air flow path, and this axis may extend through the first and second laterally opposed sides 140, 142 of the surface cleaning apparatus. The bleed air flow path may have the longest dimension that extends transversely in a plane that is transverse to a vertical plane that is parallel to the central longitudinal axis 144 and extends through the bleed valve 320.

Alternately, or in addition, the bleed valve 320 may have a generally linear bleed air passage 340 extending from the bleed air inlet 326 to the bleed air outlet 328, and the bleed air passage 340 may extend generally transversely. For example, at least 50%, 75%, or 90% of the bleed air passage 340 may extend generally transversely.

The bleed valve 320 may be received (e.g., enclosed and/or held) in a bleed valve housing 296, and the bleed valve housing 296 may also have an inlet 342 and an outlet 344.

Figure 13:
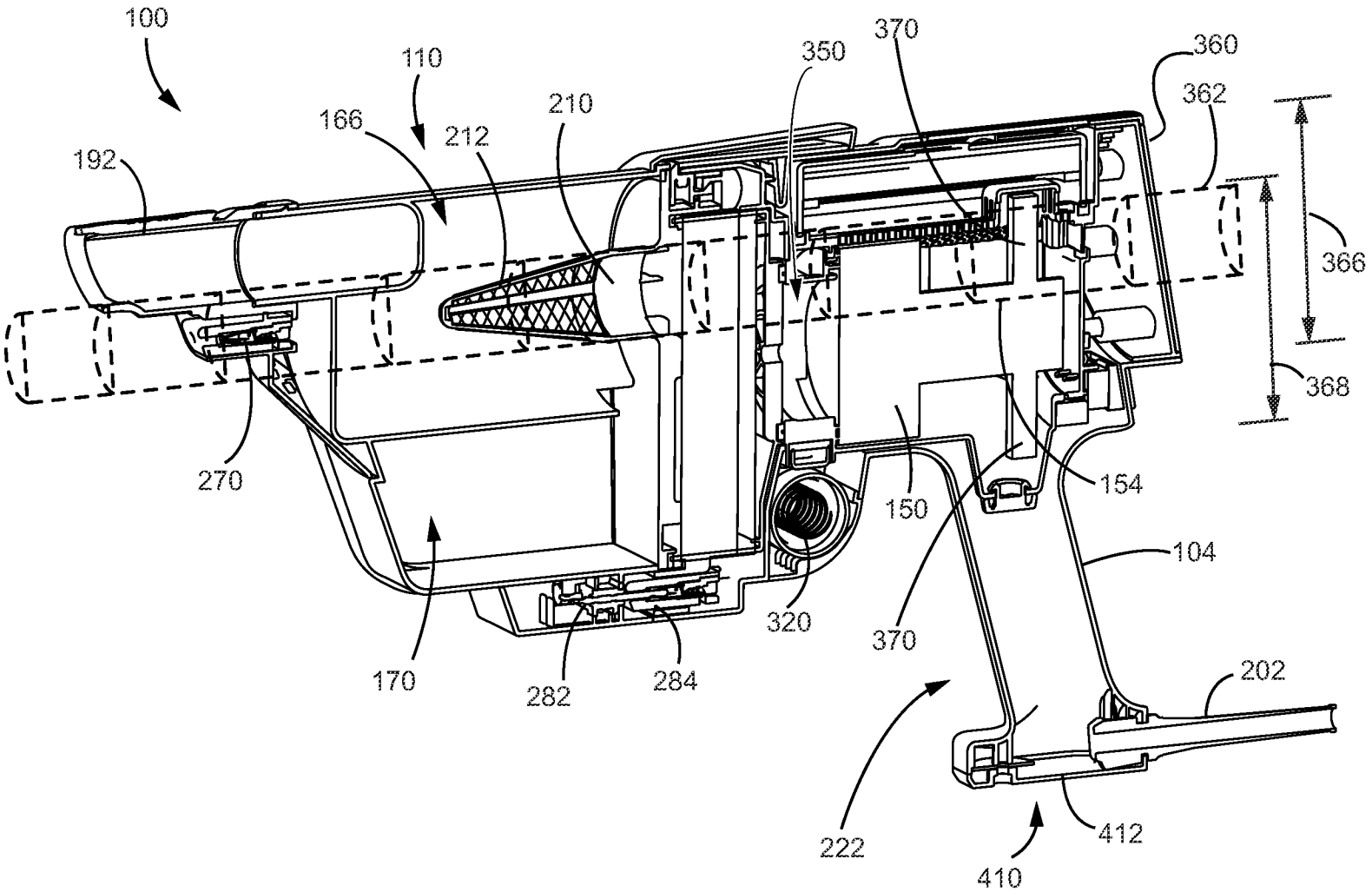
FIG. 13 is a front cross sectional view of the hand vacuum cleaner of FIG. 1 showing a projection of the vortex finder.

As exemplified in FIG. 13, part or all of a finger gap 222 may be between the handle 104 and the bleed valve 320. The finger gap 222 may be between the handle 104 and the main body 102, and the bleed valve 320 may be positioned in the main body 102 with the finger gap 222 between the bleed valve 320 and the handle 104. As illustrated, the bleed valve 320 may be part of the front side of the finger gap 222.

Alternately, the bleed valve 320 may be positioned in the main body 102 between the finger gap 222 and/or the handle 104 and the pre-motor filter 180, the pre-motor filter housing 184, and/or the dust cup 170.

As illustrated in FIGS. 2 and 13, the pre-motor filter 180 may be forward of the bleed valve 320. The pre-motor filter 180 may be upstream of the motor 150, with a duct 350 leading from the outlet of the pre-motor filter housing 184 to the inlet of the motor housing 152. As illustrated, the duct 350 may be a closed duct leading directly between the outlet of the premotor filter housing 184 and the inlet of the motor housing 152. Alternatively, the bleed valve 320 may open into the duct 350, as illustrated. The bleed valve housing 296 may have an outlet that opens into the duct 350. In some examples, the duct 350 is above the bleed valve housing 296. The bleed valve housing 296 may open into a lower portion of the duct 350.

The bleed valve 320 may be centrally positioned. For example, a line positioned centrally between the lateral sides 140, 142 and parallel to the longitudinal axis 144 may extend through the bleed valve 320. A plane that is parallel to the central longitudinal axis 144 and that extends through the first and second laterally opposed sides 140, 142 may also extend through the bleed valve 320. This plane (e.g., a horizontal plane or a plane extending at an angle between horizontal and vertical) may also extend through the air treatment member 110, the pre-motor filter 180, and/or the handle 104. This plane may be external to the suction motor 150. A vertical plane that is parallel to the central longitudinal axis 144 and that extends centrally between the first and second laterally opposed sides 140, 142 of the surface cleaning apparatus 100 may extend through the bleed valve 320. The vertical plane may bisect the bleed valve 320. In some examples, a vertical plane that is transverse to the central longitudinal axis 144 bisects the bleed valve 320.

It will be appreciated that the bleed valve air inlet may face laterally but may not extend to a lateral side of the hand vacuum cleaner.

It will be appreciated that the bleed valve may have two bleed valve inlets, each of which may be on opposite sides of a vertical plane that extends through the central axis 144 and, optionally, each bleed valve inlet may face laterally as discussed subsequently.

Laterally Directed Inlet to the Bleed Valve

The following is a description of a laterally directed inlet to the bleed valve, which may be used by itself or in combination with one of more of the uniflow cyclone, the open handle, the arcuate post-motor filter, the removable air treatment member, the accessory power connection on a removeable air treatment member, the filters are accessible when air treatment member is moved, the transversely extending bleed valve, the rearwardly positioned control panel, the motor and/or motor housing extends into surrounding features, the power line extends through the handle, the brushes are centered, the handle is in-line with additional components, centrally positioned components, off-center components with a centered centre of gravity, the friction surface on a handle base, sound damping and an in-line vortex finder or air treatment member, which are set out herein.

In accordance with this aspect, the bleed valve inlet 326 is a laterally directed or facing inlet. The air inlet 326 of the bleed valve 320 and/or the air inlet 342 of the bleed valve housing 296 may be directed or face towards a lateral side 140 or 142 of the surface cleaning apparatus 100 or may be on a lateral side 140 or 142 of the surface cleaning apparatus 100 or may be in a vertical plane that is generally parallel to axis 144. This aspect may be used by itself or in combination with one or more other aspects of this disclosure.

As exemplified in FIG. 12, the air inlet 326 of the bleed valve 320 and/or the air inlet 342 of the bleed valve housing 296 may be on one side of the centre axis 144 of the surface cleaning apparatus 100 extending between the front end 130 and the rear end 132. The air inlet 326 of the bleed valve 320 and/or the air inlet 342 of the bleed valve housing may be on one or both lateral sides of a vertical center plane through the centre line 144.

The air inlet 326 of the bleed valve 320 and/or the air inlet 342 of the bleed valve housing 296 may extend in a plane that is substantially perpendicular to a plane in which the air inlet 166 of the surface cleaning apparatus 100 extends.

The air inlet 326 of the bleed valve 320 and/or the air inlet 342 of the bleed valve housing 296 is directed towards (e.g., it opens towards) a lateral side of the surface cleaning apparatus 100. In some examples, the surface cleaning apparatus 100 includes a bleed valve air inlet 326 of the bleed valve 320 and/or an inlet 342 of the bleed valve housing 296 on each of the right and left laterally opposed sides 140, 142 of the surface cleaning apparatus 100.

The bleed valve air inlet 326 may comprise a first inlet on the right latterly opposed side and a second inlet on the left latterly opposed side of the bleed valve 320 and/or of the housing or body 102.

Rearwardly Positioned Control Panel

The following is a description of a rearwardly positioned control panel, which may be used by itself or in combination with one of more of the uniflow cyclone, the open handle, the arcuate post-motor filter, the removable air treatment member, the accessory power connection on a removeable air treatment member, the filters are accessible when air treatment member is moved, the transversely extending bleed valve, the laterally directed inlet to the bleed valve, the motor and/or motor housing extends into surrounding features, the power line extends through the handle, the brushes are centered, the handle is in-line with additional components, centrally positioned components, off-center components with a centered centre of gravity, the friction surface on a handle base, sound damping and an in-line vortex finder or air treatment member, which are set out herein.

In accordance with this aspect, the surface cleaning apparatus 100 includes a control panel 360 containing one or more toggle (e.g., a button or touchscreen) operable to control the surface cleaning apparatus 100 or a component of the surface cleaning apparatus 100 (e.g., turn on the motor 150 or adjust a setting of the motor). The control panel 360 is located on a rear external surface of the surface cleaning apparatus 100 and/or is on a centre line of the surface cleaning apparatus. This aspect may be used by itself or in combination with one or more other aspects of this disclosure.

Figure 18:
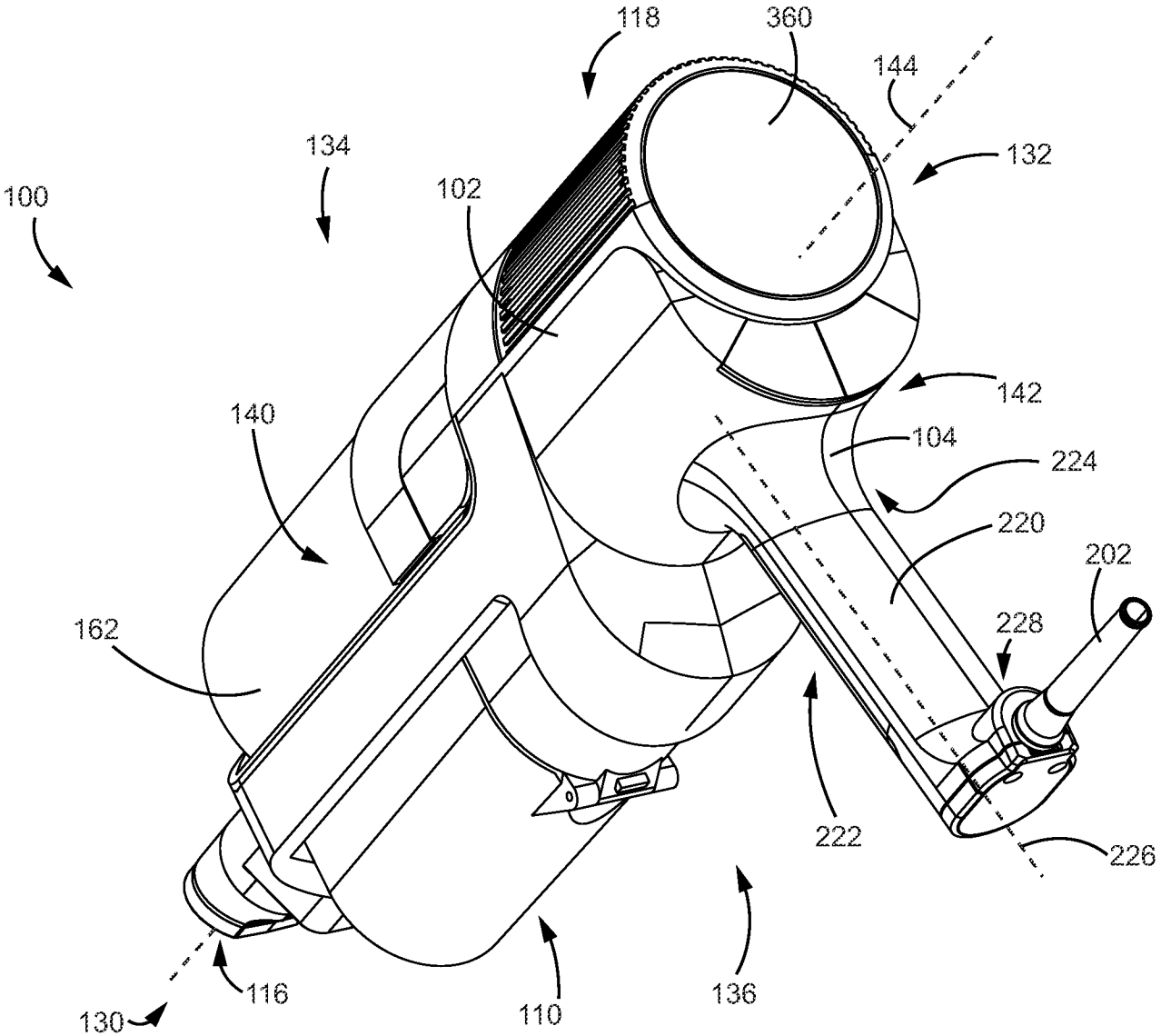
FIG. 18 is a rear perspective view of an alternative hand vacuum cleaner, in accordance with an embodiment.
Figure 29:
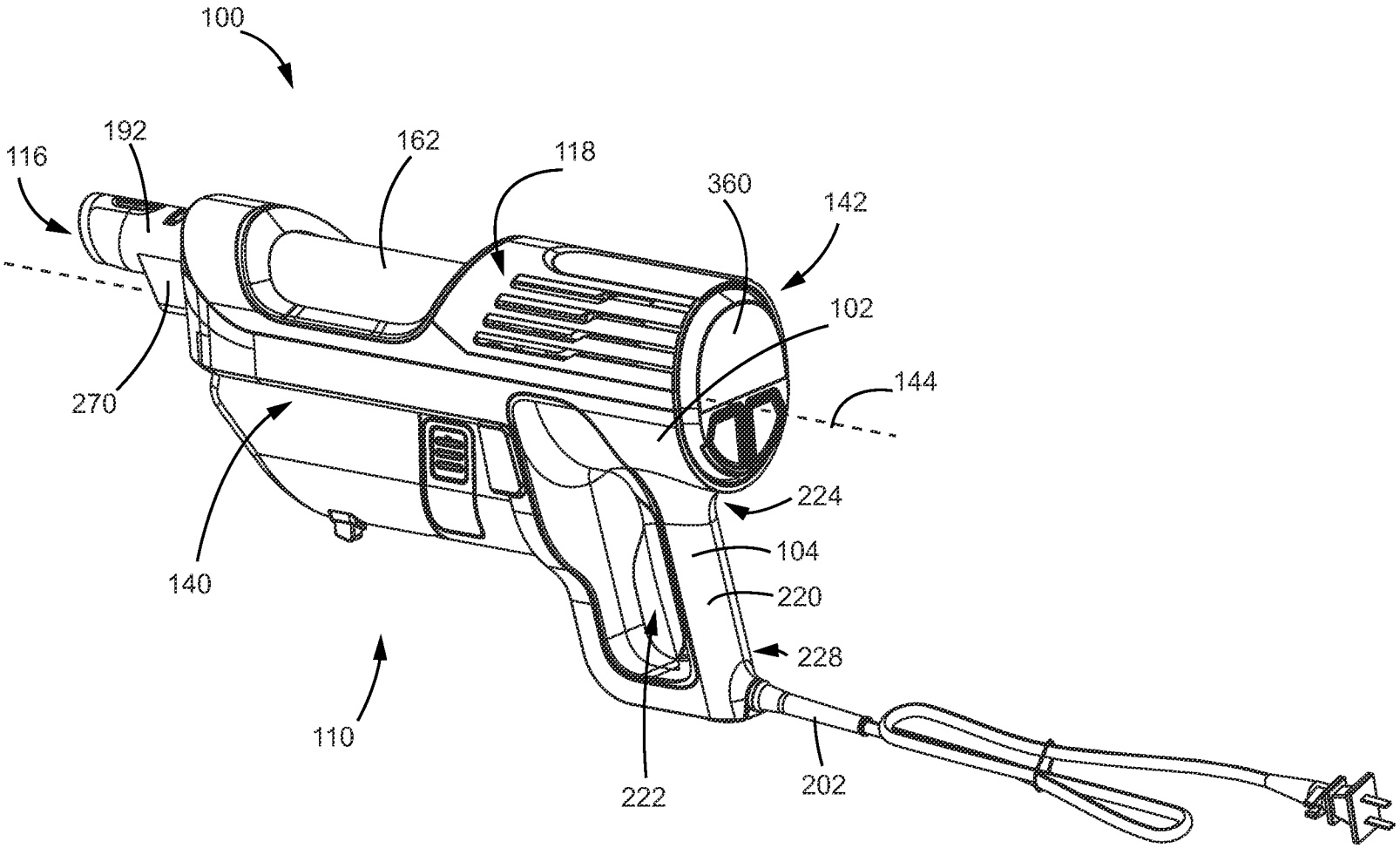
FIG. 29 is a rear perspective view of an alternative hand vacuum cleaner, in accordance with an embodiment.

As illustrated in FIGS. 1, 18, and 29, the control panel 360 may be on a rear surface of the surface cleaning apparatus 100, wherein all or at least a portion of the control panel 360 is visible when viewing the surface cleaning apparatus 100 directly from the rear end 132.

Figure 17:
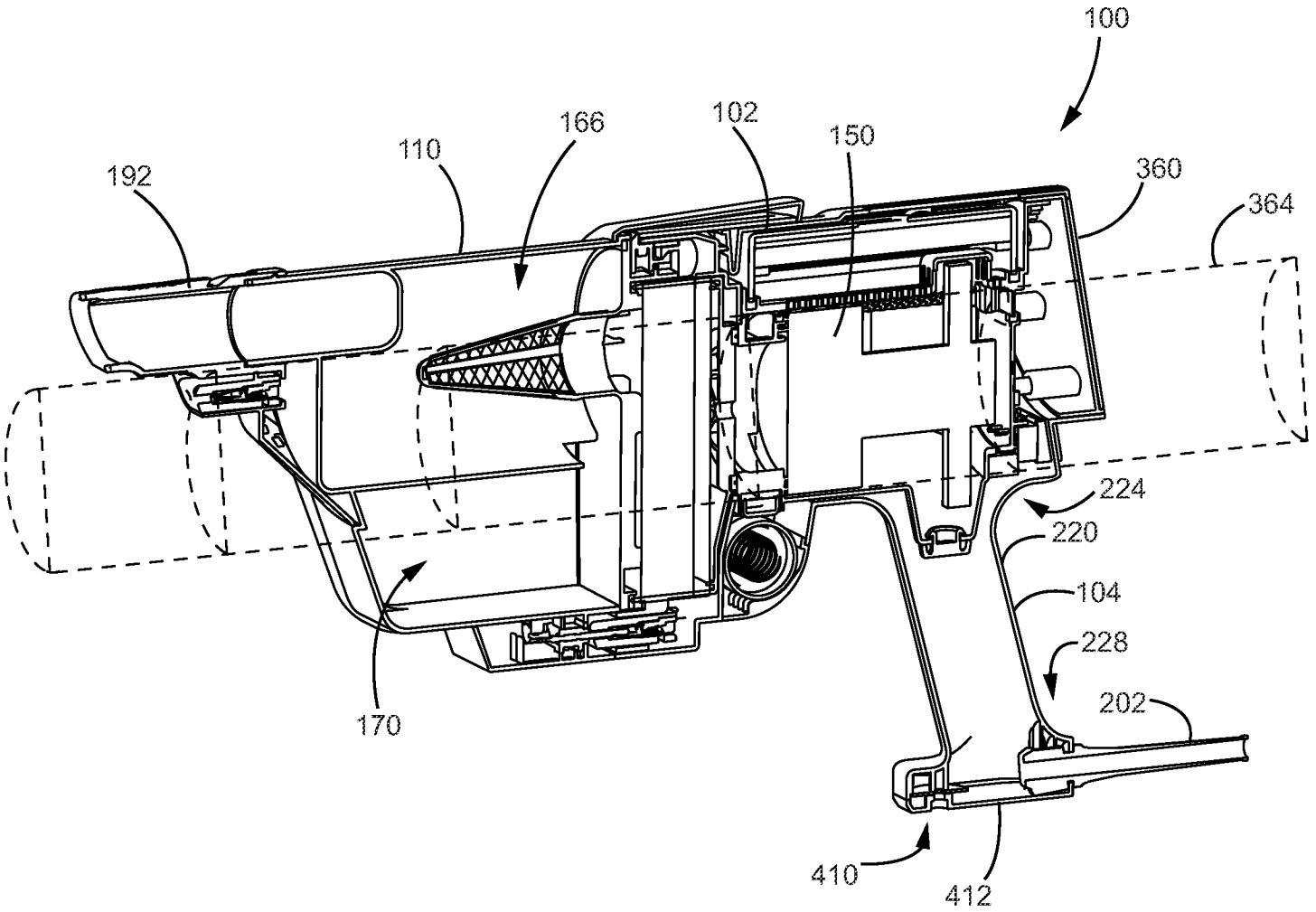
FIG. 17 is a side cross sectional view of the hand vacuum cleaner of FIG. 1 showing a projection of the motor.

Alternately or in addition, the control panel 360 may be centered, wherein the control panel 360 is on the centre axis 144 of the surface cleaning apparatus. A line or plane through the centre of the vortex finder 210 may pass through the control panel 360. As illustrated in FIG. 13, a projection 362 of the vortex finder 210 may pass through the control panel 360. The centre axis 154 of the motor 150 may pass through the control panel 360. A projection of the inlet of the motor 150 may pass through the control panel 360. A projection 364 of the body of the motor 150 may pass through the control panel 360 as illustrated in FIG. 17. A vertical centre plane may bisect the control panel 360.

As illustrated in FIG. 13, the control panel 360 may have a width 366 (e.g., a diameter, if the control panel 360 is circular) that is about the same as a width 368 (e.g., a diameter) of the motor 150 in transverse section. For example, the width 366 of the control panel 360 may be within 25%, 20%, 10%, or 5% of the width 368 of the motor 150 in transverse section.

The Motor and/or Motor Housing Extends into Surrounding Features

The following is a description of a motor and/or motor housing extends into surrounding features, which may be used by itself or in combination with one of more of the uniflow cyclone, the open handle, the arcuate post-motor filter, the removable air treatment member, the accessory power connection on a removeable air treatment member, the filters are accessible when air treatment member is moved, the transversely extending bleed valve, the laterally directed inlet to the bleed valve, the rearwardly positioned control panel, the power line extends through the handle, the brushes are centered, the handle is in-line with additional components, centrally positioned components, off-center components with a centered centre of gravity, the friction surface on a handle base, sound damping and an in-line vortex finder or air treatment member, which are set out herein.

In accordance with this aspect, a portion of the motor 150 and/or motor housing 152 of the surface cleaning apparatus 100 extends into an adjacent component or element of the surface cleaning apparatus 100. For example, a brush 370 or outer shell of the motor 150 and/or an enclosing portion of the motor housing 152 may extend into the handle 104 and/or into the post-motor filter 182 or post motor filter housing. This aspect may be used by itself or in combination with one or more other aspects of this disclosure.

Figure 19:
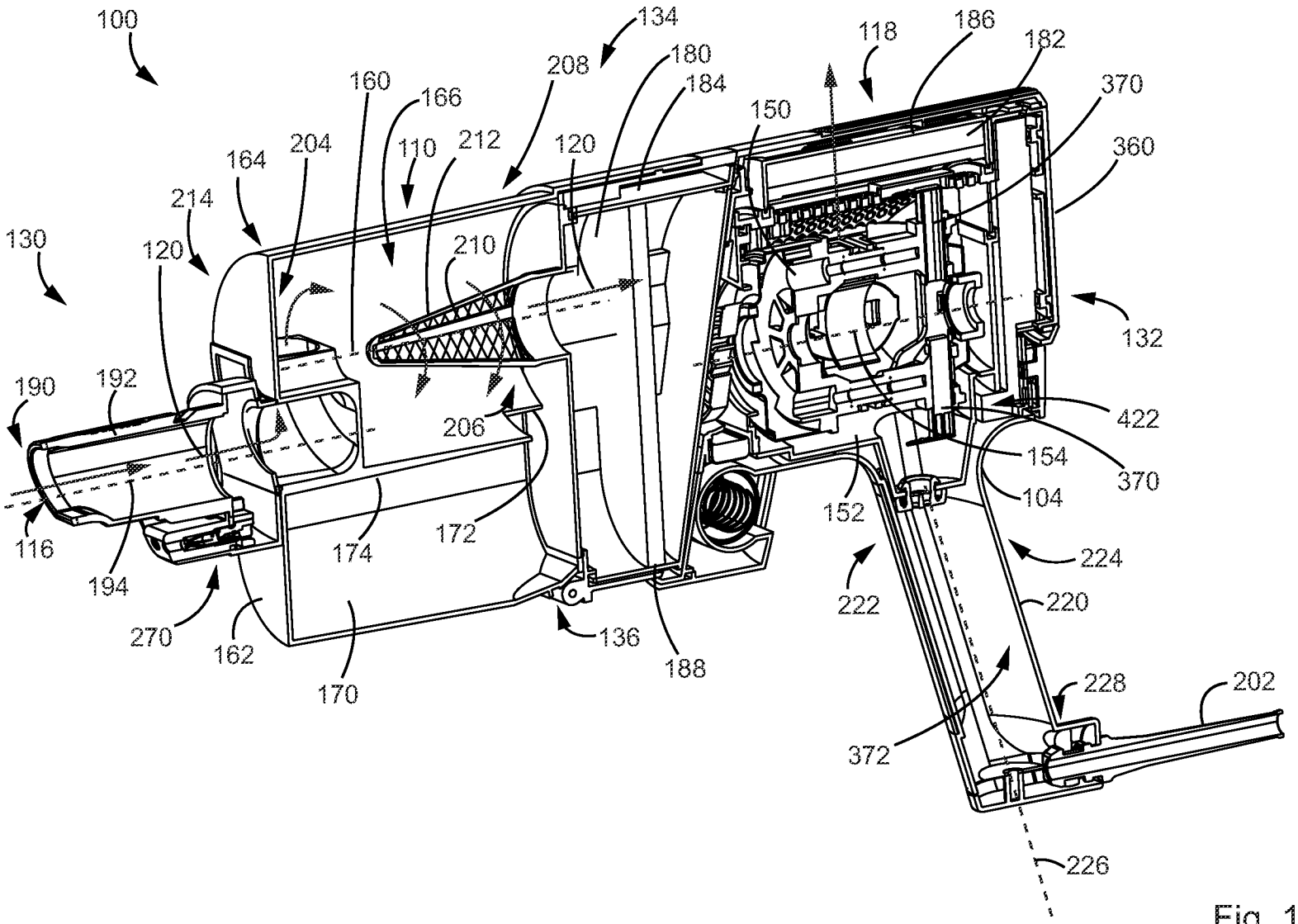
FIG. 19 is a side perspective cross sectional view, from the front, of the hand vacuum cleaner of FIG. 18.
Figure 30:
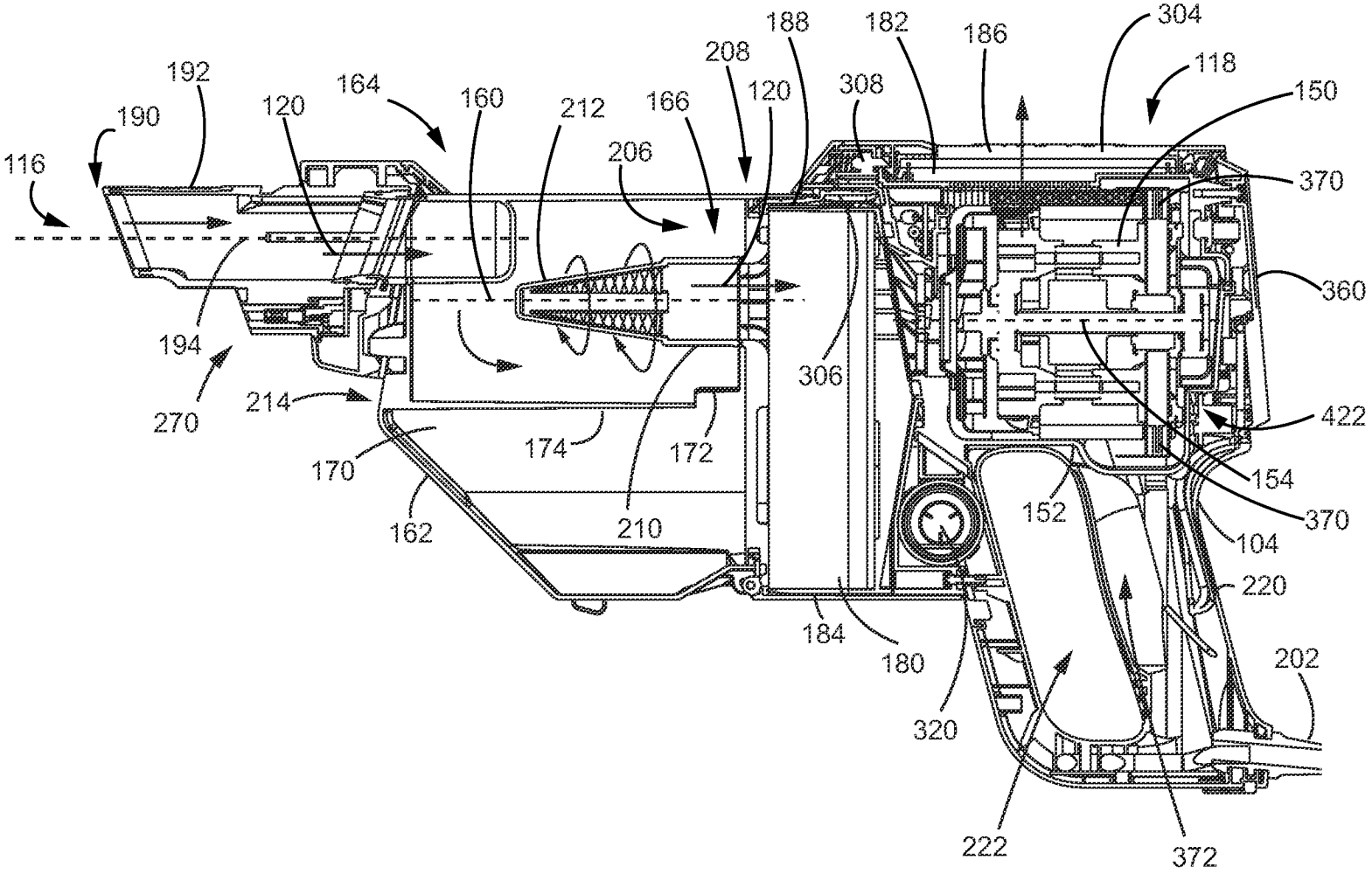
FIG. 30 is a cross sectional view of the hand vacuum cleaner of FIG. 29.
Figure 31:
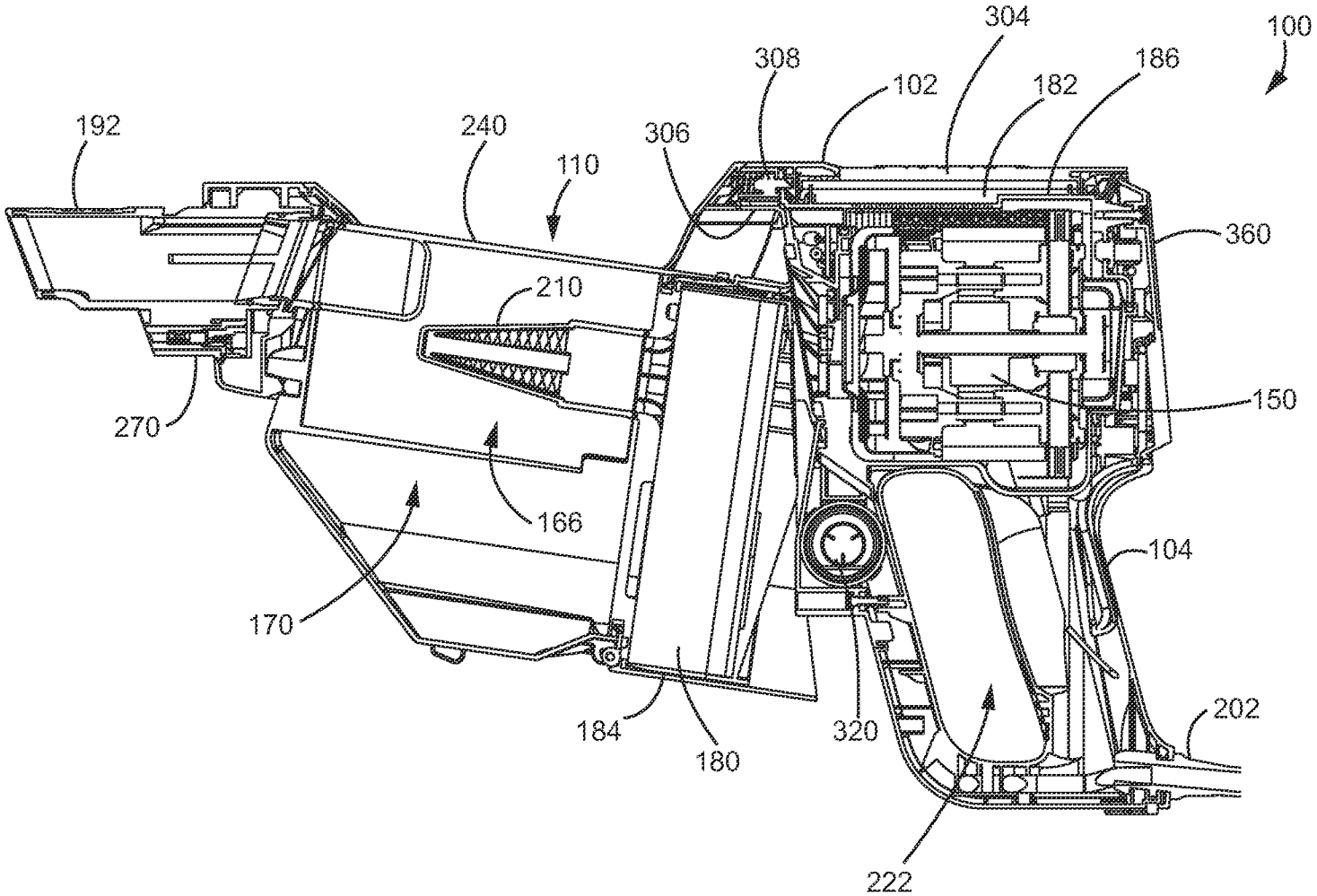
FIG. 31 is a cross sectional view of the hand vacuum cleaner of FIG. 29 with the air treatment member assembly in a first removed position.
Figure 32:
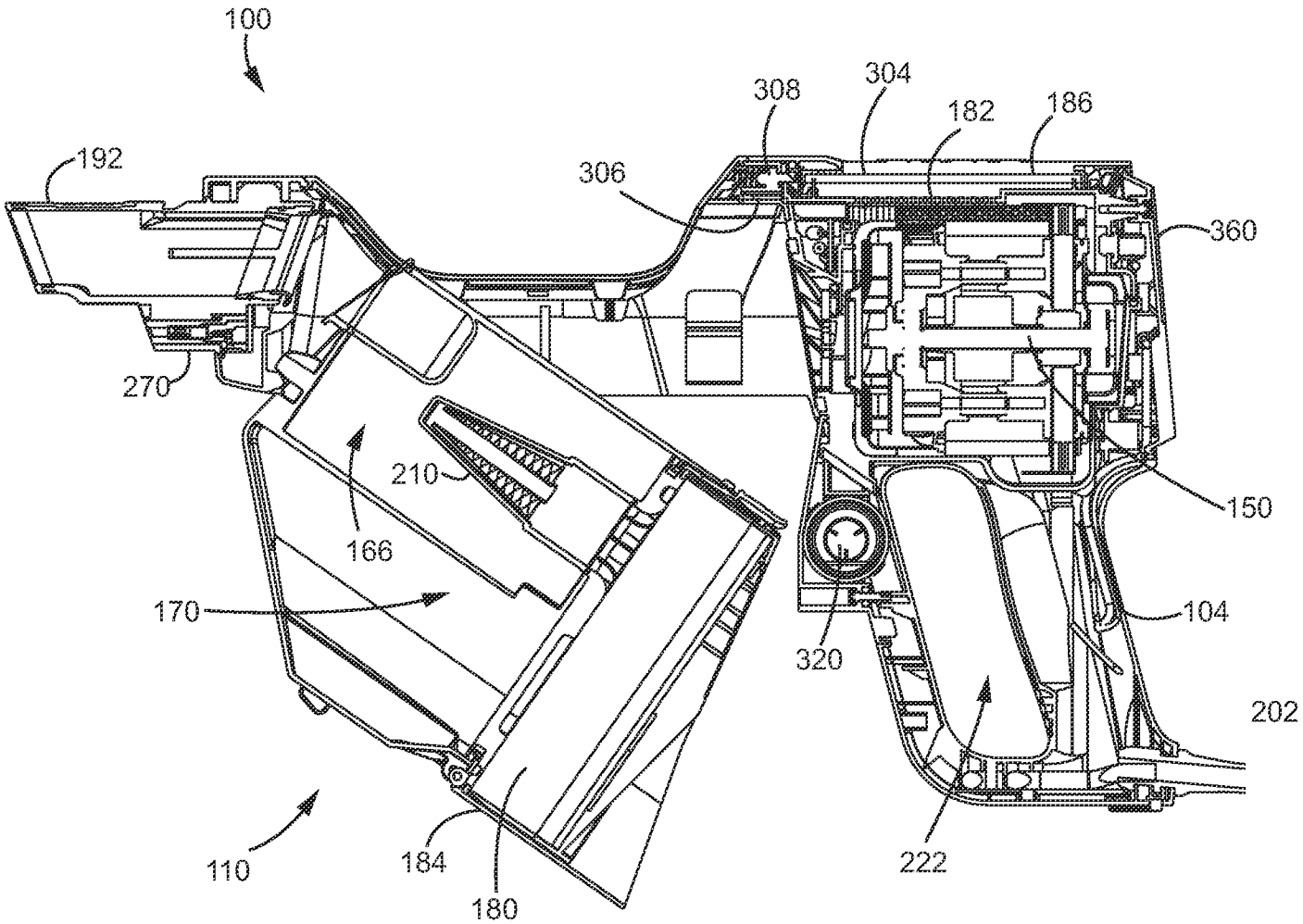
FIG. 32 is a cross sectional view of the hand vacuum cleaner of FIG. 29 with an air treatment member assembly in a further removed position.

As illustrated in FIGS. 2, 19, and 30, a portion of the motor 150 and/or the housing 152 may be recessed in the handle 104. The handle 104 may have an interior volume 372, and the portion of the suction motor 150 and/or housing 152 may extend (e.g., downwardly) into the interior volume 372 of the handle 104.

Figure 15:
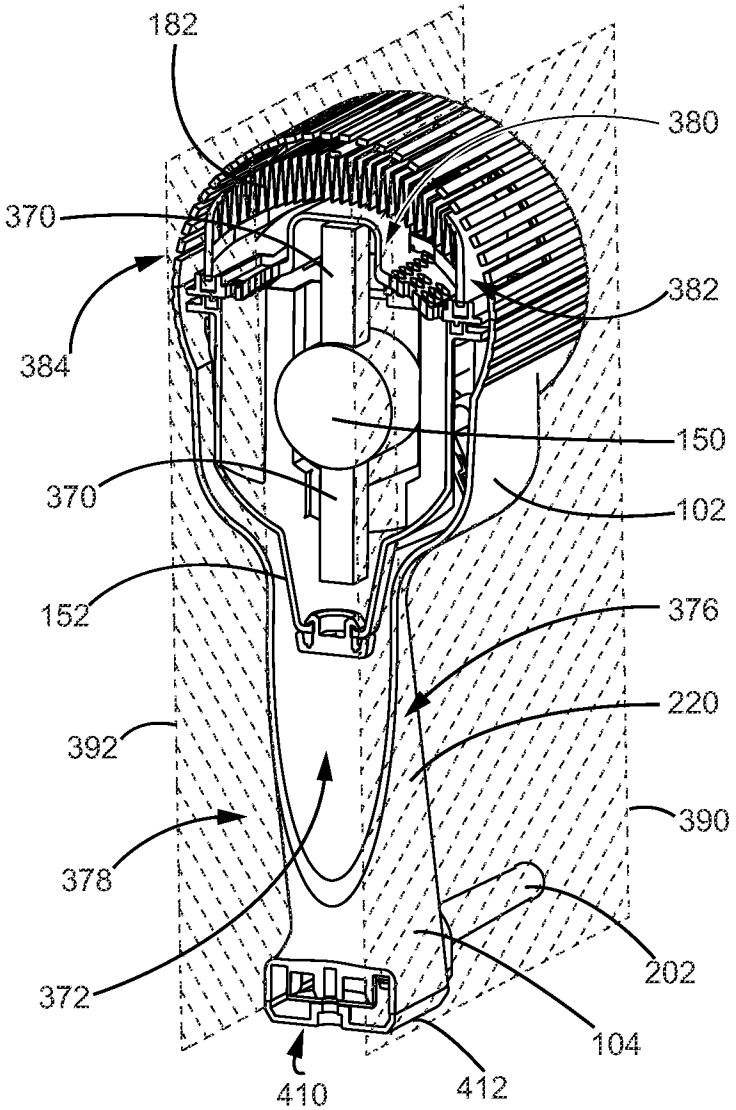
FIG. 15 is a front perspective cross sectional view of the hand vacuum cleaner of FIG. 1 showing parallel planes tangential to the sides of the handle.

As exemplified in FIG. 15, the handle 104 has first and second sides 376, 378 that are spaced apart. The first and second sides 376, 378 may be laterally opposed sides that are spaced apart in a direction transverse to the central longitudinal axis 144. A plane (e.g., a generally horizontal plane) that extends through the first and second sides 376, 378 may also extend through the suction motor 150 (e.g., one or more brushes 370 of the motor 150).

Alternately, or in addition, a portion of the motor 150 and/or the housing 152 may extend into the post-motor filter or post-motor filter housing. The portion may be opposite the handle 104 (e.g., the top portion of the motor 150), and may extend up into the region of the post-motor filter 182. As exemplified in FIG. 15, the post-motor filter 182 may have an interior volume 380 (i.e., a volume bounded on at least three sides by the post-motor filter 182), and the portion of the suction motor 150 and/or housing 152 may extend (e.g., upwardly) into the interior volume 380 of the post-motor filter 182.

The post-motor filter 182 has first and second sides 382, 384 that are spaced apart. The first and second sides 382, 384 may be laterally opposed sides that are spaced apart in a direction transverse to the central longitudinal axis 144. A plane (e.g., a generally horizontal plane) may extend through the two sides 382, 384 of the post-motor filter 182 and through the motor 150 (e.g., one or more brushes 370 of the motor 150).

As in the illustrated example, a brush 370 of the suction motor 150 extends upwardly into the interior volume 380 defined by the post-motor filter 182 and another brush 370 of the suction motor 150 extends downwardly into the interior volume 372 of the handle 104.

It will be understood that in some examples, only one of the brushes 370 may extend into the interior volume of an adjacent component or element of the surface cleaning apparatus 100.

It will also be understood that in some examples, more than two portions of the motor 150 and/or housing 152 may extend into an interior volume of one or more adjacent components or elements of the surface cleaning apparatus 100.

It will also be understood that in some examples, one component of the motor 150 and/or housing 152 may extend into the interior volume of more than one adjacent component or element of the surface cleaning apparatus 100.

It will also be understood that in some examples, more than one component of the motor 150 and/or housing 152 extends into the interior volume of a single adjacent component or element of the surface cleaning apparatus 100.

Power Line that Extends Through the Handle

The following is a description of a power line that extends through the handle, which may be used by itself or in combination with one of more of the uniflow cyclone, the open handle, the arcuate post-motor filter, the removable air treatment member, the accessory power connection on a removeable air treatment member, the filters are accessible when air treatment member is moved, the transversely extending bleed valve, the laterally directed inlet to the bleed valve, the rearwardly positioned control panel, the motor and/or motor housing extends into surrounding features, the brushes are centered, the handle is in-line with additional components, centrally positioned components, off-center components with a centered centre of gravity, the friction surface on a handle base, sound damping and an in-line vortex finder or air treatment member, which are set out herein.

In accordance with this aspect, the surface cleaning apparatus 100 includes a conductor 280 extending through the handle 104. The power line 280 may extend generally between a lower end 228 of the handle 104 and an upper end 224 of the handle 104. The power line 280 may enter the handle 104 at a rear of the handle 104 and extend to the motor 150 that is at the top of the handle 104 or that is within the handle 104 (e.g., if the motor extends into the handle). This aspect may be used by itself or in combination with one or more other aspects of this disclosure.

An electrical conductor or cable or line 280 may extend up through the handle 104 from a lower end of the handle (i.e., a pistol grip handle) to the upper end opposite the lower end. The conductor may extend to the bottom of the motor housing 152 at or in the upper end of the handle, and may extend from an electrical cord 202 provided at the lower end 136 of the handle 104.

At the motor and/or motor housing the conductor 280 may pass through a grommet 294 (e.g., a grommet in the portion of the motor 150 and/or the housing 152 that extends into the handle 104). The conductor 280 is configured to carry power in through the grommet 294 to power the suction motor.

In some examples, as illustrated, a conductor 280 also extends from within the motor housing 152 and/or motor 150 to the body connector 284 to supply power forward to the accessory connector 270 through the bin.

It will be appreciated that in any embodiment, the electrical circuit in the surface cleaning apparatus may include a power supply. The power supply may be positioned between the line 280 and the motor 150 and/or the accessory connector 270.

It will also be appreciated that conductor 280 may be an AC conductor or a power supply may be provided external to the surface cleaning apparatus 100 and the conductor 280 may be a low voltage DC conductor.

It will also be appreciated that any wiring circuit may be used to use conductor 280 to provide power to both motor 150 and accessory connector 270.

The Brushes are Centered

The following is a description of brushes of a suction motor 150 that are centered, which may be used by itself or in combination with one of more of the uniflow cyclone, the open handle, the arcuate post-motor filter, the removable air treatment member, the accessory power connection on a removeable air treatment member, the filters are accessible when air treatment member is moved, the transversely extending bleed valve, the laterally directed inlet to the bleed valve, the rearwardly positioned control panel, the motor and/or motor housing extends into surrounding features, the power line extends through the handle, the handle is in-line with additional components, centrally positioned components, off-center components with a centered centre of gravity, the friction surface on a handle base, sound damping and an in-line vortex finder or air treatment member, which are set out herein.

In accordance with this aspect, the brushes 370 of the motor 150 of the surface cleaning apparatus 100 are laterally centered. For example, a vertically and longitudinally extending centre plane of the surface cleaning apparatus 100 (e.g., axis 144 may extend through the plane) may intersect one or more, and optionally all of the brushes 370 of motor 150. Optionally, the plane may bisect the brushes. For example, the brushes 370 may be oriented directly above one another and the plane may extend through the brushes 370. Alternately, some or all of the brushes 370 may be located within a centrally located zone around the vertically and longitudinally extending centre plane. Optionally, at least two or all of the brushes 370 of the motor 150 may be centrally located. This aspect may be used by itself or in combination with one or more other aspects of this disclosure.

As discussed previously, a portion or all of each brush on the lower side of the motor 150 may extend into the handle 104. Similarly, a portion or all of each brush on the upper side of the motor 150 may extend into the volume defined by the post-motor filter.

Arranging the brushes 370 within a centrally located zone or in a central plane may also reduce torque and result in improved hand balance.

As exemplified in FIG. 15, in some examples the brushes 370 (e.g., at least two of the brushes) fall between vertical planes tangential to each side of the vortex finder 210 and/or the handle 104, even if the brushes 370 are not completely centered. For example, as exemplified, a first vertical plane 390 extends through the surface cleaning apparatus 100 and is tangent to a first side 376 of the handle 104 and a second vertical plane 392 extends through the surface cleaning apparatus 100 and is tangent to a second side 378 of the handle 104 that is laterally opposed to the first side 376, and the brushes 370 are positioned in a central zone between the first and second vertical planes 390, 392.

Figure 16:
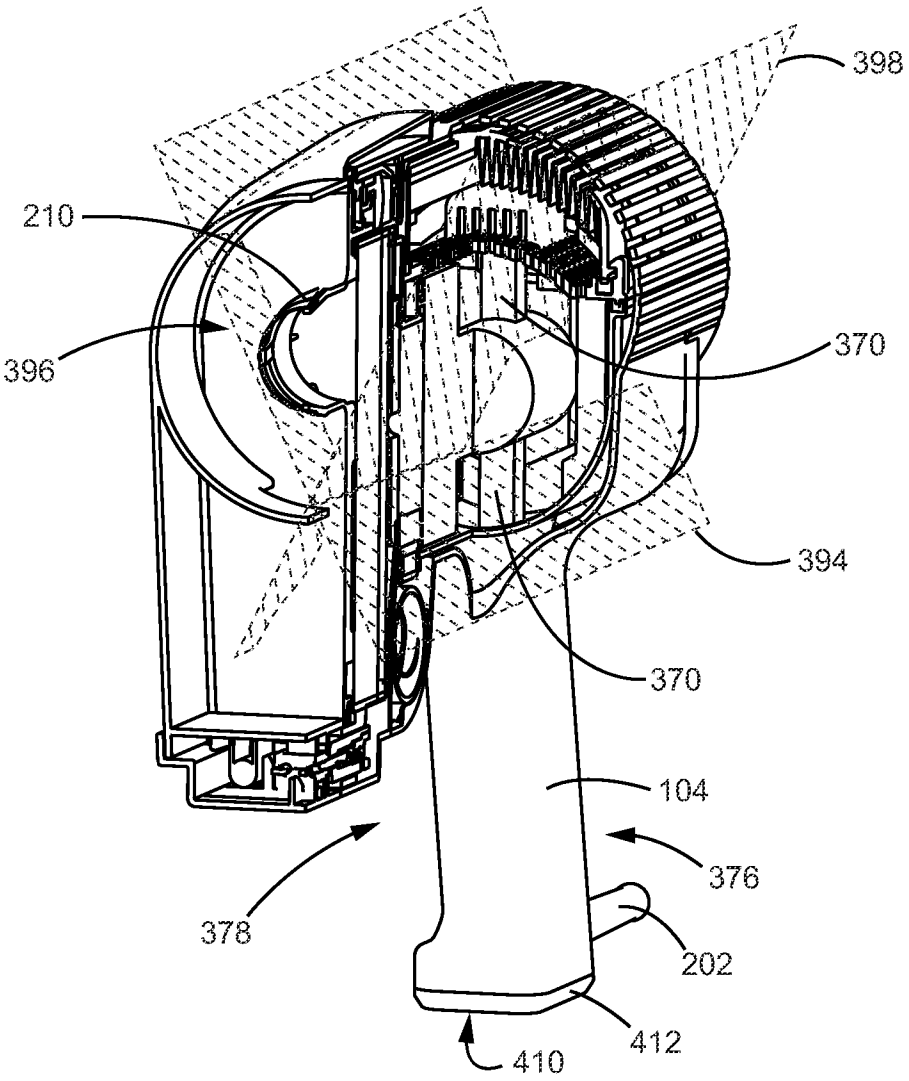
FIG. 16 is a front perspective cross sectional view of the hand vacuum cleaner of FIG. 1 showing angled planes tangential to the sides of the handle.

Alternately, as exemplified in FIG. 16, the brushes 370 (e.g., at least two of the brushes 370) are between two planes which extend at an angle as long as each plane extends through the handle 104 and is tangential to a side of the vortex finder 210 and/or the suction motor 150. For example, as exemplified, a first plane 394 extends through a right side 376 of the handle 104 and is tangent to the first or left side 396 of the vortex finder 210 and a second plane 398 extends through a left side 378 of the handle 104 that is laterally opposed to the right side 376 and is tangent to the second or right side (not shown) of the vortex finder 210, and the brushes 370 are positioned in a central zone between the first and second planes 394, 398. In other words, the brushes 370 are between the upper ends of the planes 394, 398 and/or between the lower ends of the planes 394, 398. In the illustrated example, one brush 370 is between the upper ends of the planes and one brush 370 is between the lower ends of the planes.

Alternately, one generally vertical plane may extend through the handle 104 and at least two of the brushes 370 (e.g., brushes on opposite ends of the suction motor 150). For example, referring to FIG. 15, a central vertical plane may be positioned between first and second vertical planes 390, 392. The central vertical plane may also extend through the vortex finder 210 and/or the bleed valve 320. Axis 144 may extend in the central vertical plane and the central vertical plane may bisect the vortex finder 210 and/or the bleed valve 320.

The Handle is in-Line with Additional Components

The following is a description of a handle that is in-line with additional components, which may be used by itself or in combination with one of more of the uniflow cyclone, the open handle, the arcuate post-motor filter, the removable air treatment member, the accessory power connection on a removeable air treatment member, the filters are accessible when air treatment member is moved, the transversely extending bleed valve, the laterally directed inlet to the bleed valve, the rearwardly positioned control panel, the motor and/or motor housing extends into surrounding features, the power line extends through the handle, the brushes are centered, the centrally positioned components, off-center components with a centered centre of gravity, the friction surface on a handle base, sound damping and an in-line vortex finder or air treatment member, which are set out herein.

In accordance with this aspect, the handle 104 of the surface cleaning apparatus 100 is in-line with at least one additional component of the surface cleaning apparatus 100. The handle 104 may be in-line with (e.g., an axis such as axis 144 may extend through the handle and) one or more of the bleed valve 320, the air treatment member 110, the dirt collection chamber 170, the pre-motor filter 180, the cyclone 166, the bin electrical connector 282 and an openable end of the air treatment member assembly 110 (e.g., the front openable door 290). It will be appreciated that the axis, e.g., axis 144, may bisect (in the lateral direction) the handle and one or more of the bleed valve 320, the air treatment member 110, the dirt collection chamber 170, the pre-motor filter 180, the cyclone 166, the bin electrical connector 282 and an openable end of the air treatment member assembly 110. The axis may not extend through the post motor filter 182.

Figure 14:
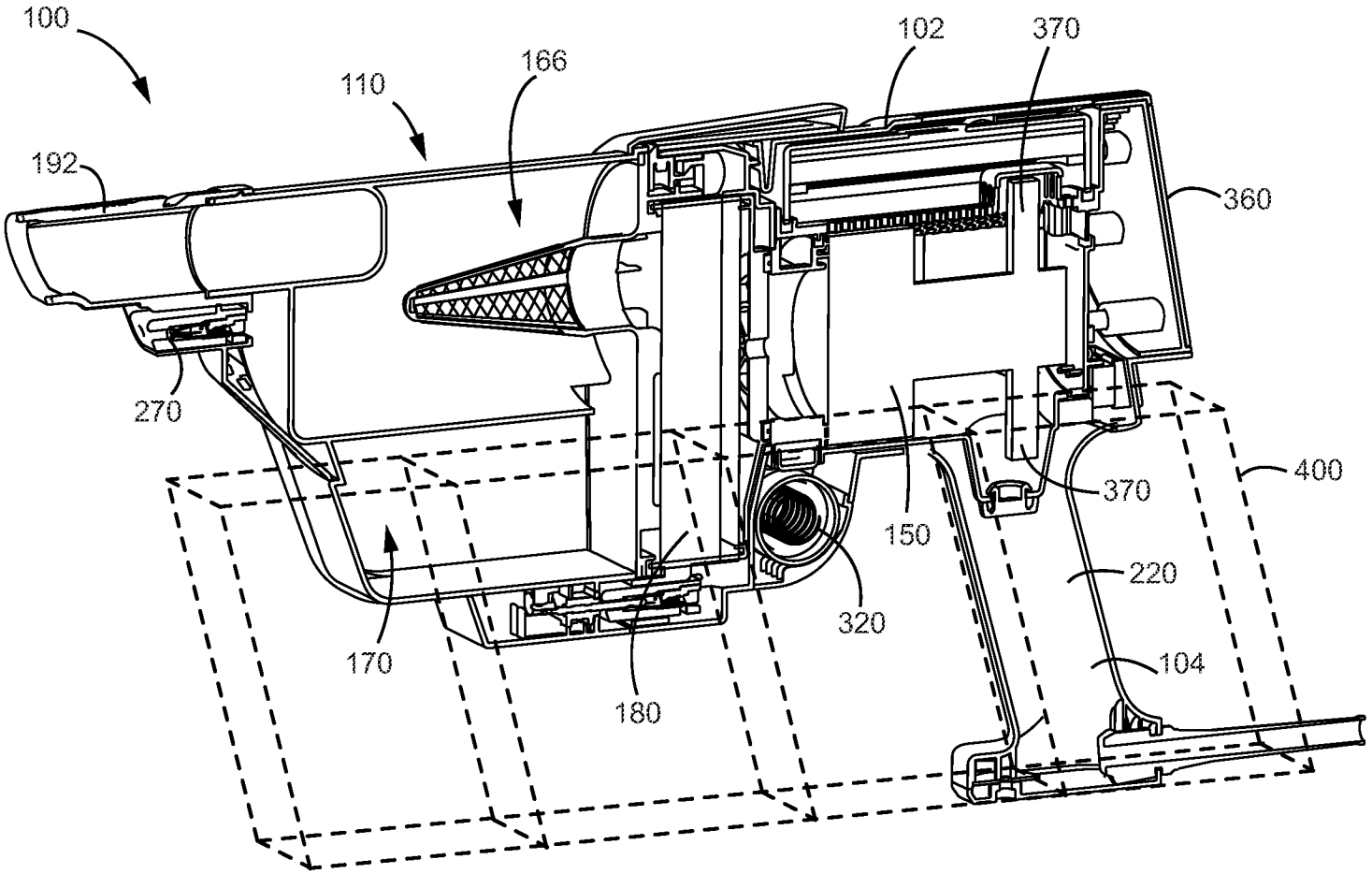
FIG. 14 is a front cross sectional view of the hand vacuum cleaner of FIG. 1 showing a projection of the handle.

As exemplified in FIG. 14, an axial projection 400 of the handle 104 may pass through forward and/or rearward through one or more of the bleed valve 320, the pre-motor filter 180, the air treatment member 110, the dirt collection chamber 170, the cyclone 166, the bin electrical connector 282 and the front openable door 290.

Aligning the handle 104 with one or more other component of the surface cleaning apparatus 100 may improve the hand feel of the surface cleaning apparatus 100.

Centrally Positioned Components

The following is a description of centrally positioned components, which may be used by itself or in combination with one of more of the uniflow cyclone, the open handle, the arcuate post-motor filter, the removable air treatment member, the accessory power connection on a removeable air treatment member, the filters are accessible when air treatment member is moved, the transversely extending bleed valve, the laterally directed inlet to the bleed valve, the rearwardly positioned control panel, the motor and/or motor housing extends into surrounding features, the power line extends through the handle, the brushes are centered, the handle is in-line with additional components, off-center components with a centered centre of gravity, the friction surface on a handle base, sound damping and an in-line vortex finder or air treatment member, which are set out herein.

In accordance with this aspect, one or more components of the surface cleaning apparatus 100 are centrally positioned. The components may be symmetrically positioned about one or more of a longitudinal and vertically centered (between the lateral sides of the surface cleaning apparatus) plane wherein axis 144 extends in the plane, a longitudinal and horizontally centered plane, and/or a transvers and vertically centered plane wherein axis 144 is perpendicular to the plane. This aspect may be used by itself or in combination with one or more other aspects of this disclosure.

Central and/or symmetrical positioning of one or more components may improve the balance of the surface cleaning apparatus 100 or otherwise improve the hand feel and/or the performance of the surface cleaning apparatus 100.

The longitudinal and horizontally centered plane may extend through one or more of the handle, the bleed valve 320, the air treatment member 110, the dirt collection chamber 170, the pre-motor filter 180, the bin electrical connector 282, the power connector 270, and an openable end of the air treatment member assembly 110 and may bisect one or more of these components.

The longitudinal and vertically centered plane may extend through one or more of the handle, the bleed valve 320, the air treatment member 110, the dirt collection chamber 170, the pre-motor filter 180, the bin electrical connector 282, the power connector 270, the post motor filter 182 and an openable end of the air treatment member assembly 110 and may bisect one or more of these components.

A component may be symmetrical about the longitudinal and horizontally centered plane and/or the longitudinal and vertically centered plane. For example, the pre-motor filter 180 may be substantially symmetrical about the centre line (e.g., symmetrical about a vertical plane and/or a horizonal plane) extending through the vortex finder 210, inlet conduit 192, and handle 104. As another example, batteries may be included and may be symmetrically positioned about one or both of these planes. As another example, the motor controls 360 may be generally symmetrical about one or both of these planes.

Off-Center Components with a Centered Centre of Gravity

The following is a description of off-center components with a centered centre of gravity, which may be used by itself or in combination with one of more of the uniflow cyclone, the open handle, the arcuate post-motor filter, the removable air treatment member, the accessory power connection on a removeable air treatment member, the filters are accessible when air treatment member is moved, the transversely extending bleed valve, the laterally directed inlet to the bleed valve, the rearwardly positioned control panel, the motor and/or motor housing extends into surrounding features, the power line extends through the handle, the brushes are centered, the handle is in-line with additional components, centrally positioned components, the friction surface on a handle base, sound damping and an in-line vortex finder or air treatment member, which are set out herein.

In accordance with this aspect, one or more of the components may be positioned such that a centre of gravity of the components is spaced from a desired location of the centre of gravity of the surface cleaning apparatus. However, the components may be positioned such that, in totality, surface cleaning apparatus has a centre of gravity at the desired location. For example, it may be desired to have a centre of gravity of a hand vacuum cleaner that is located in the centre of a pistol grip handle, or forward of the pistol grip handle but at a mid-point elevation between the top and bottom of the pistol grip handle. The components of the hand vacuum cleaner may be positioned such that the weight of each component, and the moment arm between the centre of gravity of the component and the desired location of the centre of gravity, resolve to produce a hand vacuum cleaner with a centre of gravity at the desired location. Accordingly, the non-centered components are balanced (e.g., weight-balanced) by one or more other components across a horizontal longitudinally extending plane and/or a vertical longitudinally extending plane. This aspect may be used by itself or in combination with one or more other aspects of this disclosure.

For example, the centre of gravity of the surface cleaning apparatus may be on the centre line 226 of the handle 104 (see FIG. 1) and at a mid-point elevation between the top and bottom of the pistol grip handle.

Alternately, the centre of gravity of the surface cleaning apparatus may be between parallel planes that are tangential to the vortex finder outer lateral edges and, optionally at a mid-point elevation between the top and bottom of the pistol grip handle.

Alternately, the centre of gravity of the surface cleaning apparatus may be within parallel planes that are tangential to the lateral sides of the motor 150 (i.e., is within the diameter of the motor 150) and, optionally at a mid-point elevation between the top and bottom of the pistol grip handle.

Alternately, the centre of gravity of the surface cleaning apparatus may be between the planes 390, 392 and/or the planes 394, 398 and, optionally at a mid-point elevation between the top and bottom of the pistol grip handle.

The centre of gravity of one or more, or each, component of the surface cleaning apparatus may be offset from a horizontal longitudinally extending plane and/or a vertical longitudinally extending plane or offset from a central zone (e.g., a zone between planes 390 and 392), while the centre of gravity of the surface cleaning apparatus is on the plane or within the central zone. For example, the centre of gravity of the motor 150 and/or optional batteries may be offset from axis 144.

In some examples, the handle 104 is substantially (e.g., more than 50%) to one side of a horizontal plane in which axis 144 extends while the post motor filter 182 is substantially (e.g., more than 50%) on the other side of the horizontal plane.

An advantage of this configuration is that the housing 102 and/or the surface cleaning apparatus 100 may look and feel symmetrical, while the components are positioned off-center but balanced.

Friction Surface on a Handle Base

The following is a description of a friction surface on a handle base, which may be used by itself or in combination with one of more of the uniflow cyclone, the open handle, the arcuate post-motor filter, the removable air treatment member, the accessory power connection on a removeable air treatment member, the filters are accessible when air treatment member is moved, the transversely extending bleed valve, the laterally directed inlet to the bleed valve, the rearwardly positioned control panel, the motor and/or motor housing extends into surrounding features, the power line extends through the handle, the brushes are centered, the handle is in-line with additional components, centrally positioned components, off-center components with a centered centre of gravity, sound damping and an in-line vortex finder or air treatment member, which are set out herein.

In accordance with this aspect, a lower surface of a handle 410, such as a lower surface of base 410 of the handle 104 of the surface cleaning apparatus 100, comprises, consists essentially of or consists of a high-friction or anti-skid surface 412 on a lower surface of the base 410 (see for example FIGS. 12 and 17). This aspect may be used by itself or in combination with one or more other aspects of this disclosure.

As exemplified in FIG. 17, the surface cleaning apparatus 100 may be placed down by a user when the user does not need the surface cleaning apparatus 100. The user may place the surface cleaning apparatus 100 on a counter, floor, or other generally horizontal surface in a leaning position, with the lower surface 412 of the base of the handle 104 resting on the counter, floor, or other surface and, optionally, a lateral side of the surface cleaning apparatus 100 leaning against a wall. If the lower surface 412 at the base of the handle 104 has a high-friction or anti-skid surface, the surface cleaning apparatus 100 may be prevented from falling from the leaning position due to the lower surface 412 sliding laterally against the counter, floor, or other generally horizontal surface.

Similarly, if the surface cleaning apparatus is a stick vacuum cleaner as exemplified in FIG. 1, then if the handle 104 is rested against the wall when the stick vacuum cleaner is in the storage position exemplified in FIG. 1, then the surface cleaning apparatus may remain in place without the weight of the hand vacuum cleaner causing the handle 104 to slide down the wall.

Part or all of the handle (e.g., a lower end of the handle 104) or the base of the handle 104 may be formed of a high-friction material (e.g., a rubberized plastic). This material will then also form the lower surface 412 of the handle 104. Alternatively, the base of the handle may be covered by a coating or removeable cover. The coating or removeable cover may be formed of and/or include a high-friction material (e.g., a rubberized plastic).

In some examples, the surface cleaning apparatus may include an energy storage pack (e.g., a battery pack) at the bottom of the handle 104. The lower surface 412 may be a lower surface of the energy storage pack. The high-friction material may form a lower surface of the energy storage pack and/or a lower surface of the handle 104 in which the energy storage pack is removably attached (e.g., to form a high-friction lower surface when the energy storage pack is detached).

Sound Damping

The following is a description of sound damping, which may be used by itself or in combination with one of more of the uniflow cyclone, the open handle, the arcuate post-motor filter, the removable air treatment member, the accessory power connection on a removeable air treatment member, the filters are accessible when air treatment member is moved, the transversely extending bleed valve, the laterally directed inlet to the bleed valve, the rearwardly positioned control panel, the motor and/or motor housing extends into surrounding features, the power line extends through the handle, the brushes are centered, the handle is in-line with additional components, centrally positioned components, off-center components with a centered centre of gravity, the friction surface on handle base and an in-line vortex finder or air treatment member, which are set out herein.

In accordance with this aspect, the motor housing or shroud which surrounds a motor has air flow passages or apertures 420 therethrough through which air that exits the suction motor 150 travels as the air flows towards the clean air outlet. These apertures 420 are sized to reduce the transmission of sound therethrough. According to this aspect, the apertures 420 may be smaller than the wavelength of some or all of the sound frequencies that are to be blocked (e.g., to reduce sound transmission at those frequencies). The apertures 420 may be at or near the air outlet 118. This aspect may be used by itself or in combination with one or more other aspects of this disclosure.

Certain sound frequencies generated by a suction motor 150 of a surface cleaning apparatus 100 may be aggravating to a user. These sounds may travel through the air flow path 120 and exit the surface cleaning apparatus via clean air outlet 118. The air flow path 120 may be constricted to reduce the transmission of these sounds. For example, the air flow path 120 may extend through small apertures that serve to inhibit the passage of these sound waves.

As illustrated in FIGS. 11, 28, and 33, the air flow path 120 extends to the clean air outlet 118. As exemplified, at or adjacent the clean air outlet 118 (e.g., within 10%, 5% or 2% of the total length of the air flow path) the air flow path passes through apertures 420. The apertures 420 are shaped to provide acoustic restriction over a range of noise frequencies but with minimal back pressure. The apertures 420 may each have a largest width (e.g., the diameter if the apertures are circular, or the longer width if the apertures are rectangular) that is smaller than the wavelength of the sound frequencies that are to be blocked. The largest width may be, e.g., 20 mm, 15 mm, 10 mm, or 5 mm.

As exemplified, if the clean air outlet is in an upper portion of the main body 102, then the apertures 420 may be provided in only the upper part of the housing or body 102. The rest of the housing or body 102, e.g., the bottom may be a closed area 422 (see for example FIGS. 2, 19, and 30) that is free of the outlet apertures 420. The angular extent of the bottom closed area may be 200°, 250°, or 270°.

As exemplified, the power cord 202 may pass through a sealed grommet 294 in the bottom closed area 422, to the motor 150 and control board 360.

In-Line Vortex Finder or Air Treatment Member

The following is a description of an in-line vortex finder or air treatment member, which may be used by itself or in combination with one of more of the uniflow cyclone, the open handle, the arcuate post-motor filter, the removable air treatment member, the accessory power connection on a removeable air treatment member, the filters are accessible when air treatment member is moved, the transversely extending bleed valve, the laterally directed inlet to the bleed valve, the rearwardly positioned control panel, the motor and/or motor housing extends into surrounding features, the power line extends through the handle, the brushes are centered, the handle is in-line with additional components, centrally positioned components, off-center components with a centered centre of gravity, the friction surface on handle base and sound damping, which are set out herein.

In accordance with this aspect, the vortex finder 210 and/or air treatment member 110 of the surface cleaning apparatus 100 is axially aligned with components of the surface cleaning apparatus 100. The vortex finder 210 and/or air treatment member 110 may be axially aligned with the suction motor 150 and/or accessory electrical connector 270. This aspect may be used by itself or in combination with one or more other aspects of this disclosure.

As exemplified in FIG. 13, an axial projection 362 of the vortex finder 210 and/or fluff screen 212 may extend through one or more of the suction motor 150, the accessory electrical connector 270, a volume defined by the post-motor filter, the pre-motor filter 180, the head space 350 downstream of the pre-motor filter 180, the control panel 360, and a brush 370 of the motor 150.

One or more of the handle 104, batteries, the post-motor filter 182, the bleed valve 320, and the pistol grip handle 104 may be exterior to the projection of the vortex finder 210 and/or the fluff screen 212.

As used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

Clause Set A

1. A hand vacuum cleaner comprising:
   (a) an air flow path extending from a dirty air inlet provided at a front end of the hand vacuum cleaner to a clean air outlet;
   (b) a main body housing a suction motor;
   (c) an air treatment member having a front end and a rear end with a central longitudinal axis extending between the front and rear ends;
   (d) a bleed valve having a bleed air flow path that extends from a bleed air inlet to a bleed air outlet; and,
   (e) a handle,
   wherein the hand vacuum cleaner has a front end having the dirty air inlet, a rear end axially spaced from the front end and first and second laterally opposed sides that are spaced apart in a direction transverse to the central longitudinal axis, and
   wherein the bleed air inlet and the bleed air outlet are transversely spaced apart.
2. The hand vacuum cleaner of clause 1 wherein the bleed valve has a bleed air passage extending from the bleed air inlet to the bleed air outlet and at least 75% of the bleed air passage extends generally transversely.
3. The hand vacuum cleaner of clause 1 wherein the bleed valve has a bleed air passage extending from the bleed air inlet to the bleed air outlet and the bleed air passage extends generally transversely.
4. The hand vacuum cleaner of clause 1 wherein the bleed valve has a longest dimension, and the longest dimension extends transversely.
5. The hand vacuum cleaner of clause 3 wherein the bleed air inlet is a plane that is generally parallel to the first laterally opposed side.
6. The hand vacuum cleaner of clause 1 wherein a plane that is parallel to the central longitudinal axis and that extends through the first and second laterally opposed sides also extends through the bleed valve and the pre-motor filter.
7. The hand vacuum cleaner of clause 1 wherein a plane that is parallel to the central longitudinal axis and that extends through the first and second laterally opposed sides also extends through the bleed valve, the pre-motor filter, and the handle.
8. The hand vacuum cleaner of clause 1 wherein a plane that is parallel to the central longitudinal axis and that extends through the first and second laterally opposed sides also extends through the bleed valve and the air treatment member.
9. The hand vacuum cleaner of clause 8 wherein the plane also extends through the pre-motor filter.
10. The hand vacuum cleaner of clause 8 wherein the plane also extends through the handle.
11. The hand vacuum cleaner of clause 9 wherein the plane also extends through the handle.
12. The hand vacuum cleaner of clause 1 further comprising a finger gap provided between the handle and the main body and the bleed valve is positioned in the main body between the finger gap and a pre-motor filter.
13. The hand vacuum cleaner of clause 1 wherein the main body has a portion in which the bleed valve is positioned, a finger gap is provided between the handle and the portion of the main body and the portion of the main body forms part of a forward side of the finger gap.
14. The hand vacuum cleaner of clause 1 wherein a first vertical plane that is parallel to the central longitudinal axis and that extends centrally between the first and second laterally opposed sides bisects the bleed valve.
15. The hand vacuum cleaner of clause 1 wherein a first vertical plane that is parallel to the central longitudinal axis extends through the bleed valve, the bleed air flow path has a longest dimension that extends transversely in a second plane that is transverse to the first vertical plane.
16. A hand vacuum cleaner comprising:
   (a) an air flow path extending from a dirty air inlet provided at a front end of the hand vacuum cleaner to a clean air outlet;
   (b) a main body housing a suction motor;
   (c) an air treatment member having a front end and a rear end with a central longitudinal axis extending between the front and rear ends;
   (d) a bleed valve having a bleed air flow path that extends from a bleed air inlet to a bleed air outlet; and, (e) a handle, wherein the hand vacuum cleaner has a front end having the dirty air inlet, a rear end axially spaced from the front end and first and second laterally opposed sides, and wherein the central longitudinal axis extends through the bleed valve, and a second axis that is transverse to the central longitudinal axis extends through a longest dimension of the bleed air flow path and first and second laterally opposed sides.

17. The hand vacuum cleaner of clause 16 wherein a plane in which the central longitudinal axis extends bisects the bleed valve.
18. The hand vacuum cleaner of clause 16 wherein the main body has a portion in which the bleed valve is positioned, a finger gap is provided between the handle and the portion of the main body and the portion of the main body forms part of a forward side of the finger gap.
19. The hand vacuum cleaner of clause 16 wherein a first plane that is parallel to the central longitudinal axis and that extends through first and second laterally opposed sides also extends through the bleed valve, the pre-motor filter, and the handle.
20. The hand vacuum cleaner of clause 19 wherein the handle is a pistol grip handle.

Clause Set B

1. A hand vacuum cleaner comprising:
   (a) an air flow path extending from a dirty air inlet to a clean air outlet;
   (b) a cyclone having a vortex finder, a front end, a rear end and a central axis of rotation that extends between the front and rear ends, wherein the vortex finder has right and left laterally opposed sides;
   (c) a main body housing a suction motor, the suction motor has brushes, the main body has right and left laterally opposed sides that are spaced apart in a direction transverse to the central longitudinal axis; and,
   (d) a handle having right and left laterally opposed side,
   wherein a first plane extends through the right laterally opposed side of the handle and is tangent to the left laterally opposed side of the vortex finder, a second plane extends through the left laterally opposed side of the handle and is tangent to the right laterally opposed side of the vortex finder and the brushes are positioned between the first and second planes.
2. The hand vacuum cleaner of clause 1 wherein a first vertical plane extends through the hand vacuum cleaner and is tangent to the first laterally opposed side of the vortex finder, a second vertical plane extends through the hand vacuum cleaner and is tangent to the second laterally opposed side of the vortex finder and the brushes are positioned between the first and second vertical planes.
3. The hand vacuum cleaner of clause 1 wherein the handle is a pistol grip handle and a third vertical plane extends through the pistol grip handle and the brushes.
4. The hand vacuum cleaner of clause 3 wherein the third vertical plane also extends through the vortex finder.
5. The hand vacuum cleaner of clause 4 further comprising a bleed valve and the third vertical plane also extends through the bleed valve.
6. The hand vacuum cleaner of clause 5 wherein the third vertical plane bisects the bleed valve.
7. The hand vacuum cleaner of clause 1 further comprising a post-motor filter housing and a portion of the suction motor extends upwardly into an interior volume of the post-motor filter housing.
8. The hand vacuum cleaner of clause 5 wherein a portion of the brushes extend upwardly into an interior volume of the post-motor filter housing.
9. The hand vacuum cleaner of clause 6 wherein a post-motor filter is receivable in the post-motor filter housing, the post-motor filter has a longest dimension in a direction of the central longitudinal axis and the post-motor filter is arcuate in cross-section in a plane transverse to the central longitudinal axis.
10. The hand vacuum cleaner of clause 8 wherein a portion of the brushes extends downwardly into an interior volume of the handle.
11. The hand vacuum cleaner of clause 1 wherein a portion of the brushes extends downwardly into an interior volume of the handle.
12. The hand vacuum cleaner of clause 11 further comprising a post-motor filter housing and a portion of the suction motor extends upwardly into an interior volume of the post-motor filter housing.
13. The hand vacuum cleaner of clause 1 wherein a central vertical plane that is parallel to the central longitudinal axis and that extends centrally between the first and second laterally opposed sides bisects the bleed valve.
14. The hand vacuum cleaner of clause 1 wherein a central vertical plane that is parallel to the central longitudinal axis extends through the bleed valve, the bleed air flow path has a longest dimension that extends transversely in a second plane that is transverse to the central vertical plane.

Clause Set C

1. A hand vacuum cleaner comprising:
   (a) an air flow path extending from a dirty air inlet provided at a front end of the hand vacuum cleaner to a clean air outlet;
   (b) a main body housing a suction motor;
   (c) an air treatment member having a front end and a rear end with a central longitudinal axis extending between the front and rear ends;
   (d) a bleed valve; and,
   (e) a handle having an upper end that is provided on the main body,
   wherein a forward projection of the handle extends through the bleed valve.
2. The hand vacuum cleaner of clause 1 wherein the handle is a pistol grip handle.
3. The hand vacuum cleaner of clause 2 wherein the handle extends downwardly from a portion of the main body that houses the suction motor.
4. The hand vacuum cleaner of clause 1 further comprising a pre-motor filter and the forward projection of the handle passes through the pre-motor filter.
5. The hand vacuum cleaner of clause 4 wherein the forward projection of the handle passes through the air treatment member.
6. The hand vacuum cleaner of clause 5 wherein the air treatment member comprises a dirt collection chamber external to an air treatment chamber and the forward projection of the handle passes through the dirt collection chamber.

7. The hand vacuum cleaner of clause 1 wherein the forward projection of the handle passes through the air treatment member.
8. The hand vacuum cleaner of clause 7 wherein the air treatment member comprises a dirt collection chamber external to an air treatment chamber and the forward projection of the handle passes through the dirt collection chamber.
9. The hand vacuum cleaner of clause 1 wherein the hand vacuum cleaner has right and left laterally opposed sides that are spaced apart in a direction transverse to the central longitudinal axis, and the bleed valve has a bleed valve air inlet that is in a plane that is generally parallel to one of the right and left laterally opposed sides.
10. The hand vacuum cleaner of clause 1 wherein the hand vacuum cleaner has right and left laterally opposed sides that are spaced apart in a direction transverse to the central longitudinal axis, and the bleed valve has a bleed valve air flow path that extends between a bleed valve air inlet and a bleed valve air outlet and the bleed valve air flow path has a longest dimension that extends in the transverse direction.

Clause Set D

1. A hand vacuum cleaner comprising:
   (a) an air flow path extending from a dirty air inlet provided at a front end of the hand vacuum cleaner to a clean air outlet;
   (b) a main body housing a suction motor;
   (c) an air treatment member having a front end and a rear end with a central longitudinal axis extends between the front and rear ends;
   (d) a bleed valve having a bleed air flow path that extends from a bleed air inlet to a bleed air outlet; and,
   (e) a handle,
   wherein the hand vacuum cleaner has right and left laterally opposed sides that are spaced apart in a direction transverse to the central longitudinal axis, and the bleed valve air inlet that is in a plane that is generally parallel to one of the right and left laterally opposed sides.
2. The hand vacuum cleaner of clause 1 wherein a vertical plane that is parallel to the central longitudinal axis and that extends centrally between the right and left laterally opposed sides extends through the bleed valve.
3. The hand vacuum cleaner of clause 2 wherein the vertical plane bisects the bleed valve.
4. The hand vacuum cleaner of clause 1 wherein a vertical plane that is parallel to the central longitudinal axis extends through the bleed valve, and the bleed air flow path has a longest dimension that extends transversely in a horizontal plane that is transverse to the vertical plane.
5. The hand vacuum cleaner of clause 1 wherein the bleed valve air inlet comprises a first inlet on the right latterly opposed side and a second inlet on the left latterly opposed side.
6. The hand vacuum cleaner of clause 1 wherein the air treatment member is positioned forward of the suction motor, the suction motor has an axis of rotation and the suction motor axis of rotation is parallel to the central longitudinal axis.
7. The hand vacuum cleaner of clause 6 wherein the suction motor axis of rotation is vertically spaced from the central longitudinal axis.
8. The hand vacuum cleaner of clause 2 further comprising a pre-motor filter and the pre-motor filter has a vertical length in the vertical plane that is greater than a vertical length of the suction motor in a second vertical plane that is parallel to the vertical plane.
9. The hand vacuum cleaner of clause 1 wherein a horizontal plane that extends between the right and left laterally opposed sides extends through the bleed valve and the handle.
10. The hand vacuum cleaner of clause 9 further comprising a finger grip area between the handle and the main body and the horizontal plane extends through the finger gap area.

Clause Set E

1. A hand vacuum cleaner comprising:
   (a) an air flow path extending from a dirty air inlet provided at a front end of the hand vacuum cleaner to a clean air outlet;
   (b) a main body housing a suction motor;
   (c) an air treatment member having a front end and a rear end with a central longitudinal axis extending between the front and rear ends;
   (d) a bleed valve having a bleed air flow path that extends from a bleed air inlet to a bleed air outlet; and,
   (e) a handle,
   wherein the hand vacuum cleaner has right and left laterally opposed sides that are spaced apart in a direction transverse to the central longitudinal axis, a first vertical plane that is parallel to the central longitudinal axis and that extends centrally between the right and left laterally opposed sides extends through the bleed valve and the bleed air flow path has a longest dimension that extends generally transversely in a horizontal plane that is transverse to the first vertical plane.
2. The hand vacuum cleaner of clause 1 wherein the vertical plane bisects the bleed air flow path.
3. The hand vacuum cleaner of clause 1 wherein the bleed valve air inlet that is in a plane that is generally parallel to one of the right and left laterally opposed sides.
4. The hand vacuum cleaner of clause 1 wherein a second vertical plane that is transverse to the first vertical plane extends through the right and left laterally opposed sides, the section motor, the handle and a post-motor filter.
5. The hand vacuum cleaner of clause 4 wherein the post-motor filter overlies the suction motor.
6. The hand vacuum cleaner of clause 4 wherein the post-motor filter has a longest dimension in a direction of the central longitudinal axis and the post-motor filter is arcuate in cross-section in the second vertical plane.
7. The hand vacuum cleaner of clause 4 wherein the handle is a pistol grip handle that extends downwardly from a portion of the main body that houses the suction motor.
8. The hand vacuum cleaner of clause 7 wherein the pistol grip handle has a handle axis that extends through a hand grip portion of the pistol grip handle and intersects the suction motor.

9. The hand vacuum cleaner of clause 1 wherein the handle is a pistol grip handle that extends downwardly from a portion of the main body that houses the suction motor.

10. The hand vacuum cleaner of clause 9 wherein the pistol grip handle has a handle axis that extends through a hand grip portion of the pistol grip handle and intersects that suction motor.

11. The hand vacuum cleaner of clause 1 wherein a horizontal plane that extends between the right and left laterally opposed sides extends through the bleed valve, the handle and the air treatment member.

12. The hand vacuum cleaner of clause 12 wherein the horizontal plane extends through a pre-motor filter.

13. The hand vacuum cleaner of clause 12 wherein the horizontal plane is external to the suction motor.

The invention claimed is:

1. A hand vacuum cleaner having a front end, a rear end, and a vacuum axis extending longitudinally from the front end to the rear end of the hand vacuum cleaner, the hand vacuum cleaner comprising:

(a) an air flow path extending from a dirty air inlet, which is provided at the front end of the hand vacuum cleaner, to a clean air outlet;

(b) a front electrical connector and electrical conductors which have a length from the front electrical connector to a source of power;

(c) a body housing a suction motor and fan assembly that is positioned in the air flow path; and, (d) a cyclone unit having a cyclone chamber, a front end comprising a front wall, a rear end comprising a rear wall, a sidewall extending rearwardly from the front wall to the rear wall and a cyclone axis of rotation extending longitudinally from the front end to the rear end of the cyclone unit, wherein the cyclone axis of rotation is parallel with the vacuum axis, and wherein a first portion of the length of the electrical conductors extends along a portion of the front wall and a second portion of the length extends along the side wall of the cyclone unit, whereby, when a cleaning tool is connected to the hand vacuum cleaner, the cleaning tool is connected in air flow communication with the dirty air inlet and the cleaning tool is electrically connected to the front electrical connector.

2. The hand vacuum cleaner of claim 1 wherein the first portion of the length of the electrical conductors extend in a direction generally transverse to the cyclone axis of rotation along the front end of the cyclone unit.

3. The hand vacuum cleaner of claim 2 wherein a portion of the sidewall along which the electrical conductors extend comprises a bottom surface of the cyclone unit.

4. The hand vacuum cleaner of claim 1 wherein the electrical conductors extend along a portion of an outer perimeter of the cyclone unit.

5. The hand vacuum cleaner of claim 1 wherein the electrical conductors extend along a portion of an outer perimeter of the cyclone chamber.

6. The hand vacuum cleaner of claim 1 wherein the sidewall is moveable relative to the body.

7. The hand vacuum cleaner of claim 6 wherein the body has a body electrical connector, and the cyclone unit has a cyclone unit electrical connector wherein the cyclone unit electrical connector is disconnected from the body electrical connector when the sidewall is moved relative to the body.

8. The hand vacuum cleaner of claim 1 wherein the rear wall of the cyclone unit is moveably mounted to the cyclone unit between a closed position in which the hand vacuum cleaner is operable to clean a surface and an open position in which the cyclone unit is opened and material which has collected in the cyclone unit is emptyable.

9. The hand vacuum cleaner of claim 1, wherein the portion of the front wall along which the first portion of the length of the electrical conductors extend comprises at least a portion of an inner surface of the front wall of the cyclone unit.

10. A hand vacuum cleaner having a front end, rear end, upper end, and a bottom end, the hand vacuum cleaner comprising:

(a) an air flow path extending from a dirty air inlet, which is provided at an upper portion of the front end of the hand vacuum cleaner, to a clean air outlet;

(b) a front electrical connector and electrical conductors that extend from the front electrical connector to a source of power;

(c) a body housing a suction motor and fan assembly that is positioned in the air flow path; and, (d) an air treatment member having an air treatment chamber, a front end, a rear end and a central longitudinal axis extending centrally through the air treatment chamber from the front end to the rear end of the air treatment chamber, and a front end of the air treatment chamber comprises a front wall and, when the hand vacuum cleaner is oriented with the central longitudinal axis extending horizontally and the dirty air inlet positioned at the upper portion of the front end of the hand vacuum cleaner, the air treatment chamber has a planar bottom wall that extends rearwardly from the front wall, wherein the electrical conductors extend along the front wall and the bottom wall of the air treatment member, whereby, when a cleaning tool is connected to the hand vacuum cleaner, the cleaning tool is connected in air flow communication with the dirty air inlet and the cleaning tool is electrically connected to the front electrical connector.

11. The hand vacuum cleaner of claim 10 wherein at least a portion of the electrical conductors extend in a direction generally transverse to the central longitudinal axis along the front end of the air treatment member.

12. The hand vacuum cleaner of claim 10 wherein the electrical conductors extend along a portion of an outer perimeter of the air treatment member.

13. The hand vacuum cleaner of claim 10 wherein the electrical conductors extend along a portion of an outer perimeter of the air treatment chamber.

14. The hand vacuum cleaner of claim 10 wherein the front electrical connector is centrally positioned on the front end of the air treatment chamber.

15. The hand vacuum cleaner of claim 10 wherein the air treatment member comprises a sidewall that is moveable relative to the body.

16. The hand vacuum cleaner of claim 15 wherein the body has a body electrical connector, and the air treatment member has an air treatment member electrical connector wherein the air treatment member electrical connector is disconnected from the body electrical connector when the sidewall is moved relative to the body.

17. The hand vacuum cleaner of claim 10 wherein a rear wall of the air treatment member is moveably mounted to the air treatment member between a closed position in which the hand vacuum cleaner is operable to clean a surface and an open position in which the air treatment member is opened and material which has collected in the air treatment member is emptyable.

* * * * *